US006468710B1

(12) United States Patent
Yasuda

(10) Patent No.: US 6,468,710 B1
(45) Date of Patent: Oct. 22, 2002

(54) SILVER HALIDE PHOTOGRAPHIC LIGHT-SENSITIVE MATERIAL

(75) Inventor: Shoji Yasuda, Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/964,732

(22) Filed: Sep. 28, 2001

(51) Int. Cl.[7] ..... G03C 1/09; G03C 1/295; G03C 1/38

(52) U.S. Cl. ..... 430/264; 430/523; 430/539; 430/631; 430/635; 430/636; 430/637

(58) Field of Search ..... 430/264, 523, 430/539, 528, 529, 631, 636, 635, 637

(56) References Cited

U.S. PATENT DOCUMENTS 5,550,003 A * 8/1996 Inoue ..... 430/264
6,013,410 A * 1/2000 Arai ..... 430/264
6,100,022 A * 8/2000 Inoue et al. ..... 430/264

* cited by examiner

*Primary Examiner*—Richard L. Schilling
(74) *Attorney, Agent, or Firm*—Sughrue Mion, PLLC

(57) ABSTRACT

A silver halide photographic light-sensitive material that has at least one silver halide emulsion layer on a support, the light-sensitive material containing a surfactant represented by the following formula (F), and having the characteristic curve that a gamma in the range of an optical density from 0.3 to 3.0 is 5.0 or more, on the characteristic curve shown in a rectangular coordinate where a logarithmic exposure amount (the x axis) and an optical density (the y axis) are indicated according to the same unit length;

$$[Rf—(Rc)_n]_m—Z \qquad \text{formula (F)}$$

wherein Rf represents a perfluoroalkyl group, Rc represents an alkylene group, Z represents a group having an anionic group, cationic group, amphoteric ionic group, or nonionic polar group, n is an integer of 0 or 1, and m is an integer of 1 to 3.

12 Claims, 1 Drawing Sheet

SILVER HALIDE PHOTOGRAPHIC LIGHT-SENSITIVE MATERIAL

FIELD OF THE INVENTION

The present invention relates to a silver halide photographic light-sensitive material, and to a method of forming a high-contrast negative image by using the light-sensitive material. Specifically, the present invention relates to an ultrahigh-contrast negative-type photographic light-sensitive material suitable for a silver halide light-sensitive material used in a photomechanical process, and to a method of forming an image by using the light-sensitive material.

BACKGROUND OF THE INVENTION

In a photomechanical process in the field of graphic arts, a method is adopted in which a photographic image having a continuous gradation is converted into a so-called dot image, for expressing the shade of an image by a difference in the size of a dot area, and the dot image is combined with an image obtained by taking photographs of letterings and line originals, to thereby produce a printing master plate. It has been required for a silver halide light-sensitive material used in such an application to have ultrahigh-contrast photographic characteristics, such that an image portion is clearly separated from a non-image ortion, to improve the reproducibility of letterings, line originals, and dot images.

As a system meeting the demand for the ultrahigh-contrast photographic characteristics, the so-called lithographic developing system has been known, in which a silver halide light-sensitive material containing silver chlorobromide is processed in a hydroquinone developer, in which the effective concentration of a sulfite ion is made extremely low, to form a high-contrast image. However, since the concentration of a sulfite ion in the developer is low in this system, the developer is extremely unstable against air oxidation, requiring a large amount of a replenishing developer to maintain stable activity of the solution.

Image formation systems capable of obtaining ultrahigh-contrast photographic properties through development with a processing solution having good storage stability, solving the instability problem concerning the image formation in the lithographic developing system, are disclosed, for example, in U.S. Patents Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746, and the like. These patents disclose the system in which a surface-latent-image-type silver halide photographic light-sensitive material, to which a hydrazine derivative is added, is processed using a developer containing, as a developing agent, hydroquinone/metol or hydroquinone/phenidone containing 0.15 mol/l or more of a sulfurous acid preservative, and having a pH of 11.0 to 12.3, to form an ultrahigh-contrast negative image having a γ value exceeding 10. According to this system, ultrahigh-contrast and highly-sensitive photographic characteristics are obtained. Also, a high-density sulfite can be added in the developer, and therefore the stability of the developer against air oxidation is improved more outstandingly than that of a conventional lithographic developer.

In order to complete a high-contrast image formation using hydrazine derivatives, it is necessary to process with a developing solution having a pH of 11 or more, usually 11.5 or more. Even though the use of a high-density sulfurous acid preservative makes it possible to heighten the stability of a developer, it is necessary to use such a developer having a high pH value as aforementioned, to obtain an ultrahigh-contrast photographic image. Therefore, even if the preservative is present, the developer is easily oxidized and hence unstable. To solve this problem, attempts have been made to attain an ultrahigh-contrast image at lower pHs, to improve the stability further.

For example, U.S. Pat. No. 4,269,929 (JP-A-61-267759 (the term "JP-A-" as used herein means an unexamined published Japanese patent application)), U.S. Pat. No. 4,737,452 (JP-A-60-179734), U.S. Pat. Nos. 5,104,769 and 4,798,780, JP-A-1-179939, JP-A-1-179940, U.S. Pat. Nos. 4,998,604 and 4,994,365, and JP-A-8-272023 disclose methods using a highly active hydrazine derivative and a nucleation accelerator, to obtain an ultrahigh-contrast image, by using a developer having a pH of less than 11.0.

Silver halide photographic light-sensitive materials used in such an image-formation system self-contains a highly active compound, posing problems concerning storage stability, such as variation in sensitivity and increased fogging during storing. Therefore, a need has existed for silver halide photographic light-sensitive materials that are improved in terms of these drawbacks.

SUMMARY OF THE INVENTION

The present invention is a silver halide photographic light-sensitive material that has at least one silver halide emulsion layer on a support, the light-sensitive material containing a surfactant represented by the following formula (F), and having the characteristic curve that a gamma in the range of an optical density from 0.3 to 3.0 is 5.0 or more, on the characteristic curve shown in a rectangular coordinate where a logarithmic exposure amount (the x axis) and an optical density (the y axis) are indicated according to the same unit length;

$$[Rf-(Rc)_n]_m-Z \qquad \text{formula (F)}$$

wherein Rf represents a perfluoroalkyl group, Rc represents an alkylene group, Z represents a group having an anionic group, cationic group, amphoteric ionic group, or nonionic polar group, n is an integer of 0 or 1, and m is an integer of 1 to 3.

Other and further features and advantages of the invention will appear more fully from the following description, taken in connection with the accompanying drawing.

DETAILED DESCRIPTION OF THE INVENTION

Figure 1:
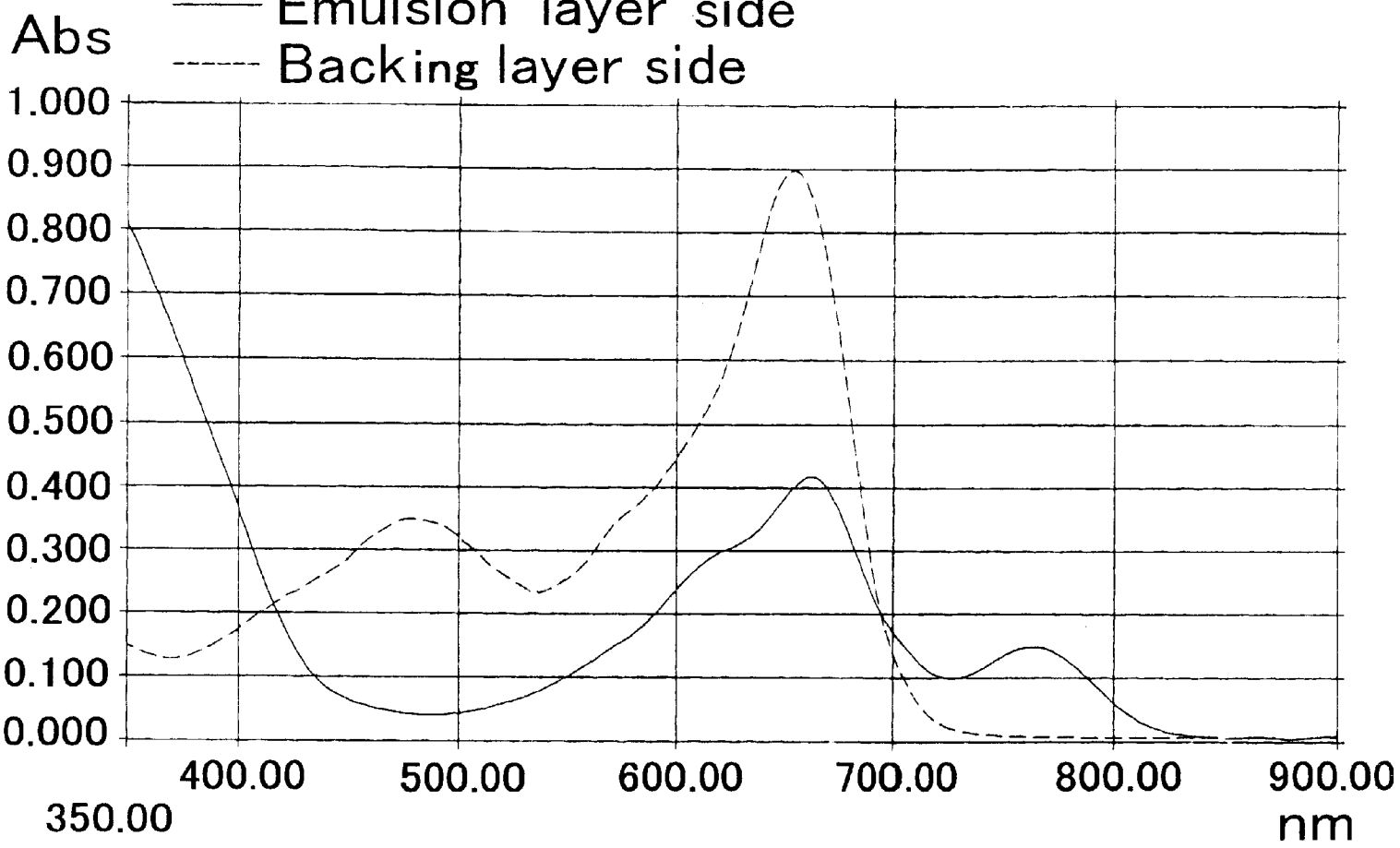
FIG. 1 shows the absorption spectrums of the emulsion layer side and backing layer side of a light-sensitive material prepared in Example 1.

According to the present invention, there are provided the following means:

(1) A silver halide photographic light-sensitive material that has at least one silver halide emulsion layer on a support, the light-sensitive material containing a surfactant represented by the following formula (F), and having the characteristic curve that a gamma in the range of an optical density from 0.3 to 3.0 is 5.0 or more, on the characteristic curve shown in a rectangular coordinate where a logarithmic exposure amount (the x axis) and an optical density (the y axis) are indicated according to the same unit length;

$$[Rf-(Rc)_n]_m-Z \qquad \text{formula (f)}$$

wherein Rf represents a perfluoroalkyl group, Rc represents an alkylene group, Z represents a group having an anionic group, cationic group, amphoteric ionic group, or nonionic polar group, n is an integer of 0 or 1, and m is an integer of 1 to 3.

(2) The silver halide photographic light-sensitive material according to the above item (1), further containing a hydrazine compound.

(3) The silver halide photographic light-sensitive material according to the above item (1) or (2), wherein the pH of a film surface on the silver halide emulsion layer side is 6.0 or less.

In the light-sensitive material having the characteristics shown by the characteristic curve prescribed in the present invention, namely the high-contrast light-sensitive material, storage stability is improved by the inclusion of the surfactant represented by the formula (F).

The gamma meant in the present invention is defined as follows. Specifically, the gamma means the gradient of the line connecting two points where the optical densities are 0.3 and 3.0 respectively in a characteristic curve showing the relation between the optical density (y axis) and the common logarithmic exposure amount (x axis) on a rectangular coordinate where the x axis and the y axis have the same unit length. Namely, when the angle of the line with the x axis is θ, the gamma is expressed by tanθ.

A specific processing method used to obtain the light-sensitive material having the characteristics shown by the characteristic curve defined in the present invention is as follows.

Developing solution: ND-1 (trade name, manufactured by Fuji Photo Film Co., Ltd.)

Fixing solution: NF-1 (trade name, manufactured by Fuji Photo Film Co., Ltd.)

Automatic developing machine: FG-680AG (trade name, manufactured by Fuji Photo Film Co., Ltd.)

Developing condition: 35° C. and 30 seconds

Although the method used to obtain the light-sensitive material having the characteristics shown by the characteristic curve defined in the present invention is optional, specific examples of the method will be shown.

In one example, the silver halide emulsion is allowed to contain a heavy metal, such as a group VIII metal in the periodic table, which can attain high-contrast. Particularly, it is preferable to contain a rhodium compound, iridium compound or ruthenium compound.

In another example, the silver halide emulsion is allowed to contain at least one of a hydrazine derivative and an amine compound as the nucleating agent on the side including the emulsion layer.

The compound represented by the formula (F) and used in the present invention will be explained in detail.

Rf in the formula (F) represents preferably a perfluoroalkyl group having 3 to 20 carbon atoms. Specific examples of the perfluoroalkyl group include a $C_3F_7$— group, $C_4F_9$— group, $C_6F_{13}$— group, $C_8F_{17}$— group, $C_{12}F_{25}$— group and $C_{16}F_{33}$— group. Rc represents an alkylene group. The number of carbon atoms in the alkylene group is 1 or more, preferably 2 or more, preferably 20 or less. Specific examples of the alkylene group include a methylene group, an ethylene group, 1,2-propylene group, 1,3-propylene group, 1,2-butylene group, 1,4-butylene group, 1,6-hexylene group and 1,2-octylene group.

The compound represented by the formula (F) in the present invention may be used as a mixture of a plural number of compounds having a perfluoroalkyl group Rf of different chain length, or may be used as a compound having a single perfluoroalkyl group Rf or as a mixture of compounds having the same Rf and different Rc.

When the compound represented by the formula (F) is used as a mixture of a plural number of compounds having a perfluoroalkyl group Rf of different chain length, the average value of chain length in the perfluoroalkyl group Rf is preferably 4 to 10, more preferably 4 to 9 as carbon atom.

n represents an integer of 0 or 1, preferably 1.

m represents an integer of 1 to 3, and when m is 2 or 3, $[Rf-(Rc)_n]$ may be the same or different. When Z is not a phosphate group, m is preferably 1. When Z represents a phosphate group, the compound represented by formula (f) is a compound having m of 1, 2, or 3, or a mixture thereof, in which the average value of m is preferably 1 to 2.

Z represents a group required to provide surface activity and specifically a cationic group, an anionic group, an amphoteric ionic group or a group having a polar nonionic group. It doesn't matter how to connect Z to Rc as far as z contains any one of these groups.

Examples of the anionic group required to provide surface activity include a sulfonic acid group and its ammonium or metal salt, carbonic acid group and its ammonium or metal salt, phosphonic acid group and its ammonium or metal salt, sulfate group and its ammonium or metal salt and phosphate group and its ammonium or metal salt.

Examples of the cationic group required to provide surface activity include quaternary alkylammonium groups such as a trimethylammoniumethyl group and trimethylammoniumpropyl group, and aromatic ammonium groups such as a dimethylphenylammoniumalkyl group and N-methylpyridinium group. There is a proper counter ion for each of these groups. Examples of the counter ion include a halide ion, benzenesulfonic acid anion and toluenesulfonic acid anion. Among these counter ions, a toluenesulfonic acid anion is preferable.

Examples of the amphoteric ionic group required to provide surface activity includes groups having a betaine structure such as $-N^+(CH_3)_2CH_2COO^-$ or $—N^+(CH_3)_2CH_2CH_2COO^-$.

Examples of the nonionic group required to provide surface activity include a polyoxyalkylene group and polyhydric alcohol. Among these groups, a polyoxyalkylene group such as polyethylene glycol and polypropylene glycol are preferable. However, the termini of these groups may be groups other than hydrogen atom, for example, alkyl groups.

In the formula (F), Rf is preferably a perfluoroalkyl group having 4 to 16 carbon atoms and more preferably a perfluoroalkyl group having 6 to 16 carbon atoms. RC is preferably an alkylene group having 2 to 16 carbon atoms and more preferably an alkylene group having 2 to 8 carbon atoms. An ethylene group is particularly preferable. n represents preferably 1.

How to connect Rc to a group required to provide surface activity is optional. For example, the both may be connected to each other by using an alkylene chain, arylene or the like, further these groups may be substituted with a substituent. Each of these groups may contain an oxy group, thio group, sulfonyl group, sulfoxide group, sulfonamide group, amide group, amino group, or carbonyl group at its principal chain or side chain.

Specific examples of these groups will be shown below. However, these examples are not intended to be limiting of the present invention.

$C_8F_{17}CH_2CH_2SO_3^-Li^+$ FS-1

$C_8F_{17}CH_2CH_2SO_3^-Na^+$ FS-2

$C_8F_{17}CH_2CH_2SO_3^-K^+$ FS-3

$C_6F_{13}CH_2CH_2SO_3^-K^+$ FS-4

$C_{10}F_{21}CH_2CH_2SO_3^-Li^+$ FS-5

$C_8F_{17}CH_2CH_2SCH_2COO^-Na^+$ FS-6

$C_8F_{17}CH_2CH_2OCH_2COO^-K^+$ FS-7

$C_8F_{17}CH_2CH_2SCH_2CH_2COO^-Na^+$ FS-8

$C8F_{17}CH_2CH_2SCH_2CH_2COO^-Li^+$ FS-9

$C_8F_{17}CH_2COO^-K^+$ FS-10

$F(CF_2CF_2)nCH_2CH_2SO_3^-Na^+$ n=3–7 FS-11

$F(CF_2CF_2)nCH_2CH_2SO_3^-Li^+$ n=3–7 FS-12

FS-13

$C_8F_{17}CH_2CH_2SO_2N(CH_2CH_2O)_4(CH_2)_4SO_3^-Na^+$
$\quad\quad\quad

-continued

FS-40

$F(CF_2CF_2)nCH_2CH_2S(CH_2CH_2O)xH$ n = 1-9, x = 0-25

FS-41

$C_6F_{13}CH_2CH_2SO_2N(C_3H_7)CH_2CH_2O(CH_2CH_2O)xH$ x = 0-15

FS-42

$C_8F_{17}CH_2CH_2SO_2NH(CH_2)_3N^+(CH_3)_2CH_2CH_2COO^-$

The compound represented by the above-described formula (F) may be used either singly or in combinations of two or more, further may be added to an optional layer of the light-sensitive material. These structural layers include, for example, a light-sensitive layer, intermediate layer, surface protective layer, backing layer and back protective layer. It is particularly preferable to use the compound in the surface protective layer or the back protective layer among these structural layers. The amount of the compound represented by the above-described formula (F) to be used in the present invention is preferably within a range from 0.1 to 200 $mg/m^2$, more preferably within a range from 0.5 to 50 $mg/m^2$ and still more preferably within a range from 1 to 30 $mg/m^2$ on the surface side or back surface side of the light-sensitive material, respectively.

The compounds represented by the formula (F) used in the present invention can be produced by a usual synthesis method, or may also make use of those commercially available as the so-called telomer-type perfluoroalkyl group-containing surfactant. Examples thereof include surfactants available under the following trade names: Zonyl FSP, FSE, FSJ, NF, TBS, FS-62, FSA, FSK (which are ionic), Zonyl 9075, FSO, FSN, FS-300, FS-310 (which are nonionic) manufactured by Dupont, S-111, S-112, S-113, S-121, S-131, S-132 (which are ionic), S-141, S-145 (which are nonionic) manufactured by Asahi Glass Co., Ltd., Unidine DS-101, DS-102, DS-202, DS-301 (which are ionic), DS-401, DS-403 (which are nonionic) manufactured by Daikin Industries, Ltd.

Among various above-described compounds, the ionic surfactants can be used in the form of various different salts formed by means such as ion-exchange or neutralization or in the presence of one or more kinds of counter ions, depending on the purpose of using thereof, a variety of necessary properties, etc.

The light-sensitive material of the present invention preferably contains, as the nucleating agent, a hydrazine compound represented by the following formula (D).

Formula (D)

$$R_{20}-N(A_{10})-N(A_{20})-G_{10}-R_{10}$$

wherein $R_{20}$ represents an aliphatic group, an aromatic group, or a heterocyclic group; $R_{10}$ represents a hydrogen atom or a blocking group; $G_{10}$ represents a —CO—, —COCO—, —C(=S)—, —$SO_2$—, —SO—, or —PO($R_{30}$)— group (in which $R_{30}$ is a group selected from the same range of groups for $R_1O$ as defined above, and $R_{30}$ and $R_{10}$ may be the same or different), or an iminomethylene group; $A_{10}$ and $A_{20}$ each represent a hydrogen atom, or one of $A_{10}$ and $A_{20}$ is a hydrogen atom and the other of $A_{10}$ and $A_{20}$ is a substituted or unsubstituted alkylsulfonyl group, a substituted or unsubstituted arylsulfonyl group, or a substituted or unsubstituted acyl group.

In formula (D), the aliphatic group represented by $R_{20}$ is preferably a substituted or unsubstituted straight-chain, branched-chain, or cyclic alkyl, alkenyl, or alkynyl group, each having 1 to 30 carbon atoms.

In formula (D), the aromatic group represented by $R_{20}$ is a monocyclic or condensed-ring aryl group. Examples of the ring include a benzene ring and a naphthalene ring. The heterocyclic group represented by $R_{20}$ is a monocyclic or condensed-ring, saturated or unsaturated, aromatic or non-aromatic heterocyclic group. Examples of the ring include a pyridine, a pyrimidine, an imidazole, a pyrazole, a quinoline, an isoquinoline, a benzimidazole, a thiazole, a benzothiazole, a piperidine, and a triazine ring. $R_{20}$ is preferably an aryl group, and especially preferably a phenyl group.

$R_{20}$ may be substituted with a substituent. Typical examples of the substituent include a halogen atom (fluorine, chlorine, bromine, or iodine), an alkyl group, which includes an aralkyl group, a cycloalkyl group, and an active methine group; an alkenyl group, an alkynyl group, an aryl group, a heterocyclic group, a quaternary nitrogen atom-containing heterocyclic group (e.g. a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group; an alkoxy group, which group contains a group containing a repeating unit of an ethyleneoxy group or a propyleneoxy group; an aryloxy group, a heterocyclic oxy group, an acyloxy group, an (alkoxy or aryloxy)carbonyloxy group, a carbamoyloxy group, a sulfonyloxy group, an amino group, an (alkyl, aryl, or heterocyclic)amino group, an N-substituted nitrogen-containing heterocyclic group, an acylamino group, a sulfonamide group, a ureido group, a thioureido group, an isothioureido group, an imido group, an (alkoxy or aryloxy)-carbonylamino group, a sulfamoylamino group, a semicarbazido group, a thiosemicarbazido group, a hydrazino group, a quaternary ammonio group, an oxamoyl amino group, an (alkyl or aryl)sulfonylureido group, an acylureido group, an N-acylsulfamoylamino group, a nitro group, a mercapto group, an (alkyl, aryl, or heterocyclic)-thio group, an (alkyl or aryl)sulfonyl group, an (alkyl or aryl)sulfinyl group, a sulfo group or a salt thereof, a sulfamoyl group, an N-acylsulfamoyl group, a sulfonylsulfamoyl group or a salt thereof, and a group having a phosphonamide or phosphate structure.

These substitutes may be further substituted by any of the above substituents.

Preferable examples of the substituent that $R_{20}$ may have include an alkyl group having 1 to 30 carbon atoms, wherein an active methylene group is included; an aralkyl group, a heterocyclic group, a substituted amino group, an acrylamino group, a sulfonamide group, a ureido group, a sulfamoylamino group, an imido group, a thioureido group, a phosphonamide group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl, or heterocyclic)thio group, a sulfo group or a salt thereof, a sulfamoyl group, a halogen atom, a cyano group, and a nitro group.

In formula (D), $R_{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group, and a hydrazino group.

The alkyl group represented by $R_{10}$ is preferably an alkyl group having 1 to 10 carbon atoms. Specific examples of the alkyl group include a methyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a methanesulfonamidomethyl group, a benzenesulfonamidomethyl group, a hydroxymethyl group, a methoxymethyl group, a methylthiomethyl group, a phenylsulfonylmethyl group, and an o-hydroxybenzyl group. The alkenyl group is preferably an alkenyl group having 1 to 10 carbon atoms. Examples of the alkenyl group include a vinyl group, a 2,2-dicyanovinyl group, a 2-ethoxycarbonylvinyl group, and a 2-trifluoro-2-methoxycarbonylvinyl group. The alkynyl group is preferably an alkynyl group having 1 to 10 carbon atoms. Examples of the alkynyl group include an ethynyl group and a 2-methoxycarbonylethynyl group. The aryl group is preferably a monocyclic or condensed-ring aryl group, and especially preferably an aryl group containing a benzene ring. Examples of the aryl group include a phenyl group, a 3,5-dichlorophenyl group, a 2-methanesulfonamidephenyl group, a 2-carbamoylphenyl group, a 4-cyanophenyl group, and a 2-hydroxymethylphenyl group.

The heterocyclic group is preferably a 5- or 6-membered, saturated or unsaturated, monocyclic or condensed-ring heterocyclic group that contains at least one nitrogen, oxygen, or sulfur atom. Examples of the heterocyclic group include a morpholino group, a piperidino group (N-substituted), a piperazino group, an imidazolyl group, an indazolyl group (e.g. a 4-nitroindazolyl group), a pyrazolyl group, a triazolyl group, a benzimidazolyl group, a tetrazolyl group, a pyridyl group, a pyridinio group (e.g. a N-methyl-3-pyridinio group), a quinolinio group, and a quinolyl group. Among these, especially preferred are a morpholino group, a piperidino group, a pyridyl group, and a pyridinio group.

The alkoxy group is preferably an alkoxy group having 1 to 8 carbon atoms. Examples of the alkoxy group include a methoxy group, a 2-hydroxyethoxy group, and a benzyloxy group. The aryloxy group is preferably a phenyloxy group. The amino group is preferably an unsubstituted amino group, an alkylamino group having 1 to 10 carbon atoms, an arylamino group, or a saturated or unsaturated heterocyclic amino group, wherein a quaternary nitrogen atom-containing heterocyclic group is included. Examples of the amino group include a 2,2,6,6-tetramethylpiperidine-4-ylamino group, a propylamino group, a 2-hydroxyethylamino group, an anilino group, an o-hydroxyanilino group, a 5-benzotriazolylamino group, and an N-benzyl-3-piridinioamino group. The hydrazino group is especially preferably a substituted or unsubstituted hydrazino group, or a substituted or unsubstituted phenylhydrazino group (e.g. a 4-benzenesulfonamidophenylhydrazino group).

These groups represented by $R_{10}$ may be substituted with a substituent. Preferable examples of the substituent are the same as those mentioned as the substituent of $R_{20}$.

In formula (D), $R_{10}$ may be an atomic group capable of splitting a part of $G_{10}$–$R_{10}$ from the residual molecule, and subsequently of taking place cyclization reaction by which a ring structure containing atoms of the —$G_{10}$—$R_{10}$ part is formed. Examples of the atomic groups include those described, for example, in JP-A-63-29751.

The hydrazine derivatives represented by formula (D) may contain an adsorptive group capable of being adsorbed onto the silver halide. Examples of the absorbing group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

$R_{10}$ or $R_{20}$ of formula (D) may contain a polymer or a ballasting group that is usually used for immobile photographic additives, such as a coupler. The ballasting group in the present invention has 6 or more carbon atoms. The ballasting group can be selected from a straight-chain or branched, alkyl group (or alkylene group), alkoxy group (or alkyleneoxy group), alkylamino group (or alkyleneamino group), or alkylthio group, or a group having these groups as its partial structure. It is more preferable that the ballasting group is, having 7 or more but 24 or less carbon atoms, a straight-chain or branched, alkyl group (or alkylene group), alkoxy group (or alkyleneoxy group), alkylamino group (or alkyleneamino group), or alkylthio group, or a group having these groups as its partial structure. Examples of the polymer include those described, for example, in JP-A-1-100530.

$R_{10}$ or $R_{20}$ of formula (D) may contain a plurality of hydrazino groups as a substituent. At this time, the compound represented by formula (D) is a multimer of the hydrazino group. Specific examples of the compound include those described, for example, in JP-A-64-86134, JP-A-4-16938, JP-A-5-197091, W095-32452, W095-32453, JP-A-9-179229, JP-A-9-235264, JP-A-9-235265, JP-A-9-235266, and JP-A-9-235267.

$R_{10}$ or $R_{20}$ in the formula (D) may contain a cationic group (specifically, a group containing a quaternary ammonio group, a group containing a quaternary phosphorous atom or a nitrogen-containing heterocyclic group having a quaternary nitrogen atom), a group containing a repeating unit of an ethyleneoxy group or propyleneoxy group, an (alkyl, aryl or heterocyclic) thio group or a dissociating group (which means a group, or a partial structure, having a proton(s) of such low acidity that the proton is dissociable by an alkaline developer, or a salt of such group or structure, specifically, for example, carboxy group/—COOH, sulfo group/—$SO_3H$, phosphonic acid group/—$PO_3H$, phosphoric acid group/—$OPO_3H$, hydroxy group/—OH, mercapto group/—SH, —$SO_2NH_2$, N-substituted sulfonamide group/—$SO_2NH$—, —$CONHSO_2$—, —$CONHSO_2NH$—, —$NHCONHSO_2$—, —$SO_2NHSO_2$—, —CONHCO—, an activated methylene group, —NH— inherent in a nitrogen-containing heterocyclic group, or salts of these groups). Examples of containing these groups include compounds described in JP-A-7-234471, JP-A-5-333466, JP-A-6-19032, JP-A-6-19031, JP-A-5-45761, U.S. Pat. Nos. 4,994,365, 4,988,604, JP-A-7-259240, JP-A-7-5610, JP-A-7-244348, German Patent No. 4,006,032, JP-A-11-7093.

In formula (D), $A_{10}$ and $A_{20}$ each represent a hydrogen atom or an alkyl or arylsulfonyl group having 20 or less carbon atoms (preferably, a phenylsulfonyl group, or a phenyl sulfonyl group substituted with a substituent(s) so that the total of the Hammett substituent constant of the substituent becomes −0.5 or more), or an acyl group having 20 or less carbon atoms (preferably, a benzoyl group, a benzoyl group substituted with a substituent(s) so that the total of the Hammett substituent constant of the substituent becomes −0.5 or more, or a straight-chain, branched, or cyclic, substituted or unsubstituted, aliphatic acyl group, wherein examples of the substituent include a halogen atom, an ether group, a sulfonamide group, a carbonamide group, a hydroxyl group, a carboxyl group, and a sulfo group). $A_{10}$ and $A_{20}$ each are most preferably a hydrogen atom.

Next, in the present invention, a particularly preferable hydrazine compound will be explained.

As $R_{20}$, a substituted phenyl group is particularly preferably. As the substituent, a sulfonamide group, acylamino group, ureido group, carbamoyl group, thioureido group, isothioureido group, sulfamoylamino group or N-acylsulfamoylamino group is particularly preferable. A sulfonamide group or ureido group is more preferable and a sulfonamide group is most preferable.

In the hydrazine derivatives represented by the formula (D), $R_{20}$ or $R_{10}$ is particularly preferably substituted directly or indirectly with, as the substituent, at least one of the ballast group, the group adsorptive onto the silver halide, the group containing the quaternary ammonio group, the nitrogen-containing heterocyclic group having a quaternary nitrogen atom, the group containing a repeating unit of an ethyleneoxy group, the (alkyl, aryl or heterocyclic)thio group, the dissociating group dissociable by an alkaline developer, and the hydrazino group that can form a multimer (e.g., the group represented by —NHNH—$G_{10}$—$R_{10}$ ). Further $R_{20}$ preferably has at least one of the aforementioned groups as its substituent directly or indirectly. Most preferably, $R_{20}$ represents a phenyl group substituted with a benzenesulfonamide group, and the benzenesulfonamide group has any one of the aforementioned groups as the substituent on its benzene ring , directly or indirectly.

Among those groups represented by $R_{10}$ when $G_{10}$ is a —CO— group, preferred are a hydrogen atom, an alkyl group, an alkenyl group, an alkynyl group, an aryl group, or a heterocyclic group, and more preferably a hydrogen atom, an alkyl group, or a substituted aryl group, wherein the substituent is especially preferably an electron-withdrawing group or an o-hydroxymethyl group. A hydrogen atom or an alkyl group is most preferred.

When $G_{10}$ is a —COCO— group, an alkoxy group, an aryloxy group, and an amino group are preferred. Further, a substituted amino group, specifically an alkylamino group, an arylamino group, and a saturated or unsaturated heterocyclic amino group, is especially preferred.

Further, when $G_{10}$ is a —$SO_2$— group, $R_{10}$ is preferably an alkyl group, an aryl group, or a substituted amino group.

In formula (D), $G_{10}$ is preferably a —CO— group or a —COCO— group and especially preferably a —CO— group.

Next, specific examples of the compound represented by formula (D) are illustrated below, but they are not intended to restrict the scope of the present invention.

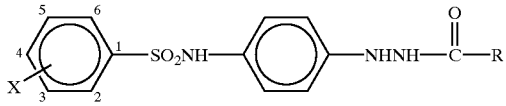

| | X = | R = —H | —$C_2F_4$—COOH (or —$C_2F_4$—$COO^{\ominus}K^{\oplus}$) | 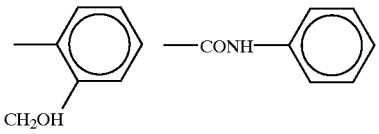 | |
|---|---|---|---|---|---|
| D-1 | 3-$NHCOC_9H_{19}(n)$ | 1a | 1b | 1c | 1d |
| D-2 | 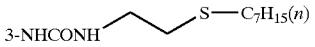 | 2a | 2b | 2c | 2d |
| D-3 | 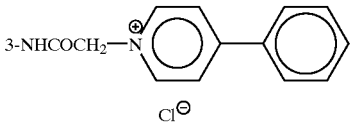 | 3a | 3b | 3c | 3d |
| D-4 | 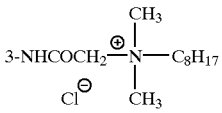 | 4a | 4b | 4c | 4d |
| D-5 | 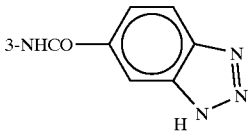 | 5a | 5b | 5c | 5d |

-continued
| | | | | | |
|---|---|---|---|---|---|
| D-6 | 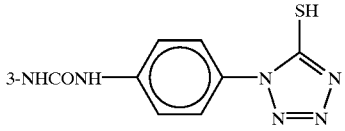 | 6a | 6b | 6c | 6d |
| D-7 | 2,4-$(CH_3)_2$-3-$SC_2H_4$—$(OC_2H_4)_4$—$OC_8H_{17}$ | 7a | 7b | 7c | 7d |
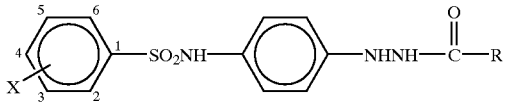
| | R = | | | |
|---|---|---|---|---|
| X = | —H | —$CF_2H$ | 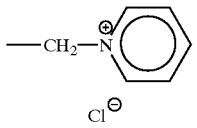 | 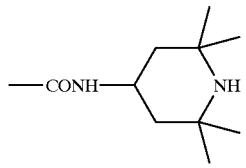 |
| | | | | | |
|---|---|---|---|---|---|
| D-8 | 3-$CONHCH_2CH(C_2H_5)$—$C_4H_9$ | 8a | 8e | 8f | 8g |
| D-9 | 6-$OCH_3$-3-$C_5H_{11}$(t) | 9a | 9e | 9f | 9g |
| D-10 | 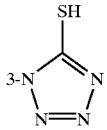 | 10a | 10e | 10f | 10g |
| D-11 | 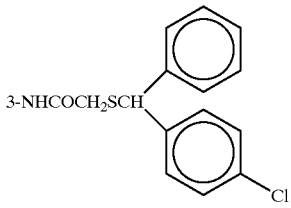 | 11a | 11e | 11f | 11g |
| D-12 | 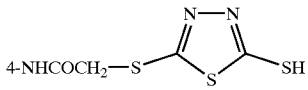 | 12a | 12e | 12f | 12g |
| D-13 | 3-$NHCOCH(CH_2COOH)$—$C_8H_{17}$ | 13a | 13e | 13f | 13g |
| D-14 | 3.5-$(CONHCH_2CH(C_2H_5)$—$C_4H_9)_2$ | 14a | 14e | 14f | 14g |
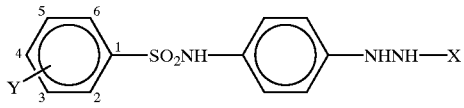
| | X = | | | |
|---|---|---|---|---|
| Y = | —CHO | —$COCF_3$ | —$SO_2CH_3$ | —$P(=O)(OC_2H_5)_2$ |

-continued
| | | | | | |
|---|---|---|---|---|---|
| D-15 | 3-NHCOCH$_2$N$^{\oplus}$ — CONHC$_4$H$_9$ • Cl | 15a | 15h | 15i | 15j |
| D-16 | 4-NCHO(CH$_2$)$_2$ N$^{\oplus}$ — C$_6$H$_{13}$ Cl$^{\ominus}$ | 16a | 16h | 16i | 16j |
| D-17 | 3-SO$_2$NH — (CH$_2$CH$_2$O)$_4$ — OC$_4$H$_9$ | 17a | 17h | 17i | 17j |
| D-18 | 3,4-(COOCH(CH$_3$)COOC$_4$H$_9$)$_2$ | 18a | 18h | 18i | 18j |
| D-19 | 3-NHCO — (CH$_2$)$_4$ — (1,2-dithiolane ring) | 19a | 19h | 19i | 19j |
| D-20 | 3-NHSO$_2$NH—C$_8$H$_{17}$ | 20a | 20h | 20i | 20j |
| D-21 | 2-Cl-5-(1,3,4-thiadiazolyl-2-SH) | 21a | 21h | 21i | 21j |
| | | R = | | | |
|---|---|---|---|---|---|
| | | —H | —CF$_2$H | 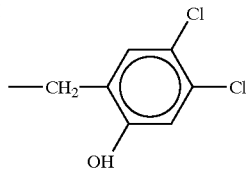 | —CONHC$_3$H$_7$ |
| D-22 | 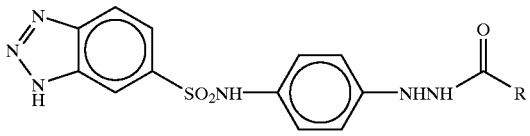 | 22a | 22e | 22k | 22l |
| D-23 | 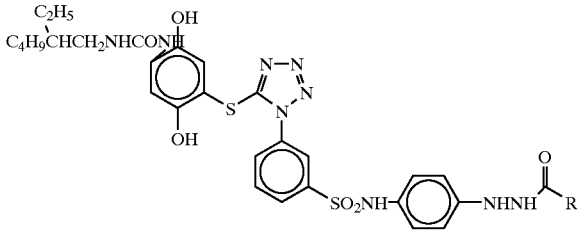 | 23a | 23e | 23k | 23l |

-continued
| | | | | |
|---|---|---|---|---|
| D-24 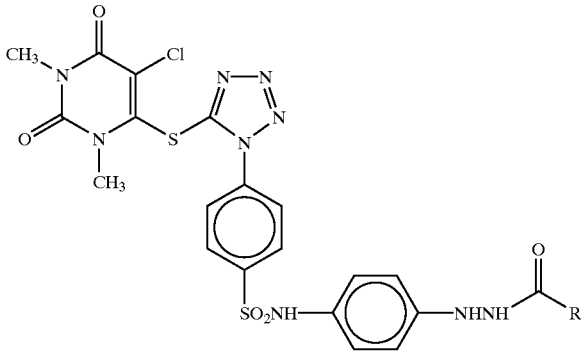 | 24a | 24e | 24k | 24l |
| D-25 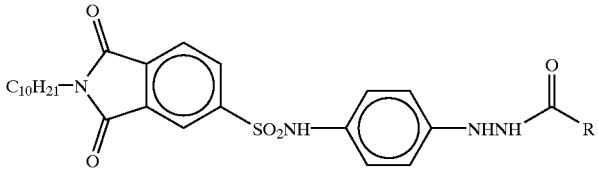 | 25a | 25e | 25k | 25l |
| D-26 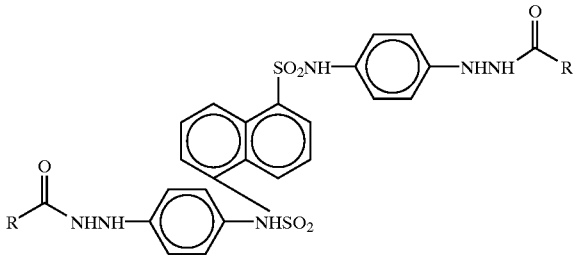 | 26a | 26e | 26k | 26l |
| D-27 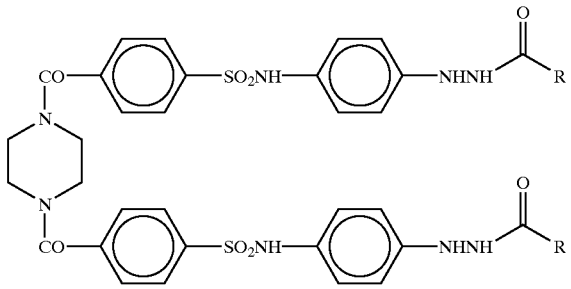 | 27a | 27e | 27k | 27l |
| D-28 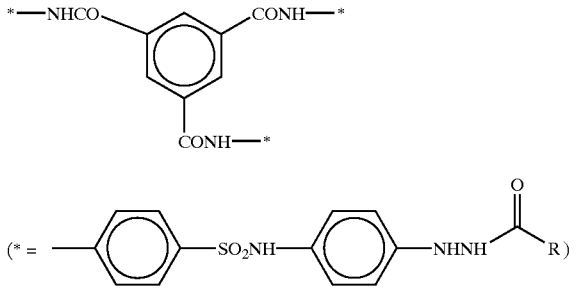 | 28a | 28e | 28k | 28l |
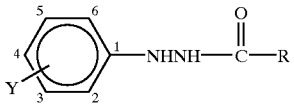
R =

-continued
| | Y = | —H | —$CH_2OCH_3$ | 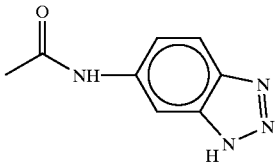 | 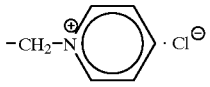 |
|---|---|---|---|---|---|
| D-29 | 4-NHC(=S)NH—$C_8H_{17}$(*n*) | 29a | 29m | 29n | 29f |
| D-30 | 4-NHP(=S)($OCH_2$—$C_6H_4$)$_2$ | 30a | 30m | 30n | 30f |
| D-31 | 4-NHCONH—($CH_2$)$_3$O—$C_6H_4$—C(CH$_3$)$_3$ | 31a | 31m | 31n | 31f |
| D-32 | 4-OH<br>3-NHCONH$CH_2$CH($C_2H_5$)—$C_4H_9$ | 32a | 32m | 32n | 32f |
| D-33 | 4-$NHSO_2(CH_2)_2NHCO$—$C_6H_4$— 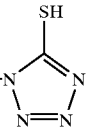 | 33a | 33m | 33n | 33f |
| D-34 | 4-$OCH_2$—$C_6H_5$ | 34a | 34m | 34n | 34f |
| D-35 | 4-NHCONHN—($CH_2$—$C_6H_4$)$_2$ | 35a | 35m | 35n | 35f |
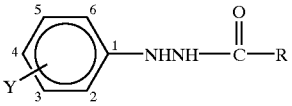
| Y = | R = —H | —$C_3F_8$—COOH | —$CONHCH_3$ | 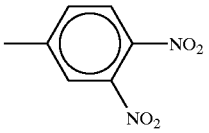 |
|---|---|---|---|---|
| D-36 2-$OCH_3$—<br>4-NHCONH($CH_2$)$_3$S— 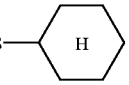 | 36a | 36o | 36p | 36q |
| D-37 2-$OCH_3$—<br>4-$NHSO_2C_{12}H_{25}$ | 37a | 37o | 37p | 37q |
| D-38 3-$NHCOC_{11}H_{23}$<br>4-$NHSO_2CF_3$ | 38a | 38o | 38p | 38q |

-continued
| | | | | | |
|---|---|---|---|---|---|
| D-39 | 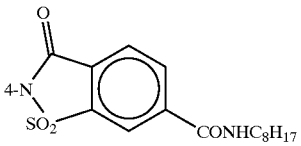 | 39a | 39o | 39p | 39q |
| D-40 | 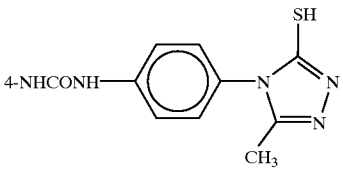 | 40a | 40o | 40p | 40q |
| D-41 | 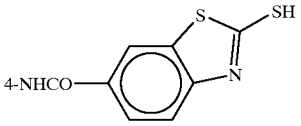 | 41a | 41o | 41p | 41q |
| D-42 | 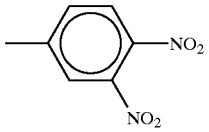 | 42a | 42o | 42p | 42q |
| D-43 | 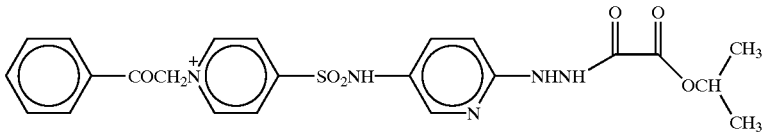 | | | | |
| D-44 | 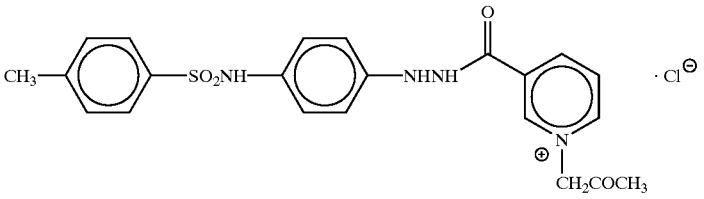 | | | | |
| D-45 | 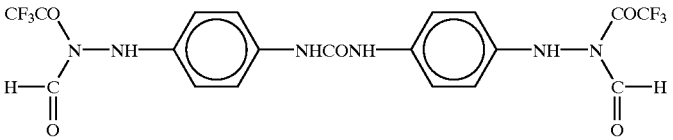 | | | | |
| D-46 | 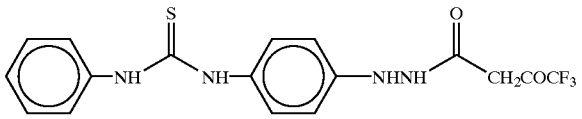 | | | | |
| D-47 | 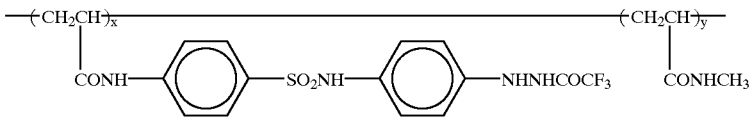 | | | | |
x:y = 3:97 Average molecular weight » 100000

-continued
D-48
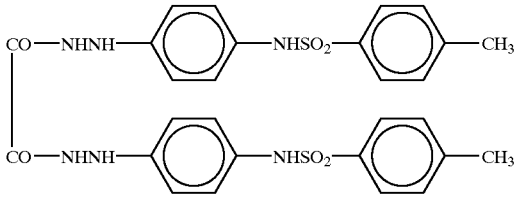
D-49
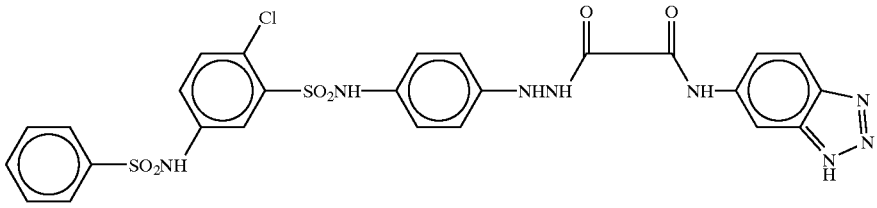
No.
D-50
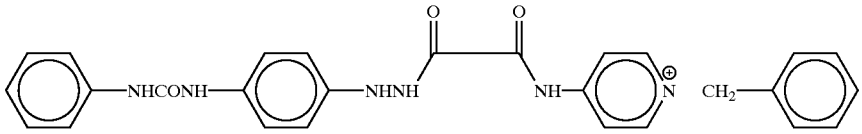
D-51
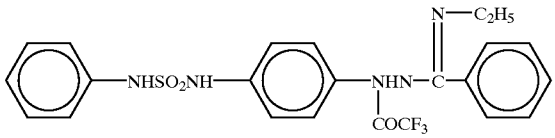
D-52
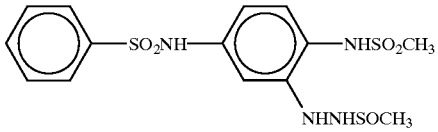
D-53
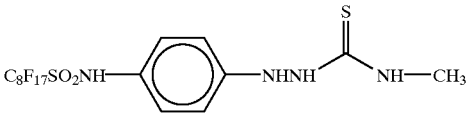
D-54
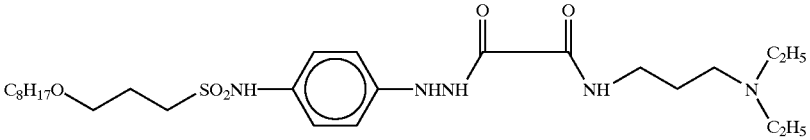
D-55
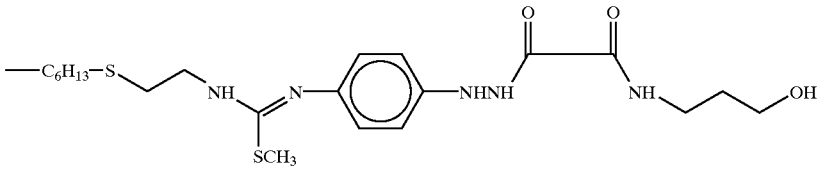
D-56
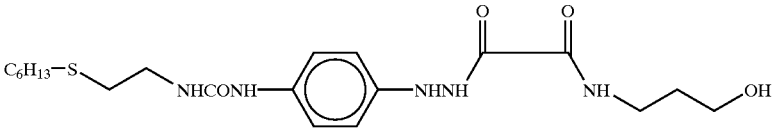

-continued
D-57
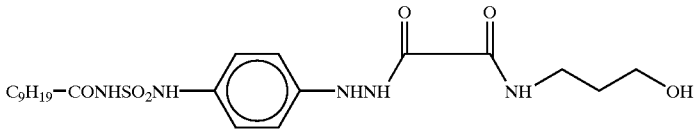
D-58
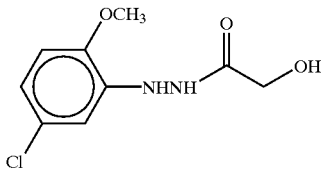
D-59
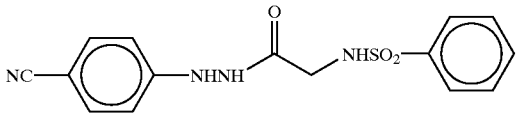
D-60
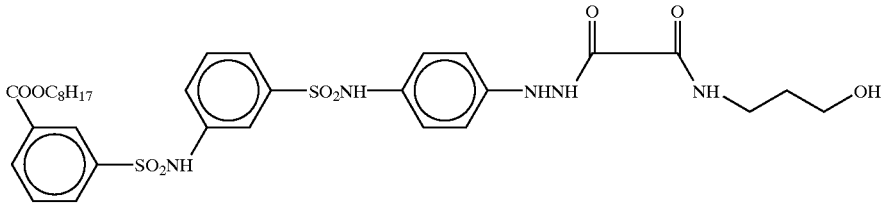
D-61
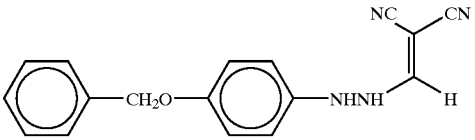
D-62
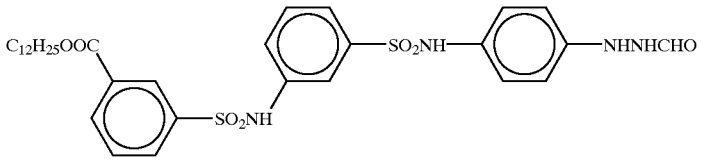
D-63
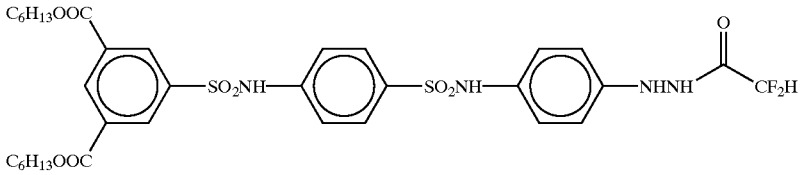
D-64
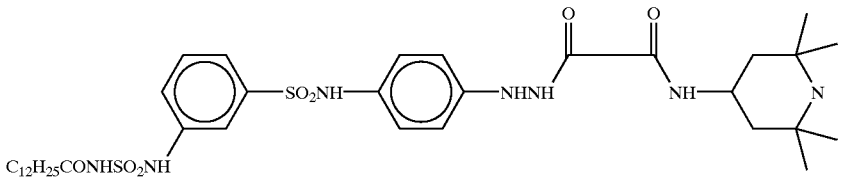
D-65
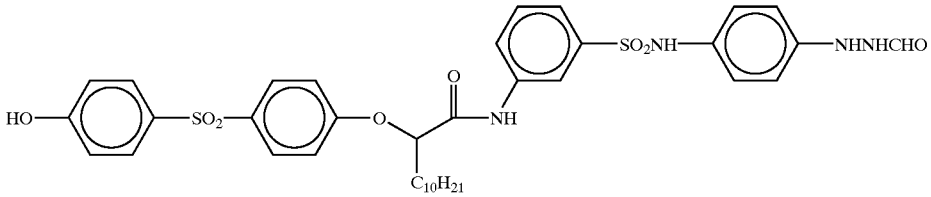

-continued

D-66

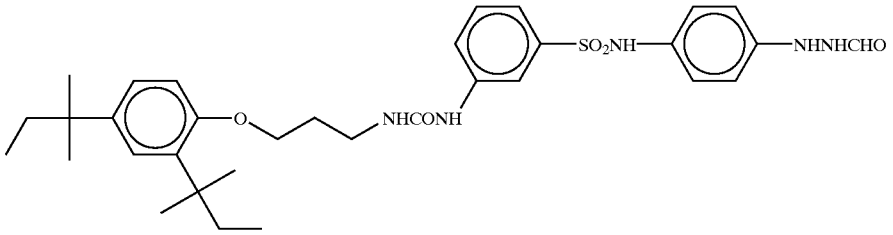

D-67

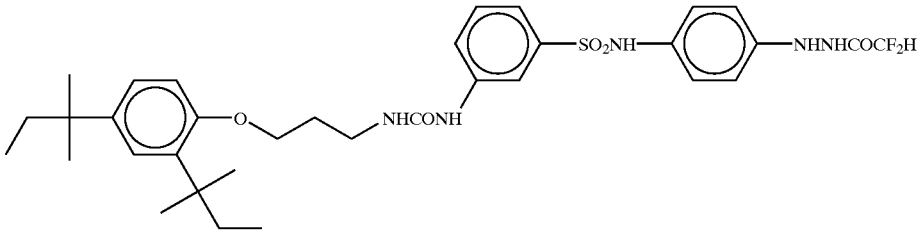

As the hydrazine derivatives to be used in the present invention, in addition to the above, the following hydrazine derivatives can also preferably be used. The hydrazine derivatives to be used in the present invention can be synthesized by various methods described in the following patents: compounds represented by (Chemical formula 1) described in JP-B-6-77138 ("JP-B" means examined Japanese patent publication); specifically, compounds described on pages 3 and 4 of the publication; compounds represented by formula (I) described in JP-B-6-93082; specifically, Compounds 1 to 38 described on pages 8 to 18 of the publication; compounds represented by formulae (4), (5), and (6) described in JP-A-6-230497; specifically, Compound 4-1 to Compound 4-10 described on pages 25 and 26, Compound 5-1 to Compound 5-42 described on pages 28 to 36, and Compound 6-1 to Compound 6-7 described on pages 39 and 40 of the publication, respectively; compounds represented by formulae (1) and (2) described in JP-A-6-289520; specifically, Compounds 1-1) to 1-17) and 2-1) described on pages 5 to 7 of the publication; compounds represented by (Chemical formula 2) and (Chemical formula 3) described in JP-A-6-313936; specifically, compounds described on pages 6 to 19 of the publication; compounds represented by (Chemical formula 1) described in JP-A-6-313951; specifically, compounds described on pages 3 to 5 of the publication; compounds represented by formula (I) described in JP-A-7-5610; specifically, Compounds I-1 to I-38 described on pages 5 to 10 of the publication; compounds represented by formula (II) described in JP-A-7-77783; specifically, Compounds II-1 to II-102 described on pages 10 to 27 of the publication; compounds represented by formulae (H) and (Ha) described in JP-A-7-104426; specifically, Compounds H-1 to H-44 described on pages 8 to 15 of the publication; compounds that have an anionic group in the vicinity of the hydrazine group or a nonionic group for forming an intramolecular hydrogen bond with the hydrogen atom of the hydrazine; and especially, compounds represented by formulae (A), (B), (C), (D), (E), and (F), described in JP-A-9-22082; specifically, Compounds N-1 to N-30 described in the specification thereof; and compounds represented by formula (1) described in JP-A-9-22082; specifically, Compounds D-1 to D-55 described in the specification thereof.

Besides, hydrazine derivatives described in WO 95-32452, WO 95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

The hydrazine-series nucleating agent to be used in the present invention may be dissolved in an appropriate water-miscible organic solvent, such as an alcohol (e.g. methanol, ethanol, propanol, fluorinated alcohol), a ketone (e.g. acetone, methyl ethyl ketone), dimethylformamide, dimethylsulfoxide, or methyl cellosolve, before use.

Also, the hydrazine-series nucleating agent to be used in the present invention may be dissolved using an oil, such as dibutyl phthalate, tricresyl phosphate, glyceryl triacetate, or diethyl phthalate; or using or an auxiliary solvent, such as ethyl acetate or cyclohexanone, by a conventionally well-known emulsion dispersion method, and mechanically processed into an emulsion dispersion before use. Alternatively, the hydrazine powder may be dispersed in water by means of a ball mill, a colloid mill, or ultrasonic waves, according to a method known as a solid dispersion method, and used.

The hydrazine nucleating agent to be used in the present invention may be added to a silver halide emulsion layer or to any of other hydrophilic colloid layers on the silver halide emulsion layer side of a support, but it is preferably added to the above-described silver halide emulsion layer or to a hydrophilic colloid layer adjacent thereto. Also, two or more kinds hydrazine-series nucleating agent may be used together.

The addition amount of the nucleating agent to be used in the present invention is preferably from $1\times10^{-5}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

In the present invention, a nucleation accelerator may be included in the light-sensitive material.

Examples of the nucleation accelerator (nucleating accelerator) to be used in the present invention include an amine derivative, an onium salt, a disulfide derivative, or a hydroxymethyl derivative. Specific examples thereof are described below: compounds described in JP-A-7-77783, page 48, lines 2 to 37; specifically, Compounds A-1) to A-73) described on pages 49 to 58; compounds represented by (Chemical formula 21), (Chemical formula 22), and (Chemical formula 23) described in JP-A-7-84331; specifically, compounds described on pages 6 to 8 of the publication; compounds represented by formulae [Na] and [Nb] described in JP-A-7-104426; specifically, Compounds Na-1 to Na-22 and Compounds Nb-1 to Nb-12 described on pages 16 to 20 of the publication; compounds represented by formula (1), formula (2), formula (3), formula (4), formula (5), formula (6), and formula (7) described in JP-A-8-272023; specifically, compounds 1-1 to 1-19, 2-1 to 2-22, 3-1 to 3-36, 4-1 to 4-5, 5-1 to 5-41, 6-1 to 6-58, and 7-1 to 7-38, described in this publication; nucleation accelerator described in JP-A-9-297377, page 55, column 108, line 8 to page 69, column 136, line 44.

As the nucleation accelerator to be used in the present invention, the quaternary salt compounds represented by the formula (a) to (f) are preferable and the compounds represented by the formula (b) are most preferable.

Formula (a)

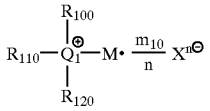

Formula (b)

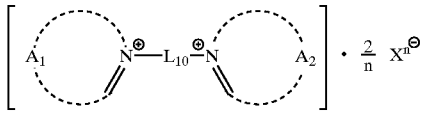

Formula (c)

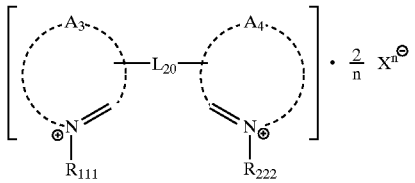

Formula (d)

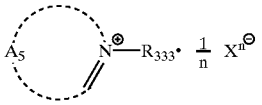

In the formula (a), $Q_1$ represents a nitrogen atom or a phosphorus atom, $R_{100}$, $R_{110}$ and $R_{120}$ respectively represent an aliphatic group, an aromatic group or a heterocyclic group and may be combined with each other to form a ring structure and M represents an organic group which has $m_{10}$ valences and is connected to $Q_1^+$ through a carbon atom contained in M wherein $m_{10}$ denotes an integer from 1 to 4.

In the formula (b), (c) or (d), $A_1$, $A_2$, $A_3$, $A_4$ and $A_5$ respectively represent an organic residue for completing an unsaturated heterocyclic group containing a quaternary nitrogen atom, $L_{10}$ and $L_{20}$ respectively represent a divalent connecting group and $R_{111}$, $R_{222}$ and $R_{333}$ respectively represent a substituent.

The quaternary salt compound represented by the formula (a), (b), (c) or (d) has a total of 20 or more repeating unit of an ethyleneoxy group or propyleneoxy group in its molecule. These repeating units may be extended over several positions.

Formula (e)

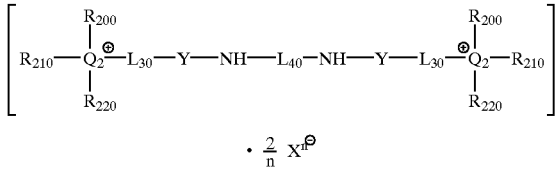

Formula (f)

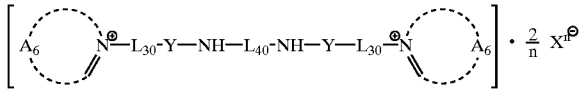

In the formula (e), $Q_2$ represents a nitrogen atom or a phosphorus atom. $R_{200}$, $R_{210}$ and $R_{220}$ represent groups having the same meanings as those represented by $R_{100}$, $R_{110}$ and $R_{120}$ in the formula (a).

In the formula (f), $A_6$ represents groups having the same meanings as those represented by $A_1$ or $A_2$ in the formula (b) provided that a nitrogen-containing unsaturated hetero ring formed by $A_6$ may have a substituent, but has no primary hydroxyl group on the substituent. In the formula (e) and (f), $L_{30}$ represents an alkylene group, Y represents —C(=O)— or —$SO_2$— and $L_{40}$ represents a divalent connecting group having at least one hydrophilic group.

In the formula (a) to (f), $X^{n-}$ represents a counter anion having n valences wherein n denotes an integer from 1 to 3. However, $X^{n-}$ is needless in the case where a separate anion group is contained in the molecule, and the anion is combined with $Q_1^+$, $Q_2^+$ or $N^+$ to form an intermolecular salt.

Examples of the aliphatic groups represented by $R_{100}$, $R_{110}$ or $R_{120}$ in the formula (a) include straight-chain or branched alkyl groups such as a methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; aralkyl groups such as a substituted or unsubstituted benzyl group; cycloalkyl groups such as a cyclopropyl group, cyclopentyl group and cyclohexyl group; alkenyl groups such as an allyl group, vinyl group and 5-hexenyl group; cycloalkenyl groups such as a cyclopentenyl group and cyclohexenyl group; and alkinyl groups such as a phenylethynyl group. Examples of the aromatic group include aryl groups such as a phenyl group, naphthyl group and phenanthryl group and examples of the heterocyclic group include a pyridyl group, quinolyl group, furyl group, imidazolyl group, thiazolyl group, thiadiazolyl group, benzotriazolyl group, benzothiazolyl group, morpholyl group, pyrimidyl group and pyrrolidyl group.

Examples of the substituent which is substituted on these groups include, besides the groups represented by $R_{100}$, $R_{110}$ and $R_{120}$, a halogen atom such as a fluorine atom, chlorine atom, bromine atom and iodine atom, nitro group, (alkyl or aryl) amino group, alkoxy group, aryloxy group, (alkyl or aryl) thio group, carbonamide group, carbamoyl group, ureide group, thioureide group, sulfonylureide group, sulfonamide group, sulfamoyl group, hydroxyl group, sulfonyl group, carboxyl group (including a carboxylate), sulfo group (including a sulfonate), cyano group, oxycarbonyl group, acyl group and heterocyclic group (including a heterocyclic group containing a quaternary nitrogen atom). These substituents may be further substituted with these substituents.

The groups represented by $R_{100}$, $R_{110}$ or $R_{120}$ in the formula (a) may be combined with each other to form a ring structure.

Examples of the group represented by M in the formula (a) include groups having the same meanings as $R_{100}$, $R_{110}$ and $R_{120}$ when $m_{10}$ represents 1. When $m_{10}$ represents an integer of 2 or more, M represents a connecting group with $m_{10}$ valences which connects to $Q_1^+$ by a carbon atom contained in M. Specifically, M represents a $m_{10}$ valence combining groups which are formed by combining groups such as an alkylene group, arylene group, heterocyclic group, with a —CO—, —O—, —N($R_N$)—, —S—, —SO—, —$SO_2$— or —P(=O)— ($R_N$ represents a hydrogen atom or a group having the same meanings as $R_{100}$, $R_{110}$ and $R_{120}$. When plural $R_N$s are present in the molecule, they may be the same or different and further they may be combined with each other). M may have an optional substituent. Examples of the optical substituent include the same substituents that may be contained in the group represented by $R_{100}$, $R_{110}$ and $R_{120}$.

In the formula (a), $R_{100}$, $R_{110}$ and $R_{120}$ respectively are preferably groups having 20 or less carbon atoms. $R_{100}$, $R_{110}$ and $R_{120}$ are particularly preferably an aryl group having 15 or less carbon atoms when $Q_1$ represents a phosphorus atom. They are particularly preferably alkyl group, aralkyl group, or aryl groups, having 15 or less carbon atoms when $Q_1$ represents a nitrogen atom. $m_{10}$ is preferably 1 or 2. When $m_{10}$ represents 1, M is preferably a group having 20 or less carbon atoms and particularly preferably an alkyl, aralkyl or aryl group having a total of 15 or less carbon atoms. When $m_{10}$ represents 2, the divalent organic group represented by M is preferably an alkylene group, an arylene group or a divalent group which is formed by combining these groups with —CO—, —O—, —N($R_N$)—, —S— or —$SO_2$—. When $m_{10}$ represents 2, M is preferably a divalent group that connects to $Q_1^+$ by a carbon atom contained in M and that has a total of 20 or less carbon atoms. It is to be noted that when M or $R_{100}$, $R_{110}$ or $R_{120}$ contains plural repeating units of an ethyleneoxy group or propyleneoxy group, the aforementioned preferable range of the number of total carbon atoms is not limited to the above. Also, when $m_{10}$ denotes an integer of 2 or more, $R_{100}$, $R_{110}$ and $R_{120}$ respectively are present in plural in the molecule. In this case, a plurality of $R_{100}$s, $R_{110}$ s and $R_{120}$s may respectively be the same or different.

The quaternary salt compound represented by the formula (a) has 20 or more repeating units of an ethyleneoxy group or propyleneoxy group in total in its molecule. These repeating units may be substituted either on one position or may be substituted so as to extend over plural positions. When $m_{10}$ represents an integer of 2 or more, it is more preferable that the connecting group represented by M has a total of 20 or more repeating units of an ethyleneoxy group or propyleneoxy group.

In the formula (b), (c) or (d), $A_1$, $A_2$, $A_3$, $A_4$ and $A_5$ respectively represent an organic moiety necessary to form a substituted or unsubstituted unsaturated heterocyclic ring containing a quaternary nitrogen atom and may contain a carbon atom, oxygen atom, nitrogen atom, sulfur atom or hydrogen atom. The heterocyclic ring may be further condensed with a benzene ring.

Examples of the unsaturated hetero ring formed by $A_1$, $A_2$, $A_3$, $A_4$ and $A_5$ may include a pyridine ring, quinoline ring, isoquinoline ring, imidazole ring, thiazole ring, thiadiazole ring, benzotriazole ring, benzothiazole ring, pyrimidine ring and pyrazole ring. A pyridine ring, quinoline ring and isoquinoline ring are particularly preferable.

The unsaturated hetero ring which $A_1$, $A_2$, $A_3$, $A_4$ and $A_5$ form in combination with a quaternary nitrogen atom may have a substituent. Examples of the substituent in this case include the same substituents as those which the group represented by $R_{100}$, $R_{110}$ or $R_{120}$ in the formula (a) may have. Preferable examples of these substituents include halogen atoms (especially, a chlorine atom), aryl groups having 20 or less carbon atoms (particularly, a phenyl group is preferable), alkyl groups, alkinyl groups, carbamoyl groups, (alkyl or aryl)amino groups, (alkyl or aryl) oxycarbonyl groups, alkoxy groups, aryloxy groups, (alkyl or aryl)thio groups, hydroxy groups, mercapto groups, carbonamide groups, sulfonamide groups, sulfo groups (including sulfonates), carboxyl groups (including carboxylates) and cyano groups. Phenyl groups, alkylamino groups, carboamide groups, chlorine atom and alkylthio groups are particularly preferable and phenyl groups are most preferable.

The divalent connecting groups represented by $L_{10}$ or $L_{20}$ are preferably those constituted by singly, an alkylene, arylene, alkenylene, alkinylene, divalent heterocyclic group, —$SO_2$—, —SO—, —O—, —S—, —N($R_n$')—, —C(=O)— and —PO—, or by a combinations of those groups, wherein $R_n$' represents an alkyl group, an aralkyl group, an aryl group or a hydrogen atom. The divalent connecting groups represented by $L_{10}$ or $L_{20}$ may have an optional substituent. Examples of the substituent include the same substituents as those which the group represented by $R_{100}$, $R_{110}$ or $R_{120}$ in the formula (a) may have. Particularly preferable examples of $L_{10}$ or $L_{20}$ include those constituted by singly, the alkylene, the arylene, —C(=O)—, —O—, —S—, —$SO_2$— and —N($R_n$')—, or by a combination of these groups.

$R_{111}$, $R_{222}$ and $R_{333}$ respectively are preferably an alkyl group or aralkyl group having 1 to 20 carbon atoms and may be the same or different. $R_{111}$, $R_{222}$ and $R_{333}$ may have a substituent. Examples of the substituent include the same substituents as those which the group represented by $R_{100}$, $R_{110}$ or $R_{120}$ in the formula (a) may have. It is particularly preferable that $R_{111}$, $R_{222}$ and $R_{333}$ respectively be an alkyl group or aralkyl group having 1 to 10 carbon atoms. Preferable examples of the substituent may include carbamoyl groups, oxycarbonyl groups, acyl groups, aryl groups, sulfo groups (including sulfonates), carboxyl groups (including carboxylates), hydroxy groups, (alkyl or aryl) amino groups and alkoxy groups.

It is to be noted that when $R_{111}$, $R_{222}$ or $R_{333}$ contains plural repeating units of an ethyleneoxy group or propyleneoxy group, the preferable range of the number of carbon atoms which are mentioned above concerning $R_{111}$, $R_{222}$ or $R_{333}$ is not limited to the above.

The quaternary salt compound represented by the formula (b) or (c) has a total of 20 or more repeating units of an ethyleneoxy group or propyleneoxy group in its molecule. These repeating units may be substituted either on one position or on plural positions. Also, these repeating units may be substituted on any of $A_1$, $A_2$, $A_3$, $A_4$, $R_{111}$ $R_{222}$, $L_{10}$ and $L_{20}$. However, the connecting group represented by $L_{10}$ or $L_{20}$ preferably has a total of 20 or more repeating units of an ethyleneoxy group or propyleneoxy group.

The quaternary salt compound represented by the formula (d) has a total of 20 or more repeating units of an ethyleneoxy group or propyleneoxy group in its molecule. These repeating units may be substituted either on one position or on plural positions. Also, these repeating units may be substituted on any of $A_5$ and $R_{333}$. However, the group represented by $R_{333}$ preferably has a total of 20 or more repeating units of an ethyleneoxy group or propyleneoxy group.

The quaternary salt compounds represented respectively by the formula (a), (b), (c) and (d) may include an ethyleneoxy group and a propyleneoxy group repeatedly at the same time. When the quaternary salt has the plural repeating unit of an ethyleneoxy group or propyleneoxy group, the number of repeating may take only one value strictly or be given as an average value. In the latter case, the quaternary salt compound is a mixture having a certain degree of distribution of molecular weight.

In the present invention, the repeating units of an ethyleneoxy group is more preferable a total of 20 or more, further and is more preferable total of 20 to 67.

In the formula (e), $Q_2$, $R_{200}$, $R_{210}$ and $R_{220}$ respectively represent groups having the same meanings as those of $Q_1$, $R_{100}$, $R_{110}$ and $R_{120}$ in the formula (a) and each preferable range is also the same.

In the formula (f), $A_6$ represent a group having the same meaning as that of $A_1$ or $A_2$ in the formula (b) and the preferable range is also the same. It is to be noted that the nitrogen-containing unsaturated hetero ring, which $A_6$ in the formula (f) forms together with the quaternary nitrogen atom, may have a substituent, however, excludes a substituent containing a primary hydroxyl group.

In the formula (e) and (f), $L_{30}$ represents an alkylene group. As the alkylene group, straight-chain, branched or cyclic substituted or unsubstituted alkylene groups having 1 to 20 carbon atoms are preferable. Not only those containing a saturated group represented by an ethylene group, but also those containing an unsaturated group represented by $—CH_2C_6H_4CH_2—$ and $—CH_2CH{=}CHCH_2—$ may be used. When $L_{30}$ has a substituent, examples of the substituent include those which the groups represented by $R_{100}$, $R_{110}$ or $R_{120}$ in the formula (a) may have.

As $L_{30}$, straight-chain or branched saturated groups having 1 to 10 carbon atoms are preferable. Substituted or unsubstituted methylene groups, ethylene groups and trimethylene groups are more preferable, substituted or unsubstituted methylene groups or ethylene groups are particularly preferable, and substituted or unsubstituted methylene groups are most preferable.

In the formula (e) and (f), $L_{40}$ represents a divalent connecting group having at least one hydrophilic group. Here, the hydrophilic group represents groups including each of $—SO_2—$, —SO—, —O—, —P(=O)—, —C(=O)—, —CONH—, $—SO_2NH—$, $—NHSO_2NH—$, —NHCONH—, amino groups, guanidino groups, ammonio groups, heterocyclic groups containing a quaternary nitrogen atom or groups comprising a combination of these groups. These hydrophilic groups are properly combined with an alkylene group, alkenylene group, arylene group or heterocyclic group to constitute $L_{40}$.

The groups, such as an alkylene group, arylene group, alkenylene group and heterocyclic groups, which constitute $L_{40}$, may have a substituent. Examples of the substituent include the same substituents as those which the groups represented by $R_{100}$, $R_{110}$ or $R_{120}$ in the formula (a) may have.

In $L_{40}$, the hydrophilic group may be present either in such a manner as to divide $L_{40}$ into sections or as a part of substituents on $L_{40}$; however, it is more preferably present in such a manner as to divide $L_{40}$ into sections. This corresponds, for example, to the case where a divalent connecting group comprising each of —C(=O)—, $—SO_2—$, —SO—, —O—, —P(=O)=, —CONH—, $—SO_2NH—$, $—NHSO_2NH—$, —NHCONH—, cationic groups (specifically, a nitrogen atom-containing hetero ring having a quaternary salt structure of phosphorus or nitrogen or a quaternary nitrogen atom), amino groups, guanidino groups, or groups comprising a combination of these groups is present in such a manner as to divide $L_{40}$ into sections.

One of preferable examples of the hydrophilic group contained in $L_{40}$ is a group containing plural repeating units of an ethyleneoxy group or propyleneoxy group by combining an ether bond and an alkylene group. The degree of polymerization or average degree of polymerization of the group is preferably 2 to 67.

As the hydrophilic group contained in $L_{40}$, the hydrophilic group contains a dissociable group either as a result of combining $—SO_2—$, —SO—, —O—, —P(=O)=, —C(=O)—, —CONH—, $—SO_2NH—$, $—NHSO_2NH—$, —NHCONH—, amino group, guanidine group, ammonio group and heterocyclic groups containing a quaternary nitrogen atom or as the substituent contained in $L_{40}$. Here, the dissociable group means a group or partial structure having a low acidic proton dissociable by an alkaline developing solution or its salt. Specific examples of the dissociable group include a carboxy group (—COOH), sulfo group ($—SO_3H$), phosphonic acid group ($—PO_3H$), phosphoric acid group ($—OPO_3H$), hydroxy group (—OH), mercapto group (—SH), $—SO_2NH_2$, N-substituted sulfonamide group ($—SO_2NH—$), $—CONHSO_2$, $—SO_2NHSO_2—$, —CONHCO—, active methylene group, —NH— self-contained in a nitrogen-containing heterocyclic group or salts of these groups.

As $L_{40}$, those obtained by properly combining an alkylene group or an arylene group with —C(=O)—, $—SO_2—$, —O—, —CONH—, $—SO_2NH—$, $—NHSO_2NH—$, —NHCONH— or an amino group are preferably used and those obtained by properly combining an alkylene group having 2 to 5 carbon atoms with —C(=O)—, $—SO_2—$, —O—, —CONH—, $—SO_2NH—$, $—NHSO_2NH—$ or —NHCONH— are more preferably used.

Y represents —C(=O)— or $—SO_2—$ with —C(=O)— being preferably used.

Examples of the counter anion represented by $X^{n-}$ in the formula (a) to (f) include halogen ions such as a chlorine ion, bromine ion and iodine ion, carboxylate ions such as an acetate ion, oxalate ion, fumarate ion and benzoate ion, sulfonate ions such as a p-toluene sulfonate ion, methane sulfonate ion, butane sulfonate ion and benzene sulfonate sulfuric acid ion, perchloric acid ion, carbonic acid ion and nitric acid ion.

As the counter anion represented by $X^{n-}$, a halogen ion, carboxylate ion, sulfonate ion or sulfuric acid is preferable. n is preferably 1 or 2. As $X_{n-}$, a chlorine ion or a bromine ion is particularly preferable and a chlorine ion is most preferable.

It is to be noted that $X^{n-}$ is not required in the case where a separate anion group is contained in the molecule and combines with $Q_1^+$, $Q_2^+$or $N^+$ to form an intermolecular salt.

As the quaternary salt compound to be used in the present invention, quaternary salts compounds represented by the formula (b), (c) and (f) are more preferable. Among these compounds, quaternary salt compounds represented by the formula (b) and (f) are particularly preferable. Further, in a preferable case, the connecting group represented by $L_{10}$ contains 20 or more repeating units of an ethyleneoxy group and. in a particularly preferable case, the connecting group contains 20 to 67 repeating units in the formula (b). Also, in the formula (f), the case where the unsaturated heterocyclic compound formed by $A_6$ represents 4-phenylpyridine, isoquinoline or quinoline is particularly preferable.

Next, specific examples of the quaternary salt compounds represented by the formula (a) to (f) will be shown. (In the formula, Ph represents a phenyl group.) However, the following compound examples are not intended to be limiting of the present invention.

| No. | $Q^+$ = | $L_0$ = | $X^-$ = |
|---|---|---|---|
| | | $Q^+—L_0—Q^+.2X^-$ | |
| 1 | 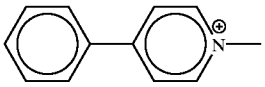 | $—C_2H_4—(OC_2H_4)_n—OC_2H_4—$ n = 20 | $Cl^{\ominus}$ |
| 2 | 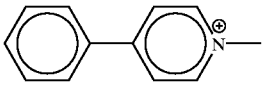 | $—C_2H_4—(OC_2H_4)_n—OC_2H_4—$ n ≈ 32 | $Cl^{\ominus}$ |
| 3 | 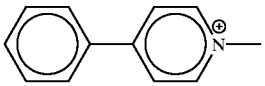 | $—C_2H_4—(OC_2H_4)_n—OC_2H_4—$ n ≈ 43 | $Cl^{\ominus}$ |
| 4 | 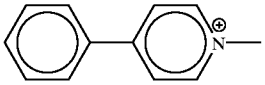 | $—C_2H_4—(OC_2H_4)_n—OC_2H_4—$ n ≈ 62 | $Cl^{\ominus}$ |
| 5 | 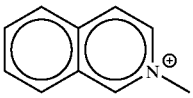 | $—C_2H_4—(OC_2H_4)_n—OC_2H_4—$ n ≈ 21 | $Cl^{\ominus}$ |
| 6 | 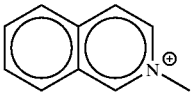 | $—C_2H_4—(OC_2H_4)_n—OC_2H_4—$ n ≈ 43 | $Cl^{\ominus}$ |
| 7 | 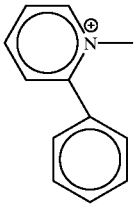 | $—C_2H_4—(OC_2H_4)_n—OC_2H_4—$ n = 20 | $Cl^{\ominus}$ |
| 8 | 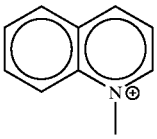 | $—C_2H_4—(OC_2H_4)_n—OC_2H_4—$ n ≈ 43 | $Cl^{\ominus}$ |
| 9 | 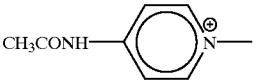 | $—C_2H_4—(OC_2H_4)_n—OC_2H_4—$ n ≈ 21 | $Cl^{\ominus}$ |
| 10 | 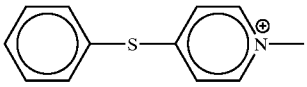 | $—C_2H_4—(OC_2H_4)_n—OC_2H_4—$ n ≈ 43 | $Cl^{\ominus}$ |
| 11 | 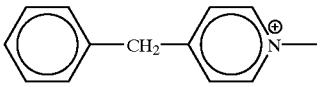 | $—C_2H_4—(OC_2H_4)_n—OC_2H_4—$ n ≈ 67 | $Cl^{\ominus}$ |
| 12 | 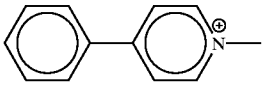 | 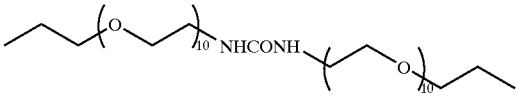 | $Cl^{\ominus}$ |
| 13 | 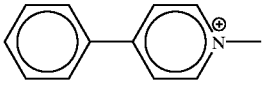 | 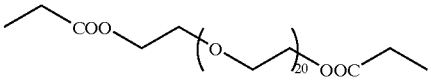 | $Cl^{\ominus}$ |

-continued
| | | | |
|---|---|---|---|
| 14 | 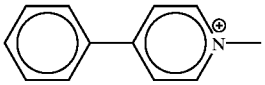 | 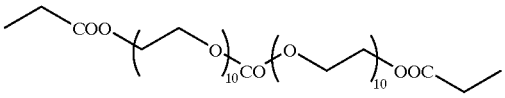 | $Cl^{\ominus}$ |
| 15 | 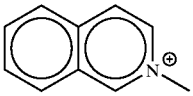 | 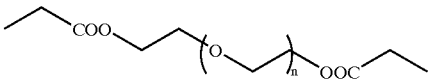 <br>n » 43 | $Cl^{\ominus}$ |
| 16 | 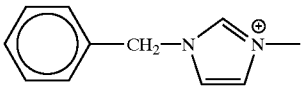 | $—C_2H_4—(OC_2H_4)_n—OC_2H_4—$<br>n ≈ 42 | $Cl^{\ominus}$ |
| 17 | 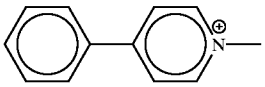 | $—C_2H_4—(OC_2H_4)_n—OC_2H_4—$<br>n ≈ 62 | 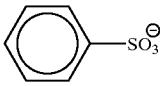 <br>n » 62 |
| 18 | 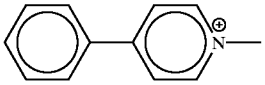 | $—C_2H_4—(OC_2H_4)_n—OC_2H_4—$<br>n ≈ 43 | $Br^{\ominus}$ |
| 19 | 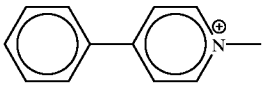 | $—C_2H_4—(OC_2H_4)_n—OC_2H_4—$<br>n = 20 | $(COO)_2^{2\ominus}$ |
| 20 | 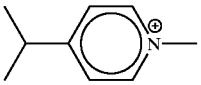 | $—C_2H_4—(OC_2H_4)_n—OC_2H_4—$<br>n ≈ 34 | $Cl^{\ominus}$ |
| 21 | 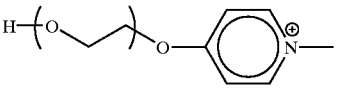 | $—(C_2)_5—$ | $CH_3SO_3^{\ominus}$ |
| 22 | 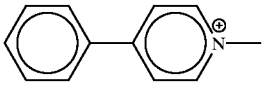 | 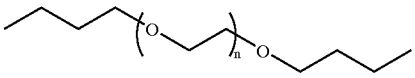 <br>n » 43 | $Cl^{\ominus}$ |
| 23 | 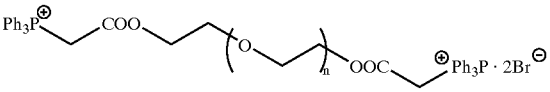 <br>n » 43 | | |
| 24 | 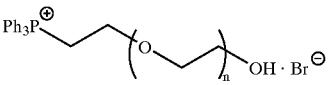 <br>n » 33 | | |

-continued
25
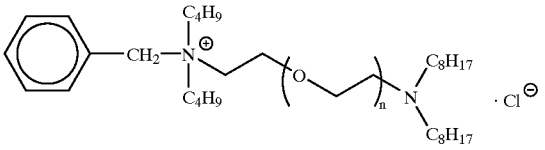
n » 33
26
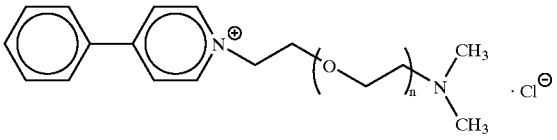
n » 43
27
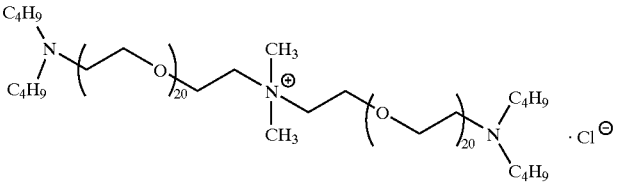
28
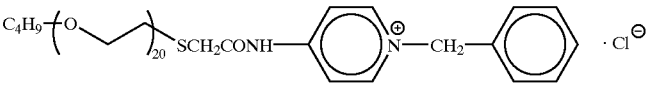
29
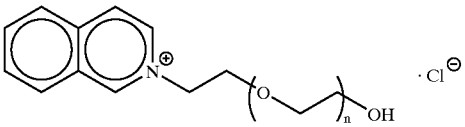
n » 67
30
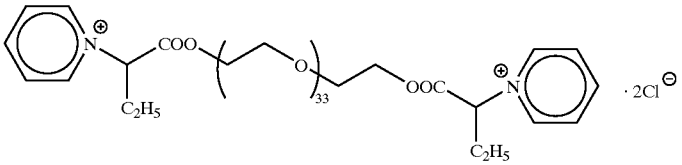
31
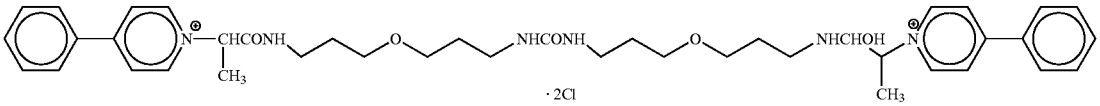
32
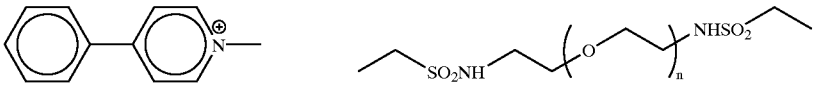
n » 12
33
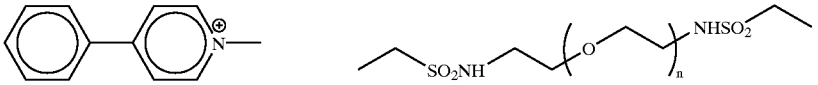
n » 24

-continued

| | | | |
|---|---|---|---|
| 34 | 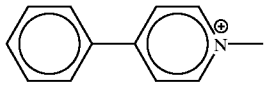 | —$(CH_3)_3CONH$  $NHCO(CH_2)_3$— | $Cl^{\ominus}$ |
| 35 | 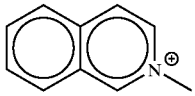 | —$(CH_3)_3CONH$  $NHCO(CH_2)_3$— | $Cl^{\ominus}$ |
| 36 | 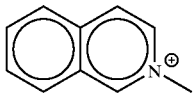 | —$CH_2$ 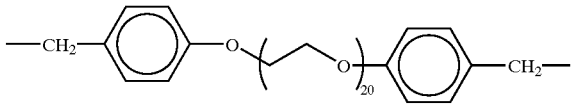 $CH_2$— | $Cl^{\ominus}$ |
| 37 | 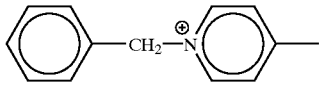 | 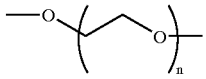 n » 33 | $Cl^{\ominus}$ |
| 38 | 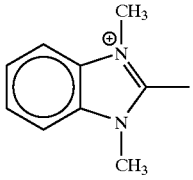 | 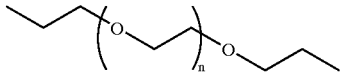 n » 43 | $Cl^{\ominus}$ |
| 39 | $(C_4H_9)_3N^{\oplus}$— | 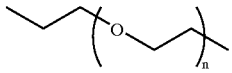 n » 20 | $Cl^{\ominus}$ |
| 40 | 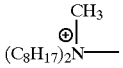 | 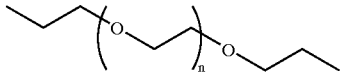 n » 43 | $Cl^{\ominus}$ |
| 41 | $Ph_3P^{\oplus}$— | 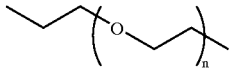 n » 20 | $Cl^{\ominus}$ |
| 42 | $Ph_3P^{\oplus}$— | 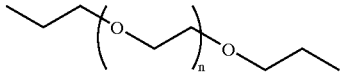 n » 33 | $Br^{\ominus}$ |

$Q^+$—$CH_2CONH$—L—$NHCOCH_2$—$Q^+.2X^-$

| No. | $Q^+$ = | L = | $X^-$ = |
|---|---|---|---|
| 43 | $Ph_3P^{\oplus}$— | —$C_2H_4$—$(OC_2H_4)_n$— n = 3 | $Cl^{\ominus}$ |
| 44 | $Ph_3P^{\oplus}$— | —$C_2H_4$—$(OC_2H_4)_n$— n = 20 | $Br^{\ominus}$ |
| 45 | $Ph_3P^{\oplus}$— | —$C_2H_4$—$(OC_2H_4)_n$— n ≈ 34 | $Cl^{\ominus}$ |
| 46 | $Ph_3P^{\oplus}$— | —$C_2H_4$—$(OC_2H_4)_n$— n = 67 | $Cl^{\ominus}$ |
| 47 | 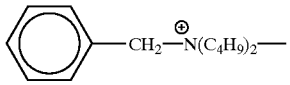 | —$C_2H_4$—$(OC_2H_4)_n$— n = 12 | $Cl^{\ominus}$ |

-continued

| | | | |
|---|---|---|---|
| 48 | $CH_2-\overset{\oplus}{N}(C_4H_9)_2$ | $-C_2H_4-(OC_2H_4)_n-$ n = 30 | $Br^{\ominus}$ |
| 49 | $CH_2-\overset{\oplus}{N}(C_4H_9)_2$ | $-C_2H_4-(OC_2H_4)_n-$ n = 43 | $SO_3^{\ominus}$ |
| 50 | $\overset{\oplus}{N}$ | $-C_2H_4-(OC_2H_4)_n-$ n = 3 | $Cl^{\ominus}$ |
| 51 | $\overset{\oplus}{N}$ | $-C_2H_4-(OC_2H_4)_n-$ n = 12 | $Cl^{\ominus}$ |
| 52 | $\overset{\oplus}{N}$ | $-C_2H_4-(OC_2H_4)_n-$ n = 20 | $Cl^{\ominus}$ |
| 53 | $\overset{\oplus}{N}$ | $-C_2H_4-(OC_2H_4)_n-$ n = 43 | $Cl^{\ominus}$ |
| 54 | $\overset{\oplus}{N}$ | $-C_2H_4-(OC_2H_4)_n-$ n = 2 | $Cl^{\ominus}$ |
| 55 | $\overset{\oplus}{N}$ | $-C_2H_4-(OC_2H_4)_n-$ n = 12 | $Br^{\ominus}$ |
| 56 | $\overset{\oplus}{N}$ | $-C_2H_4-(OC_2H_4)_n-$ n = 30 | $SO_3^{\ominus}$ |
| 57 | $\overset{\oplus}{N}$ | $-C_2H_4-(OC_2H_4)_n-$ n ≈ 67 | $(COO)_2^{2\ominus}$ |
| 58 | $CH_3S$ $\overset{\oplus}{N}$ | $-C_2H_4-(OC_2H_4)_n-$ n = 12 | $Cl^{\ominus}$ |
| 59 | $\overset{\oplus}{N}$ | $-C_2H_4-(OC_2H_4)_n-$ n = 20 | $Cl^{\ominus}$ |
| 60 | $CH_2$ $\overset{\oplus}{N}$ | $-C_2H_4-(OC_2H_4)_n-$ n = 30 | $Cl^{\ominus}$ |
| 61 | $CH_3CONH$ $\overset{\oplus}{N}$ | $-C_2H_4-(OC_2H_4)_n-$ n ≈ 67 | $Cl^{\ominus}$ |

-continued

| | | | |
|---|---|---|---|
| 62 | 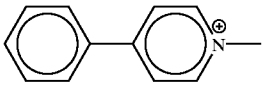 | $—C_3H_6—(OC_2H_4)_n—OC_3H_6—$<br>n = 2 | $Cl^{\ominus}$ |
| 63 | 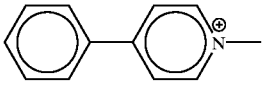 | $—C_3H_6—(OC_2H_4)_n—OC_3H_6—$<br>n = 20 | $Cl^{\ominus}$ |
| 64 | 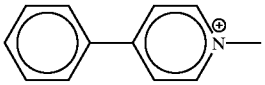 | $—C_3H_6—(OC_2H_4)_n—OC_3H_6—$<br>n ≈ 43 | $Cl^{\ominus}$ |
| 65 | $Ph_3P^{\oplus}—$ | $—C_3H_6—(OC_2H_4)_n—OC_3H_6—$<br>n = 2 | $Cl^{\ominus}$ |
| 66 | $Ph_3P^{\oplus}—$ | $—C_3H_6—(OC_2H_4)_n—OC_3H_6—$<br>n = 12 | $Cl^{\ominus}$ |
| 67 | 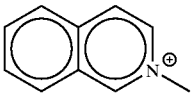 | $—C_3H_6—(OC_2H_4)_n—OC_3H_6—$<br>n = 20 | $Cl^{\ominus}$ |
| 68 | 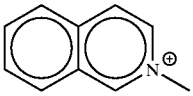 | $—C_3H_6—(OC_2H_4)_n—OC_3H_6—$<br>n ≈ 43 | $Cl^{\ominus}$ |
| 69 | $(C_3H_7)_3N^{\oplus}$ | $—C_3H_6—(OC_2H_4)_n—OC_3H_6—$<br>n ≈ 67 | $Cl^{\ominus}$ |
| 70 | $(C_3H_7)_3N^{\oplus}$ | $—CH(CH_3)CH_2—(OC_2H_4)_n—OCH_2CH(CH_3)—$<br>n » 12 | $Cl^{\ominus}$ |
| 71 | 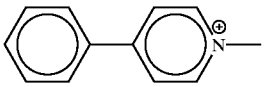 | $—CH(CH_3)CH_2—(OC_2H_4)_n—OCH_2CH(CH_3)—$<br>n »18 | $Cl^{\ominus}$ |
| 72 | 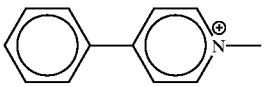 | $—CH(CH_3)CH_2—(OC_2H_4)_n—OCH_2CH(CH_3)—$<br>n » 20 | $Cl^{\ominus}$ |
| 73 | 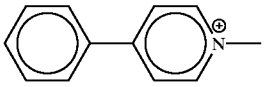 | $—C_2H_4—(O—CH_2—CH(CH_3))_n—$<br>n » 4 | $Cl^{\ominus}$ |
| 74 | 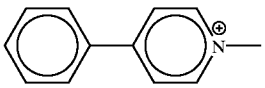 | $—C_2H_4—(O—CH_2—CH(CH_3))_n—$<br>n » 13 | $Cl^{\ominus}$ |
| 75 | 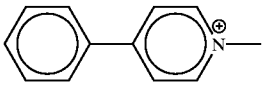 | $—(CH_2—CH_2—O)_3—NHCONH—(CH_2—CH_2—O)_3—$ | $Cl^{\ominus}$ |
| 76 | 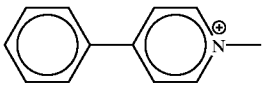 | $—(CH_2)_4—NHSO_2NH—(CH_2)_4—$ | $Cl^{\ominus}$ |

-continued

| | | | |
|---|---|---|---|
| 77 | 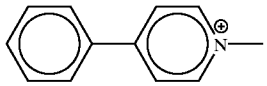 | 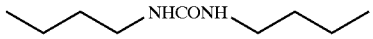 | $Cl^{\ominus}$ |
| 78 | 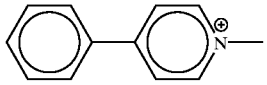 | 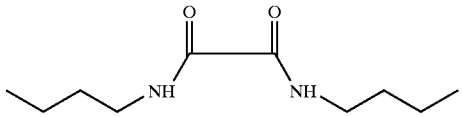 | $Cl^{\ominus}$ |
| 79 | 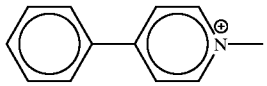 | 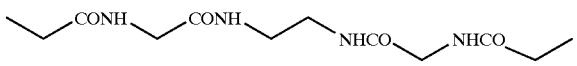 | $Cl^{\ominus}$ |
| 80 | 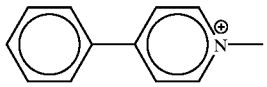 | 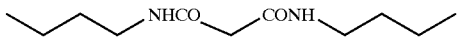 | $Cl^{\ominus}$ |
| 81 | 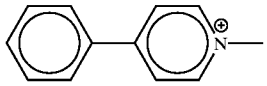 | 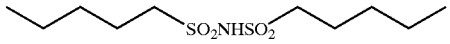 | $Cl^{\ominus}$ |
| 82 | 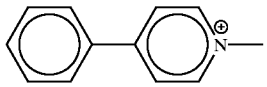 | 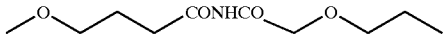 | $Cl^{\ominus}$ |
| 83 | 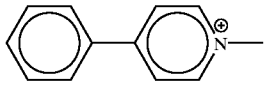 | 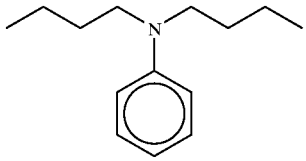 | $Cl^{\ominus}$ |
| 84 | 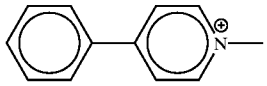 | 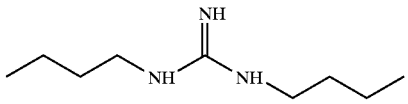 | $Cl^{\ominus}$ |
| 85 | 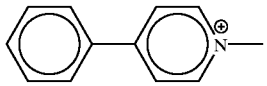 | 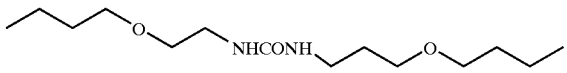 | $Cl^{\ominus}$ |
| 86 | 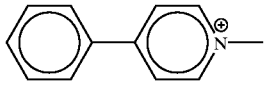 | 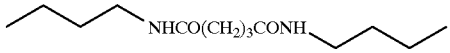 | $Cl^{\ominus}$ |

The quaternary salt compounds represented by the formulae (a) to (f) in the present invention can be synthesized with ease by known methods. Synthesis examples of these compounds will be shown below.

Synthesis Example 1

Synthesis of the Exemplified compound 3

A polyethylene glycol (average molecular weight: 2000, 800 g), thionyl chloride (584 ml) and DMF (4 ml) were mixed at ambient temperature and the mixture was heated to 90° C. and stirred for 5 hours. After excess thionyl chloride was removed, 4-phenylpyridine (372 g) was added to the mixture, which was then reacted at 150° C. for 7 hours. An ethyl acetate/2-propanol (10:1) solution of the reaction mixture was prepared and cooled. The precipitated solid was collected by filtration and dried to obtain the target exemplified compound 3 (584 g, yield: 62%).

Synthesis Example 2

Synthesis of the Exemplified compound 6

A polyethylene glycol (average molecular weight: 2000, 10 g), thionyl chloride (7.3 ml) and DMF (0.1 ml) were mixed at ambient temperature and the mixture was heated to 90° C. and stirred for 5 hours. After excess thionyl chloride was removed, isoquinoline (4.0 g) was added to the mixture, which was then reacted at 150° C. for 7 hours. An ethyl acetate/2-propanol (10:1) solution of the reaction mixture was prepared and cooled. The precipitated solid was collected by filtration and dried to obtain the target exemplified compound 6 (7.1 g, yield: 60%).

Synthesis Example 3

Synthesis of the Exemplified compound 4

The exemplified compound 4 was prepared in the same manner as in the above Synthesis Example 1 except that a polyethylene glycol (average molecular weight: 3000) was used in place of the polyethylene glycol (average molecular weight: 2000).

Synthesis Example 4

Synthesis of Exemplified 65

1,10-diamino-4,7-dioxadecane (17.6 g, 0.1 mol), potassium carbonate (27.6 g, 0.2 mol), ethyl acetate (100 ml) and water(50 ml) were vigorously agitated at a room temperature, and chloroacetyl chloride (34 g, 0.3 mol) was added dropwise thereto. The reaction solution was separated, and the separated ethyl acetate layer was dried with sodium sulfate, followed by concentration. As a result 1,10-bis (chloroacetylamino)-4,7-dioxadecane was obtained (23 g, yield 70%). 3.3 g of the thus-obtained compound and triphenylphosphine (7.9 g) were mixed and heated at 150° C. for 5 hours. The reaction mixture was cooled and then washed with ethyl acetate three times. As a result, 5.4 g of exemplified compound A-32 was obtained as a brown and viscous liquid (yield 63%).

Synthesis Example 5

Synthesis of Exemplified 62

Exemplified 62 was synthesized thoroughly in the same manner as Synthesis Example 4 except for using 4-phenylpyridine in place of triphenyl phosphine in the Synthesis Example 4.

Synthesis Example 6

Synthesis of Exemplified 71

Exemplified 4 was synthesized thoroughly in the same manner as Synthesis Example 4 except for using 0,0'-bis (2-aminopropyl) polyethylene glycol 800 in place of 1,10-diamino-4,7-dioxadecane, and further using 4-phenylpyridine in place of triphenyl phosphine in the Synthesis Example 71.

The nucleation accelerator in the present invention may be used after it is dissolved in a proper water-miscible organic solvent such as alcohols (methanol, ethanol, propanol or fluorinated alcohol), ketones (acetone or methyl ethyl ketone), dimethylformamide, dimethylsulfoxide or methyl cellosolve.

Also, the nucleation accelerator may be used after it is dissolved using an auxiliary solvent such as dibutylphthalate, tricresyl phosphate, an oil such as glyceryl triacetate or diethyl phthalate, ethyl acetate, or cyclohexanone according to an already well-known emulsion-dispersion method to produce an emulsion-dispersion mechanically. Alternatively, the nucleation accelerator may be used by dispersing a powder of the nucleation accelerator in water by using a ball mill, colloid mill or ultrasonic waves.

In the present invention, the nucleation accelerator is preferably added to a light-insensitive layer comprising a hydrophilic colloidal layer containing no silver halide emulsion on the side of the silver halide emulsion layer with respect to the support. It is particularly preferable to add the nucleation accelerator to a light-insensitive layer comprising a hydrophilic colloidal layer and disposed between said silver halide emulsion layer and the support.

In the present invention, the amount of the nucleation accelerator to be added is preferably $1\times10^{-6}$ to $2\times10^{-2}$ mol more preferably $1\times10^{-5}$ to $2\times10^{-2}$ mol and most preferably $2\times10^{-5}$ to $1\times10^{-2}$ mol, per mol of silver halide. These nucleation accelerators may be used in combinations of two or more.

No particular limitation is imposed on the silver halide of the silver halide emulsion to be used in the silver halide photographic light-sensitive material of the present invention. As, the silver halide, although silver chloride, silver chlorobromide, silver bromide, silver chlorobromoiodide or silver bromoiodide may be used, silver chlorobromide or silver chlorobromoiodide containing 50 mol % or more of silver chloride is preferable. The silver halide particle may have any form, e.g., a cubic, tetradecahedron, octahedron, undefined shape and plate shape with a cubic being desirable. The average particle diameter of the silver halide is preferably 0.1 $\mu$m to 0.7 $\mu$m and more preferably 0.1 to 0.5 $\mu$m. Silver halide particles whose coefficient of variation given by the formula {(standard deviation of particle diameter)/(average particle diameter)}×100 is generally 15% or less and preferably 10% or less and the silver halide particles having a narrow distribution of particle diameter are preferred.

The silver halide particle may have a structure in which the inside and the surface are made of either uniform phases or different phases. The silver halide particle may also have a localized layer different in halogen composition in the inside or on the surface of the particle.

The photographic emulsion to be used in the present invention can be prepared using methods described, for example, by P. Glafkides, in *Chimie et Physique Photographique,* Paul Montel (1967); by G. F. Dufin, in *Photographic Emulsion Chemistry,* The Focal Press (1966); and by V. L. Zelikman et al., in *Making and Coating Photographic Emulsion,* The Focal Press (1964).

More specifically, either an acid process or a neutral process may be used. Further, a method of reacting a soluble silver salt and a soluble halogen salt may be carried out by any of a single jet method, a double jet method, and a combination thereof. A method of forming particles in the presence of excessive silver ion (the so-called reverse-mixing method) may also be used.

As one form of the double jet method, a method of maintaining the pAg constant in the liquid phase where silver halide is produced, namely, a so-called controlled double jet method, may be used. Further, it is preferred to form particles using a so-called silver halide solvent, such as ammonia, thioether, or tetra-substituted thiourea, more preferably using a tetra-substituted thiourea compound, and this is described in JP-A-53-82408 and JP-A-55-77737. Preferred examples of the thiourea compound include tetramethylthiourea and 1,3-dimethyl-2-imidazolidinethione. The amount of silver halide solvent added varies depending on the kind of the compound used or the particle size and the halogen composition expected, but it is preferably from $10^{-5}$ to $10^{-2}$ mol per mol of silver halide.

According to the controlled double jet method or the method of forming particles using a silver halide solvent, a silver halide emulsion comprising particles having a regular crystal form and a narrow particle size distribution can be easily prepared. These methods are useful means for preparing the silver halide emulsion to be used in the present invention.

In order to render the particle size uniform, it is preferred to rapidly grow particles within the range not exceeding the critical saturation degree, using a method of changing the addition rate of silver nitrate or alkali halide according to the particle growth rate, as described in British Patent No. 1,535,016, JP-B-48-36890, and JP-B-52-16364, or a method of changing the concentration of the aqueous solution, as described in British Patent No. 4,242,445 and JP-A-55-158124.

The silver halide emulsion to be used in the present invention may contain a metal that belongs to the group VIII in the periodic table. It is especially preferred that a light-sensitive material suitable for a high intensity exposure such as a scanner exposure and a light-sensitive material for a line image photographing each contain such a metal compound as a rhodium compound, an iridium compound, or a ruthenium compound, to thereby attain a high contrast and a low fog. Meanwhile, the silver halide particles are advantageously doped with a metal complex hexacyanide such as $K_4[Fe(CN)_6]$, $K_4[Ru(CN)_6]$ or $K_3[Cr(CN)_6]$.

As a rhodium compound to be used in the present invention, a water-soluble rhodium compound can be used. Examples of the rhodium compound include rhodium (III) halide compounds, or rhodium coordination complex salts having a halogen atom, amines, oxalato, or aqua, etc., as a ligand, such as a hexachloro rhodium (III) complex salt, a pentachloroaqua rhodium (III) complex salt, a tetrachlorodiaqua rhodium (III) complex salt, a hexabromo rhodium (III) complex salt, a hexamine rhodium (III) complex salt, and a trioxalato rhodium (III) complex salt. The above-described rhodium compound is dissolved in water or an appropriate solvent before use, and a method generally, commonly used for stabilizing a solution of the rhodium compound, namely, a method of adding an aqueous solution of hydrogen halogenide (e.g. hydrochloric acid, hydrobromine acid, hydrofluoric acid) or an alkali halide (e.g. KCl, NaCl, KBr, NaBr), may be used. It is also possible to add and dissolve separately prepared silver halide particles that are previously doped with rhodium, in place of a water-soluble rhodium compound, at the preparation of silver halide.

A rhenium, ruthenium, and osmium to be used in the present invention can be added in the form of water-soluble complex salts of them, described in JP-A-63-2042, JP-A-1-285941, JP-A-2-20852, and JP-A-2-20855, etc. Among these, particularly preferred are hexa-coordination metal complexes represented by the following formula:

$$[ML_6]^{n-}$$

wherein M represents Ru, Re, or Os; L represents a ligand, and n represents 0, 1, 2, 3, or 4. A counter ion for the above-described complex may be any cation. Examples of the counter ion include an ammonium ion and an alkali metal ion. Further, preferable examples of the ligand include a halide ligand, a cyanide ligand, a cyanate ligand, a nitrosyl ligand, and a thionitrosyl ligand. Specific examples of the complex to be used in the present invention are illustrated below, but they are not intended to limit the scope of the invention.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |
| $[Ru(CO)Cl_5]^{2-}$ | $[Ru(CO)Br_5]^{2-}$ | |

-continued

| | | |
|---|---|---|
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

The addition amount of these compounds is preferably from $1\times10^{-9}$ mol to $1\times10^{-5}$ mol, and especially preferably from $1\times10^{-8}$ mol to $1\times10^{-6}$ mol, per mol of silver halide.

Examples of the iridium compound to be used in the present invention include hexachloro iridium, hexabromo iridium, hexaammine iridium, and pentachloro nitrosyl iridium. Examples of the iron compound to be used in the present invention include potassium hexacyano ferrate (II) and ferrous thiocyanate.

The silver halide emulsion to be used in the present invention is preferably subjected to chemical sensitization. The chemical sensitization may be performed using a known method, such as sulfur sensitization, selenium sensitization, tellurium sensitization, or noble metal sensitization, and these sensitization methods may be used individually or in combination. When these sensitization methods are used in combination, a combination of sulfur sensitization and gold sensitization; a combination of sulfur sensitization, selenium sensitization, and gold sensitization; and a combination of sulfur sensitization, tellurium sensitization, and gold sensitization, are preferred.

The sulfur sensitization to be used in the present invention is usually performed by adding a sulfur sensitizer and stirring the emulsion at a high temperature of 40° C. or higher for a predetermined time. The sulfur sensitizer to be used may be a known compound, and examples thereof include, in addition to the sulfur compound contained in gelatin, various sulfur compounds, such as thiosulfates, thioureas, thiazoles, and rhodanines. Preferred sulfur compounds are a thiosulfate and a thiourea compound. The addition amount of the sulfur sensitizer varies depending on various conditions, such as the pH and the temperature at the time of chemical ripening and the size of silver halide particles, but it is preferably from $10^{-7}$ to $10^{-2}$ mol, more preferably from $10^{-5}$ to $10^{-3}$ mol, per mol of silver halide.

The selenium sensitizer to be used in the present invention may be a known selenium compound. The selenium sensitization is generally performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-109240, JP-A-4-324855, and among these, particularly preferred are the compounds represented by formula (VIII) or (IX) of JP-A-4-324855.

The tellurium sensitizer to be used in the present invention is a compound for forming silver telluride, which is presumed to become a sensitization nucleus, on the surface of or inside a silver halide particle. The formation rate of silver telluride in a silver halide emulsion can be examined according to a method described in JP-A-5-313284.

Specific examples of the tellurium sensitizer to be used include the compounds described in U.S. Pat. Nos. 1,623,499, 3,320,069, and 3,772,031, British Patent Nos. 235,211, British Patent Nos. 1,121,496, British Patent Nos. 1,295,462, and British Patent Nos. 1,396,696, Canadian Patent No. 800,958, JP-A-4-204640, JP-A-4-271341, JP-A-4-333043, JP-A-5-303157, *J. Chem. Soc. Chem. Commun.,* 635(1980); *ibid.,* 1102 (1979); *ibid.,* 645 (1979); *J. Chem. Soc. Perkin. Trans.,* 1, 2191 (1980); S. Patai (compiler), *The Chemistry of Organic Serenium and Tellunium Compounds,* Vol. 1 (1986); and *ibid.,* Vol. 2 (1987). The compounds represented by formulae (II), (III), and (IV) of JP-A-4-324855 are particularly preferred.

The amount to be used of the selenium sensitizer or the tellurium sensitizer to be used in the present invention varies depending on the silver halide particles used or the chemical ripening conditions, but it is generally from in the order of $10^{-8}$to $10^{-2}$ mol, preferably from $10^{-7}$ to $10^{-3}$ mol, per mol of silver halide. The conditions of chemical sensitization in the present invention are not particularly restricted, but the pH is generally from 5 to 8, the pAg is generally from 6 to 11, preferably from 7 to 10, and the temperature is generally from 40 to 95° C., preferably from 45 to 85° C.

Examples of the noble metal sensitizer to be used in the present invention include gold, platinum, palladium, and iridium, and gold sensitization is particularly preferred. Specific examples of the gold sensitizer to be used in the present invention include chloroauric acid, potassium chloroaurate, potassium auric thiocyanate, and gold sulfide. The gold sensitizer can be used in an amount of approximately from $10^{-7}$ to $10^{-2}$ mol per mol of silver halide.

In the silver halide emulsion to be used in the present invention, a cadmium salt, a sulfite, a lead salt, or a thallium salt may be present together during formation or physical ripening of silver halide particles.

In the present invention, reduction sensitization may be used. Examples of the reduction sensitizer to be used include stannous.salt's, amines, formamidinesulfinic acid, and silane compounds.

To the silver halide emulsion to be used in the present invention, a thiosulfonic acid compound may be added, according to the method described in European Unexamined Patent Publication (EP) -293,917.

As the silver halide emulsion in the light-sensitive material used in the present invention, only one type may be used or two or more types (for example, those different in average particle size, in halogen composition, in crystal habit or in the condition of chemical sensitization) may be used together. To obtain, particularly, high contrast, it is preferable to apply an emulsion with a higher sensitivity as the emulsion is closer to a support as described in JP-A-6-324426.

The light-sensitive silver halide emulsion to be used in the present invention may be spectrally sensitized to blue light, green light, red light or infrared light having relatively long wavelengths by the sensitizing dye. As the sensitizing dye, the compounds of the formula [I] described in JP-A-55-45015 and the compounds of the formula [I] described in JP-A-9-160185 are preferable and the compounds of the formula [I] described in JP-A-9-160185 are particularly preferable. Specific examples include the compounds (1) to (19) described in JP-A-55-45015. and the compounds (I-1) to (I-40) and (I-56) to (I-85) described in JP-A-9-160185.

Examples of the sensitizing dye that can be used also include a cyanine dye, a merocyanine dye, a complex cyanine dye, a complex merocyanine dye, a holopolar cyanine dye, a styryl dye, a hemicyanine dye, an oxonol dye, and a hemioxonol dye.

Useful sensitizing dyes to be used in the present invention are described, for example, in *Research Disclosure,* Item 17643, IV-A (December, 1978, page 23); *ibid.,* Item 18341 X (August 1979, page 437), and publications cited therein.

In particular, sensitizing dyes having spectral sensitivity suitable for spectral characteristics of various light sources in a scanner, an image setter, or a photomechanical camera, can be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, Compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, besides the above-described compounds, Compounds I-41 to I-55 and I-86 to I-97 described in JP-A-9-160185, Compounds 4-A to 4-S, 5-A to 5-Q, and 6-A to 6-T described in JP-A-6-242547, may be advantageously selected.

These sensitizing dyes may be used individually or in combination, and a combination of sensitizing dyes is often used for the purpose of, particularly, supersensitization. In combination with the sensitizing dye, a dye which itself has no spectral sensitization effect, or a material that absorbs substantially no visible light, but that exhibits supersensitization, may be incorporated into the emulsion.

Useful sensitizing dyes, combinations of dyes that exhibit supersensitization, and materials that show supersensitization are described, for example, in *Research Disclosure,* Vol. 176, 17643, page 23, Item IV-J (December 1978); JP-B-49-25500, JP-B-43-4933, JP-A-59-19032, and JP-A-59-192242.

The sensitizing dyes to be used in the present invention may be used in a combination of two or more thereof. The sensitizing dye may be added to a silver halide emulsion by dispersing it directly in the emulsion, or by dissolving it in a sole or mixed solvent of such solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by a method disclosed in U.S. Pat. No. 3,469,987, in which a dye is dissolved in a volatile organic solvent, the solution is dispersed in water or a hydrophilic colloid, and the dispersion is added to the emulsion; a method disclosed, for example, in JP-B-44-23389, JP-B-44-27555, and JP-B-57-22091, in which a dye is dissolved in an acid, and the solution is added to the emulsion, or a dye is formed into an aqueous solution in the co-existence of an acid or base and then it is added to the emulsion; a method disclosed, for example, in U.S. Pat. Nos. 3,822,135 and 4,006,025, in which a dye is formed into an aqueous solution or a colloid dispersion in the presence of a surface-active agent together, and the solution or dispersion is added to the emulsion; a method disclosed in JP-A-53-102733 and JP-A-58-105141, in which a dye is directly dispersed in a hydrophilic colloid, and the dispersion is added to the emulsion; or a method disclosed in JP-A-51-74624, in which a dye is dissolved using a compound capable of red-shift, and the solution is added to the emulsion. Ultrasonic waves may also be used in the solution.

The sensitizing dye to be used in the present invention may be added to a silver halide emulsion to be used in the present invention at any step known to be useful during the preparation of a photographic emulsion. For example, the dye may be added at a step of formation of silver halide particles, and/or in a period before desalting, or at a step of desalting, and/or in a period between after desalting and before initiation of chemical ripening, as disclosed, for example, in U.S. Pat. Nos. 2,735,766, 3,628,960, 4,183,756, and 4,225,666, JP-A-58-184142, and JP-A-60-196749, or the dye may be added in any period or at any step before coating of the emulsion, such as immediately before or during chemical ripening, or in a period after chemical ripening but before coating, as disclosed, for example, in JP-A-58-113920. Also, a sole kind of compound alone, or compounds different in structure in combination, may be added in divided manner; for example, a part during particle formation, and the remaining during chemical ripening, or after completion of the chemical ripening; or a part before or during chemical ripening, and the remaining after completion of the chemical ripening, as disclosed, for example, in U.S. Pat. No. 4,225,666 and JP-A-58-7629. The kind of compounds added in divided manner, or the kind of the combination of compounds, may be changed.

The addition amount of the sensitizing dye to be used in the present invention varies depending upon the shape, size, the halogen composition of silver halide particles, the method and degree of chemical sensitization, the kind of antifoggant, and the like, but the addition amount can be from $4\times10^{-6}$ to $8\times10^{-3}$ mol per mol of silver halide. For example, when the silver halide particle size is from 0.2 to 1.3 $\mu$m, the addition amount is preferably from $2\times10^{-7}$ to $3.5\times10^{-6}$ more preferably from $6.5\times10^{-7}$to $2.0\times10^{-6}$ mol, per $m^2$ of the surface area of a silver halide particle.

Various additives to be used in the light-sensitive material of the present invention are not particularly restricted, and, for example, those described in the following portions may be preferably used.

Polyhydroxybenzene compounds described in JP-A-3-39948, from page 10, right lower column, line 11, to page 12, left lower column, line 5, specifically, Compound (III)-1 to 25 described in the publication.

Compounds represented by formula (I) and having substantially no maximum absorption in the visible region, described in JP-A-1-118832, specifically, Compounds I-1 to I-26 described in the publication.

Antifogging agents described in JP-A-2-103536, page 17, right lower column, line 19, to page 18, right upper column, line 4.

Polymer latexes described in JP-A-2-103536, page 18, left lower column, lines 12 to 20; polymer latexes having an activated methylene group represented by formula (I) described in JP-A-9-179228, specifically, Compounds I-1 to 1-16 described in the specification thereof; polymer latexes having a core/shell structure described in JP-A-9-179228, specifically, Compounds P-1 to P-55 described in the specification thereof; An acidic polymer latex described in the publication of JP-A-7-104413, page 14, left column, line 1 to right column, line 30, specifically the compounds II-1) to II-9) described in the same publication, page 15.

Matting agents, slipping agents, and plasticizers described in JP-A-2-103536, from page 19, left upper column, line 15, to right upper column, line 15.

Hardening agents described in JP-A-2-103536, page 18, right upper column, lines 5 to 17.

Compounds having an acid group described in JP-A-2-103536, from page 18, right lower column, line 6, to page 19, left upper column, line 1.

Electrically conductive materials described in JP-A-2-18542, from page 2, left lower column, line 13, to page 3, right upper column, line 7, specifically, metal oxides described in the publication, page 2, right lower column, lines 2 to 10, and electrically conductive high-molecular compounds of Compounds P-1 to P-7 described in the publication.

Water-soluble dyes described in JP-A-2-103536, from page 17, right lower column, lines 1 to page 17, right upper column, line 18.

Solid dispersion dyes represented by formulae (FA), (FA1), (FA2), and (FA3) described in JP-A-9-179243, specifically, Compounds F1 to F34 in the specification thereof, and Compounds (II-2) to (II-24), (III-5) to (III-18), and (IV-2) to (IV-7) described in JP-A-7-152112; solid dispersion dyes described in JP-A-2-294638 and JP-A-5-11382.

Redox compounds described in JP-A-5-274816, and can be released a development inhibitor by oxidation, preferably, redox compounds represented by formulae (R-1), (R-2), and (R-3) described in JP-A-5-274816, specifically, Compounds R-1 to R-68 described in JP-A-5-274816.

Binders described in the publication of JP-A-2-18542, page 3, right lower column, line 1 to line 20.

The degree of swelling of the hydrophilic colloid layers of the silver halide photographic light-sensitive material of the present invention, including a silver halide emulsion layer and a protective layer, is preferably from 80 to 150%, and more preferably from 90 to 140%. The degree of swelling of the hydrophilic colloid layers is obtained by measuring the thickness ($d_0$) of the hydrophilic colloid layers, including a silver halide emulsion layer and a protective layer, of the silver halide photographic light-sensitive material, measuring the swollen thickness ($\Delta d$) of the said silver halide photographic light-sensitive material after it has been dipped in distilled water at 25° C. for 1 minute, and following the calculating equation set forth below.

$$\text{Degree of swelling } (\%)=(\Delta d \div d_0)\times 100$$

The pH of a film surface on the side to which the silver halide emulsion layer of the silver halide photographic light-sensitive material of the present invention is applied is in a range of 4.5 to 7.5, preferably 4.8 to 6.0.

Examples of the support (base) that can be used in practice of the present invention include a baryta paper, a polyethylene-laminated paper, a polypropylene synthetic paper, a glass plate, cellulose acetate, cellulose nitrate, and polyester films, such as polyethylene terephthalate. These supports are properly selected in accordance with the use purpose of each silver halide photographic light-sensitive material.

Also, a support comprising a styrene-series polymer having a syndiotactic structure described in JP-A-7-234478 and U.S. Pat. No. 558,979 is preferably used.

The processing agents, such as the developer and the fixing solution, and the processing method used in processing the light-sensitive material of the present invention are described below, but the invention is by no means limited to the following description and specific examples.

In development-processing the light-sensitive material of the present invention, it may be performed by any known method, and a known development processing solution may be used.

The developing agent to be used in the developer (the development-initiating solution and the development replenisher are collectively called a developer, hereinafter the same) used in processing the light-sensitive material of the present invention is not particularly restricted, but it preferably contains a dihydroxybenzene compound, an ascorbic acid derivative, or a hydroquinone monosulfonate, individually or in combination. Particularly, it is preferable for the developing agent to comprise a combination of a dihydroxybenzene-series developing agent with an auxiliary developing agent that shows superadditivity. Examples of the combination include combinations of dihydroxybenzenes and/or ascorbic acid derivatives with p-aminophenol compound.

Examples of the dihydroxybenzene developing agent used in processing the light-sensitive material of the present invention include hydroquinone, chlorohydroquinone, isopropylhydroquinone, and methylhydroquinone, with hydroquinone being particularly preferred. As an ascorbic acid derivative-type developing agent, ascorbic acid or isoascorbic acid or its salts may be used. Particularly sodium erysorbate is preferable in view of material costs.

Examples of the -1-phepnyl-3-pyrazolidones or derivatives thereof as the developing agent used in processing the light-sensitive material of the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-series developing agent used in processing the light-sensitive material of the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino) phenol, with N-methyl-p-aminophenol and aminophenols, described in JP-A-9-297377, and JP-A-9-297378, being preferred.

The dihydroxybenzene-series developing agent is preferably used in an amount of generally from 0.05 to 0.8 mol/l. When a dihydroxybenzene compound and a 1-phenyl-3-pyrazolidone compound or a p-aminophenol compound are used in combination, the former is preferably used in an amount of from 0.05 to 0.6 mol/l, more preferably from 0.10 to 0.5 mol/l, and the latter is preferably used in an amount of 0.06 mol/l or less, more preferably from 0.03 to 0.003 mol/l.

The ascorbic acid derivative type developing agent is used in an amount of generally 0.01 mol/l to 0.5 mol/l and more preferably 0.05 mol/l to 0.3 mol/l. When a combination of an ascorbic acid derivative and 1-phenyl-3-pyrazolidones or p-aminophenols is used, preferably the ascorbic acid derivative is used in an amount of 0.01 mol/l to 0.5 mol/l and 1-phenyl-3-pyrazolidones or p-aminophenols are used in an amount of 0.005 mol/l to 0.2 mol/l.

The developer used in processing the light-sensitive material of the present invention may contain additives (e.g. a developing agent, an alkali agent, a pH buffer, a preservative, a chelating agent) that are commonly used. Specific examples thereof are described below, but the present invention is by no means limited thereto.

Examples of the buffer to be used in the developer used in development-processing the light-sensitive material of the present invention include carbonates, boric acids described in JP-A-62-186259, saccharides (e.g. saccharose) described in JP-A-60-93433, oximes (e.g. acetoxime), phenols (e.g. 5-sulfosalicylic acid), and tertiary phosphates (e.g. sodium salt and potassium salt), with carbonates and boric acids being preferred. The buffer, particularly the carbonate, is preferably used in an amount of 0.1 mol/l or more, particularly preferably from 0.2 to 1.5. mol/l.

Examples of the preservative to be used in the present invention include sodium sulfite, potassium sulfite, lithium sulfite, ammonium sulfite, sodium bisulfite, sodium methabisulfite, and formaldehyde-sodium bisulfite. The sulfite is used in an amount of preferably 0.2 mol/l or more, particularly preferably 0.3 mol/l or more, but if it is added too excessively, silver staining in the developer is caused. Accordingly, the upper limit is preferably 1.2 mol/l. The amount is particularly preferably from 0.35 to 0.7 mol/l.

As a preservative for a dihydroxybenzene-series developing agent, the aforementioned ascorbic acid derivative may be used in a small amount together with a sulfite. Among these ascorbic derivatives, it is preferable to use sodium erysorbate in view of material costs. The amount of the ascorbic acid derivative in a range of preferably 0.03 to 0.12 and particularly preferably 0.05 to 0.10 in terms of mol ratio to dihydroxybenzene-series developing agent. When an ascorbic acid derivative is used as a preservative, it is not preferable that a boron compound is contained in the developer.

Examples of additives to be used other than those described above include a development inhibitor, such as sodium bromide and potassium bromide, an organic solvent, such as ethylene glycol, diethylene glycol, triethylene glycol, and dimethylformamide; a development accelerator, such as an alkanolamine including diethanolamine and triethanolamine, and an imidazole and derivatives thereof; and a physical development unevenness inhibitor, such as a heterocyclic mercapto compound (e.g. sodium 3-(5-mercaptotetrazol-1-yl)benzene sulfonate, 1-phenyl-5-mercaptotetrazole) and the compounds described in JP-A-62-212651.

Further, a mercapto-series compound, an indazole-series compound, a benzotriazole-series compound, or a benzimidazole-series compound may be added, as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, and 2-mercaptobenzotriazole. The addition amount thereof is generally from 0.01 to 10 mmol, preferably from 0.1 to 2 mmol, per liter of the developer.

Further, various kinds of organic or inorganic chelating agents can be used individually or in combination in the developer to be used in the present invention.

Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acid, described in U.S. Pat. Nos. 3,214,454 and 3,794,591 and West German Patent Publication (OLS) No. 2,227,369, and the compounds described in *Research Disclosure,* Vol. 181, Item 18170 (May 1979).

Examples of the aminophosphonic acid include aminotris(methylenephosphonic acid), ethylenediamine tetramethylenephosphonic acid, aminotrimethylenephosphonic acid, and the compounds described in *Research Disclosure,* No. 18170 (supra), JP-A-57-208554, JP-A-54-61125, JP-A-55-29883, and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, and *Research Disclosure,* No. 18170 (supra).

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$to $1\times10^{-1}$ mol, more preferably from $1\times^{-3}$ to $1\times10^{-2}$ mol, per liter of the developer.

Examples of the silver stain inhibitor added to the developer include the compounds described in JP-A-56-24347, JP-B-56-46585, JP-B-62-2849, JP-A-4-362942, and JP-A-8-6215; triazines having one or more mercapto groups (for example, the compounds described in JP-B-6-23830, JP-A-3-282457, and JP-A-7-175178); pyrimidines having one or more mercapto groups (e.g. 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, compounds described in JP-A-9-274289); pyridines having one or more mercapto groups (e.g. 2-mercaptopyridine, 2,6-dimercaptopyridine, 3,5-dimercaptopyridine, 2,4,6-trimercaptopyridine, compounds described in JP-A-7-248587); pyrazines having one or more mercapto groups (e.g. 2-mercaptopyrazine, 2,6-dimercaptopyrazine, 2,3-dimercaptopyrazine, 2,3,5-trimercaptopyrazine); pyridazines having one or more mercapto groups (e.g. 3-mercaptopyridazine, 3,4-dimercaptopyridazine, 3,5-dimercaptopyridazine, 3,4,6-trimercaptopyridazine); the compounds described in JP-A-7-175177, and polyoxyalkylphosphates described in U.S. Pat. No. 5,457,011. These silver stain inhibitors may be used-individually or in combination of two or more of these. The addition amount thereof is preferably from 0.05 to 10 mmol, more preferably from 0.1 to 5 mmol, per liter of the developer.

The developer may contain the compounds described in JP-A-61-267759, as a dissolution aid. Further, the developer may contain a color toner, a surface-active agent, a defoaming agent, or a hardening agent, if necessary.

The developing solution has a pH ranging preferably from 9.0 to 12.0, particularly preferably from 9.0 to 11.0 and still more preferably from 9.5 to 11.0. As an alkaline agent to be used for pH adjustment, a usual water-soluble inorganic alkali metal salt (e.g., sodium hydroxide, potassium hydroxide, sodium carbonate or potassium carbonate) may be used.

With respect to the cation of the developer, potassium ion does not inhibit development but causes small indentations, called a fringe, on the periphery of the blacked portion, as compared with sodium ion. When the developer is stored as a concentrated solution, potassium salt is generally preferred, because of its higher solubility. However, since, in the fixing solution, potassium ion causes fixing inhibition on the same level as caused by silver ion, if the developer has a high potassium ion concentration, the developer is carried over by the light-sensitive material, to disadvantageously increase the potassium ion concentration in the fixing solution. Accordingly, the molar ratio of potassium ion to sodium ion in the developer is preferably between 20:80 and 80:20. The ratio of potassium ion to sodium ion can be freely controlled within the above-described range by a counter cation, such as a pH buffer, a pH-adjusting agent, a preservative, or a chelating agent.

The replenishing amount of the developer replenisher is generally 390 ml or less, preferably from 325 to 30 ml, and most preferably from 250 to 120 ml, per $m^2$ of the light-sensitive material. The developer replenisher may have the same composition and/or concentration as the development initiating solution, or it may have a different composition and/or concentration from the initiating solution.

Examples of the fixing agent in the fixing processing agent to be used in the present invention include ammonium thiosulfate, sodium thiosulfate, and ammonium sodium thiosulfate. The amount to be used of the fixing agent may be varied appropriately, but it is generally from about 0.7 to about 3.0 mol/l.

The fixing solution to be used in the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, and aluminum lactate. These are each preferably contained, in terms of an aluminum ion concentration in the use solution, in an amount of from 0.01 to 0.15 mol/l.

When the fixing solution is stored as a concentrated solution or a solid agent, it may be constituted by a plurality of parts, preparing a hardening agent or the like as a separate part, or it may be constituted as a one-part agent containing all components.

The fixing processing agent may contain, if desired, a preservative (e.g. sulfite, bisulfite, metabisulfite; in an amount of generally 0.015 mol/l or more, preferably from 0.02 to 0.3 mol/l), a pH buffer (e.g. acetic acid, sodium acetate, sodium carbonate, sodium hydrogencarbonate, phosphoric acid, succinic acid, adipic acid; in an amount of generally from 0.1 to 1 mol/l, preferably from 0.2 to 0.7 mol/l), or a compound having aluminum-stabilizing ability or hard-water-softening ability (e.g. gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, crysteine, ethylenediaminetetraacetic acid, nitrilotriacetic acid, and a derivative and salt thereof, saccharides, and boric acid; in an amount of generally from 0.001 to 0.5 mol/l, preferably from 0.005 to 0.3 mol/l).

In addition, the fixing processing agent may contain a compound described in JP-A-62-78551, a pH-adjusting agent (e.g. sodium hydroxide, ammonia, sulfuric acid), a surface-active agent, a wetting agent, or a fixing accelerator. Examples of the surface-active agent include anionic surface-active agents, such as sulfated products and sulfonated products; polyethylene-series surface-active agents, and amphoteric surface-active agents described in JP-A-57-6840. A known deforming agent may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535, and JP-B-58-122536; alcohols having a triple bond within the molecule; thioether compounds described in U.S. Patent No. 4,126,459; mercapto compounds described in JP-A-64-4739, JP-A-1-4739, JP-A-1-159645, and JP-A-3-101728; thiocyanates and meso-ionic compounds described in JP-A-4-170539.

The fixing solution to be used in the present invention has a pH of preferably 4.0 or more, more preferably from 4.5 to 6.0. The pH of the fixing solution increases due to mingling of the developer upon processing, and in this case, the hardening fixing solution has a pH of generally 6.0 or less, preferably 5.7 or less, and the non-hardening fixing solution has a pH of generally 7.0 or less, preferably 6.7 or less.

The replenishing amount of the fixing solution is generally 500 ml or less, preferably 390 ml or less, more preferably from 320 to 80 ml, per 1 $m^2$ of the light-sensitive material. The replenisher may have the same composition and/or concentration as the initiating solution, or it may have a composition and/or a concentration different from the initiating solution.

The fixing solution may be regenerated and reused using a known fixing solution regenerating method, such as electrolytic silver recovery. Examples of the regeneration apparatus include Reclaim R-60, trade name, manufactured by Fuji Hunt KK.

It is also preferred to remove dyes or the like through an adsorption filter, such as activated carbon.

When the development and fixing processing agents are liquid agents, it is preferable to store these agents in packing material having low oxygen-permeability as described in, for example, JP-A-61-73147. Moreover, when these solutions are concentrated solutions, they are used after being diluted by adding water in a ratio of 0.2 to 3 parts to 1 part of the concentrated solution such that a given concentration is obtained.

Even if the development and fixing processing agents are solids, the same results as those of the liquid agents can be obtained. Descriptions concerning the solid processing agents will be shown hereinbelow.

For the solid agents, known forms (e.g., a powder, particle, granule, block, tablet, compactor, briquette, plate, bar and paste) may be used. These solid agents may be coated with a water-soluble coating agent or film to separate components, which are mutually brought into contact and reacts, from each other, or may have a structure of plural layers to separate components, which mutually reacts, from each other. Also, these means may be combined.

As the coating agent;.and granulation auxiliary, known materials may be used and a polyvinylpyrrolidone, polyethylene glycol, polystyrenesulfonic acid or vinyl-series compound is preferable. Besides the above compounds, the description of JP-A-5-45805, column 2, line 48 to column 3, line 13 can be made to reference.

When a structure of plural layers is adopted, a material having a structure in which a component that is not reactive is interposed between components that react with each other when brought into contact, may be prepared and may be processed into a tablet or a briquette or the like. Also, components having known forms are used to make the above same layer structure, which is then packaged. These methods are shown in, for instance, JP-A-61-259921, JP-A-4-16841, JP-A-4-78848 and JP-A-5-93991.

The apparent density of the solid agent is preferably 0.5 to 6.0 g/$cm^3$, specifically, 1.0 to 5.0 g/$cm^3$ in the case of a tablet and 0.5 to 1.5 g/$cm^3$ in the case of a granule.

As the method of the production of the solid agent, any known method may be used. For instance, methods described in JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5,-224361, JP-A-6-138604, JP-A-6-138605, JP-A-8-286329 and the like can be made to reference.

More specifically, a rolling granulation method, extrusion granulation method, compression granulation method, cracking granulation method, agitation granulation method, spray drying method, dissolution solidification method, briquetting method, roller compacting method, or the like may be used.

The solid agent may be changed on surface conditions (e.g. smoothness and porousness) and thickness in part, or it may be made into a hollow donut shape, to control solubility. It is also possible to make the solid agents have plural shapes, in order to give plural granulated materials different solubilities, or to make materials having different solubilities accord with each other in solubility. Further, multilayer granulated materials in which the surface and the inside have different compositions may be used.

As the packing material for the solid agent, materials which have low oxygen and water permeability are preferable and as the shape of the package material, known shapes such as a bag form, cylinder form and box form may be used. A foldable form as disclosed in JP-A-6-242585 to JP-A-6-242588, JP-A-6-247432, JP-A-6-247448, JP-A-6-301189, JP-A-7-5664 and JP-A-7-5666 to JP-A-7-5669 is preferable to decrease a space required for storing discarded packings. These packing materials may be provided with a screw cap, pull-top, or aluminum seal at the take-off port or may be heat-sealed. Also, other known materials may be used and the packing materials are not particularly restricted. Moreover, it is preferable to recycle or reuse discarded packings in view of environmental safeguard.

There is no particular limitation to a method of dissolving and replenishing the solid agent of the present invention and known methods may be used. Examples of these methods include a method in which a fixed amount of solid agent is dissolved in a dissolving apparatus with a stirring function and replenished, a method in which the solid agent is dissolved in a dissolving apparatus comprising a dissolution section and a section for stocking a complete solution and is replenished from the stock section as disclosed in JP-A-9-80718, a method in which the processing agent is introduced into a circulatory system of an automatic developing machine to dissolve and replenish the processing agent as disclosed in JP-A-5-119454, JP-A-6-19102 and JP-A-7-261357 and a method in which corresponding to the processing of a light-sensitive material the processing agent is introduced into and dissolved in an automatic developing machine with a built-in dissolving vessel. Also, any one of known methods besides the above methods may be used. Also, the processing agent may be introduced either by human hands or by opening the seal and introducing automatically by using a dissolution apparatus comprising a seal-opening mechanism as described in JP-A-9-138495 and using an automatic developing machine. The latter is preferable in view of working circumstance. Specifically, there are methods of breaking through, peeling off, cutting off and push-cutting the take-off port and methods described in JP-A-6-19102 and JP-A-6-95331.

The light-sensitive material processed through development and fixing is then subjected to water-washing or stabilization (hereinafter, unless otherwise specified, water-washing includes stabilization, and the solution to be used therein is called water or washing water). The water to be used in water-washing may be tap water, ion exchanged water, distilled water, or a stabilizing solution. The replenishing amount of the washing water is generally from about 17 to about 8 liter per $m^2$ of the light-sensitive material, but a replenishing amount lower than the above-described range may also be used. In particular, when the replenishing amount is 3 liter or less (including 0, namely, standing water washing), not only can the processing achieve water savings, it can also dispense with piping for installation of an automatic developing machine. When water-washing is performed with a small replenishing amount of water, a rinsing tank of a squeeze roller or a crossover roller, described in JP-A-63-18350 and JP-A-62-287252, is preferably provided. Alternatively, addition of various oxidizing agents (e.g. ozone, hydrogen peroxide, sodium hypochlorite, active halogen, chlorine dioxide, sodium carbonate hydrogen peroxide salt) or filter filtration may be combined, so as to reduce the pollution load, which is a problem incurred in the case of water-washing with a small amount of water, or for preventing water scale.

As the method for reducing the replenishing amount of washing water, a multi-stage countercurrent system (for example, two or three stages) has been known for a long time, and the replenishing amount of washing water is preferably from 200 to 50 ml per $m^2$ of the light-sensitive material. This effect can also be obtained similarly in the case of an independent multi-stage system (a method of not using a countercurrent system but supplying a new solution individually to the multi-stage water-washing tanks).

A means for preventing water scale may be provided in the water-washing step. The water-scale-preventing means is not particularly restricted, and a known means may be used. Examples thereof include a method of adding a fungicide (a so-called water scale inhibitor), a method of passing electricity, a method of irradiating ultraviolet rays, infrared rays, or far infrared rays, a method of applying a magnetic field, a method of treating with ultrasonic waves, a method of applying heat, and a method of evacuating the tank on standing. The water-scale-preventing means may be applied according to the processing of the light-sensitive material; it may be applied at a predetermined interval irrespective of the use state, or it may be applied only in the period of non-processing time, such as nighttime. Further, the washing water may be previously treated with a water-scale-preventing means and then replenished. Further, in view of preventing generation of resistant microbes, it is preferred to perform different water-scale-preventing means at predetermined intervals.

The fungicide is not particularly restricted, and a known fungicide may be used. Examples thereof include, in addition to the above-described oxidizing agents, a glutaraldehyde, a chelating agent, such as aminopolycarboxylic acid, a cationic surface-active agent, and a mercaptopyridine oxide (e.g. 2-mercaptopyridine-N-oxide), and a sole fungicide may be used, or a plurality of fungicides may be used in combination.

The electricity may be passed according to the method described in JP-A-3-224685, JP-A-3-224687, JP-A-4-16280, or JP-A-4-18980.

In addition, a known water-soluble surface-active agent or defoaming agent may be added, so as to prevent uneven processing due to bubbling, or to prevent transfer of stains. Further, a dye adsorbent described in JP-A-63-163456 may be provided in the water-washing system, so as to prevent stains due to a dye dissolved out from the light-sensitive material.

The overflow solution from the water-washing step may be partly or wholly used by mixing it with the processing solution having fixing ability, as described in JP-A-60-235133. It is also preferred, in view of conservation of the natural environment, to reduce the biochemical oxygen demand (BOD), chemical oxygen demand (COD), or iodine consumption before discharge, by subjecting the solution to microorganism treatment (for example, sulfur oxidation bacteria or activated sludge treatment, or treatment with a filter comprising a porous carrier, such as activated carbon or ceramic, having carried thereon microorganisms) or oxidation treatment with an oxidizing agent or electrification, or to reduce the silver concentration in waste water by passing the solution through a filter, using a polymer having affinity for silver, or by adding a compound that forms a hardly soluble silver complex, such as trimercaptotriazine, to precipitate silver, and then passing the solution through a filter.

In some cases, stabilization may be performed subsequent to the water-washing, and as one example, a bath containing the compounds described in JP-A-2-201357, JP-A-2-132435, JP-A-1-102553, and JP-A-46-44446 may be used as a final bath of the light-sensitive material. This stabilization bath may also contain, if desired, an ammonium compound, a metal compound, such as Bi or Al, a fluorescent brightening agent, various chelating agents, a layer pH-adjusting agent, a hardening agent, a bactericide, a fungicide, an alkanolamine, or a surface-active agent.

The additives, such as a fungicide and the stabilizing agent added to the water-washing or stabilization bath, may be formed into a solid agent, similarly to the above-described development and fixing processing agents.

Wastewater of the developer, the fixing solution, the washing water, or the stabilizing solution used in processing the light-sensitive material of the present invention, is preferably burned for disposal. The wastewater can also be formed into a concentrated solution or a solid by a concentrating apparatus, as described, for example, in JP-B-7-83867 and U.S. Pat. No. 5,439,560, and then disposed.

When the replenishing amount of the processing agent is reduced, it is preferred to prevent evaporation or air oxidation of the solution, by reducing the contact area of the processing tank with air. A roller transportation-type automatic-developing machine is described, for example, in U.S. Pat. Nos. 3,025,779 and 3,545,971, and in the present specification, it is simply referred to as a roller transportation-type automatic processor. This automatic processor comprises four steps of development, fixing, water-washing, and drying, and it is most preferred to follow this four-step processing also in the processing method of the light-sensitive material of the present invention, though other steps (e.g. stopping step) are not excluded. Further, a rinsing bath may be provided between development and fixing, and/or between fixing and water-washing.

In the processing of the light-sensitive material in the present invention, the dry-to-dry time is preferably from 25 to 160 seconds, the development time and the fixing time are each generally 40 seconds or less, preferably from 6 to 35 seconds, and the temperature of each solution is preferably from 25 to 50° C., more preferably from 30 to 40° C. The temperature and the time of water-washing are preferably from 0 to 50° C. and 40 seconds or less, respectively. According to the method in the present invention, the light-sensitive material after development, fixing, and water-washing may be passed through squeeze rollers, for squeezing washing water, and then dried. The drying is generally performed at a temperature of from about 40° C. to about 100° C. The drying time may be appropriately varied depending upon the ambient state. The drying method is not particularly restricted, and any known method may be used, but hot-air drying, and drying by far infrared rays or a heat roller as described in JP-A-4-15534, JP-A-5-2256, and JP-A-5-289294 may be used, and a plurality of drying methods may also be used in combination.

The light-sensitive material of the present invention can form a good high-contrast image and prevents, for example, the sensitivity from fluctuating during storage of the light-sensitive material, exhibiting high storage stability.

The present invention will be explained in more detail by way of examples, which are not intended to be limiting of the present invention.

EXAMPLE

Example 1

<Preparation of Emulsion A>

| | |
|---|---|
| Solution 1 | |
| Water | 750 ml |
| Gelatin | 20 g |
| Sodium chloride | 3 g |
| 1,3-dimethylimidazolidine-2-thion | 20 mg |
| Sodium benzenethiosulfonate | 10 mg |
| Citric acid | 0.7 g |
| Solution 2 | |
| Water | 300 ml |
| Silver nitrate | 150 g |
| Solution 3 | |
| Water | 300 ml |
| Sodium chloride | 38 g |
| Potassium bromide | 32 g |
| Potassium hexachloroiridate (III) (0.005%, aqueous 20% KCl solution) | 5 ml |
| Ammonium hexachlororhodate (0.001%, aqueous 20% NaCl solution) | 7 ml |

Potassium hexachloroiridate (III) (0.005%, aqueous 20% KCl solution) and ammonium hexachlororhodate (0.001%, aqueous 20% NaCl solution) which were used for the solution 3 were prepared by dissolving a powder of each of potassium hexachloroiridate (III) and ammonium hexachlororhodate in an aqueous 20% KCl solution and an aqueous 20% NaCl solution respectively and by heating each solution at 40° C. for 120 minutes.

The solution 2 and the solution 3 were added at the same time to the solution 1 kept at a temperature of 38° C. and a pH of 4.5 in amounts equivalent to 90% of each amount of the second solution and the solution 3 with stirring over 20 minutes to form a nucleus particle having a size of 0.16 $\mu$m.

In succession, the following solution 4 and solution 5 were added to the resulting solution over 8 minutes, and the remaining 10% of each of the solution 2 and the solution 3 were further added over 2 minutes to grow the nucleus particle to a size of 0.21 $\mu$m. 0.15 g of potassium iodide was further added, followed by ripening for five minutes to finish the formation of a particle.

| | |
|---|---|
| Solution 4 | |
| Water | 100 ml |
| Silver nitrate | 50 g |
| Solution 5 | |
| Water | 100 ml |
| Sodium chloride | 13 g |

-continued

| | |
|---|---|
| Potassium bromide | 11 g |
| yellow prussiate of potash | 5 mg |

Thereafter, the resulting product was washed with water by a flocculation method according to a usual method. To state more concretely, the temperature was dropped to 35° C., 3 g of an anionic sedimentation agent-1 shown below was added and the pH was dropped using sulfuric acid to the level at which silver halide was precipitated. (The pH was in a range of 3.2±0.2.) Next, the supernatant was removed in an amount of about 3 l (first water-washing). After 3 l of distilled water was added, sulfuric acid was added until silver halide was precipitated. 3 l of the supernatant was removed again (second water-washing). The same operation as in the second water-washing was further repeated once (third water-washing) to finish a water-washing and desalting step. 45 g of a gelatin was added to the emulsion which was washed with water and desalted and the emulsion was adjusted to pH 5.6 and pAg 7.5. Then, 10 mg of sodium benzenethiosulfonate, 3 mg of sodium benzenethiosulfinate, 15 mg of sodium thiosulfate and 10 mg of chloroaurate were added to the emulsion to carry out chemical sensitization such that optimum sensitivity is obtained at 55° C. Then, 100 mg of 1,3,3a,7-tetrazaindene as a stabilizer and 100 mg of PROXEL (trade name, manufactured by ICI Co., Ltd) as an antiseptic were added to the emulsion.

Finally, a silver chlorobromoiodide cubic particle emulsion containing 70 mol % of silver chloride and 0.08 mol % of silver iodide and having an average particle diameter of 0.22 $\mu$m and a coefficient of variation of 9% was obtained. (Finally, the emulsion qualities were as follows: pH=5.7, pAg=7.5, conductivity=40 $\mu$S/m, density=$1.2\times10^3$ kg/m$^3$, and viscosity=50 mPa·s)

<Preparation of Emulsion B>

| | |
|---|---|
| Solution 1 | |
| Water | 750 ml |
| Gelatin | 20 g |
| Sodium chloride | 1 g |
| 1,3-dimethylimidazolidine-2-thion | 20 mg |
| Sodium benzenethiosulfonate | 10 mg |
| Citric acid | 0.7 g |
| Solution 2 | |
| Water | 300 ml |
| Silver nitrate | 150 g |
| Third solution | |
| Water | 300 ml |
| Sodium chloride | 38 g |
| Potassium bromide | 32 g |
| Potassium hexachloroiridate (III) (0.005%, aqueous 20% KCl solution) | 5 ml |
| Ammonium hexachlororhodate (0.001%, aqueous 20% NaCl solution | 15 ml |

Potassium hexachloroiridate (III) (0.005%, aqueous 20% KCl solution) and ammonium hexachlororhodate (0.001%, aqueous 20% NaCl solution) which were used for the solution 3 were prepared by dissolving a powder of each of potassium hexachloroiridate (III) and ammonium hexachlororhodate in an aqueous 20% KCl solution and an aqueous 20% NaCl solution respectively and by heating each solution at 40° C. for 120 minutes.

The solution 2 and the solution 3 were added at the same time to the solution 1 kept at a temperature of 38° C. and a pH of 4.5 in amounts equivalent to 90% of each amount of the solution 2 and the solution 3 with stirring over 20 minutes to form a nucleus particle having a size of 0.16 μm. After that, 500 mg of 1,3,3a,7-tetrazaindene was added, in succession, the following solution 4 and solution 5 were added to the resulting solution over 8 minutes, and the remaining 10% of each of the solution 2 and the solution 3 were further added over 2 minutes to grow the nucleus particle to a size of 0.18 μm. 0.15 g of potassium iodide was further added, followed by ripening for five minutes to finish the formation of a particle.

| | |
|---|---|
| Solution 4 | |
| Water | 100 ml |
| Silver nitrate | 50 g |
| Solution 5 | |
| Water | 100 ml |
| Sodium chloride | 13 g |
| Potassium bromide | 11 g |
| yellow prussiate of potash | 2 mg |

Thereafter, the resulting product was washed with water by a flocculation method according to a usual method. To state more concretely, the temperature was dropped to 35° C., 3 g of an anionic sedimentation agent-1 shown below was added and the pH was dropped using sulfuric acid to the level at which silver halide was precipitated. (The pH was in a range of 3.2±0.2.) Next, the supernatant was removed in an amount of about 3 l (first water-washing). After 3 l of distilled water was added, sulfuric acid was added until silver halide was precipitated. 3 l of the supernatant was removed again (second water-washing). The same operation as in the second water-washing was further repeated once (third water-washing) to finish a water-washing and desalting step. 45 g of a gelatin was added to the emulsion which was washed with water and desalted and the emulsion was adjusted to pH 5.6 and pAg 7.5. Then, 10 mg of sodium benzenethiosulfonate, 3 mg of sodium benzenethiosulfinate, 2 mg of triphenylphosphine selenide and 1 mg of chloroaurate were added to the emulsion to carry out chemical sensitization such that optimum sensitivity is obtained at 55° C. Then, 100 mg of 1,3,3a,7-tetrazaindene as a stabilizer and 100 mg of PROXEL as an antiseptic were added to the emulsion.

Finally, a silver chlorobromoiodide cubic particle emulsion containing 70 mol % of silver chloride and 0.08 mol % of silver iodide and having an average particle diameter of 0.18 μm and a coefficient of variation of 10% was obtained. (Finally, the emulsion qualities were as follows: pH=5.7, pAg=7.5, conductivity=40 μS/m, density=$1.2\times10^3$ kg/m$^3$ and viscosity=50 mPa·s)

<Preparation of Light-Insensitive Silver Halide Particle (1)>

| | |
|---|---|
| Solution 1 | |
| Water | 1 l |
| Gelatin | 20 g |
| Sodium chloride | 3.0 g |
| 1,3-dimethylimidazolidine-2-thion | 20 mg |
| Sodium benzenethiosulfonate | 8 mg |
| Solution 2 | |
| Water | 400 ml |
| Silver nitrate | 100 g |

-continued

| | |
|---|---|
| Solution 3 | |
| Water | 400 ml |
| Sodium chloride | 13.5 g |
| Potassium bromide | 45.0 g |
| Potassium hexachlororhodate (III) (aqueous 0.001% solution) | 860 ml |

The solution 1 kept at a temperature of 70° C. and a pH of 4.5, the solution 2 and the solution 3 were added to the resulting solution over 15 minutes and at the same time to form a nucleus particle. In succession, the following solution 4 and solution 5 were added to the resulting solution over 15 minutes, and 0.15 g of potassium iodide was added to finish the formation of a particle.

| | |
|---|---|
| Solution 4 | |
| Water | 400 ml |
| Silver nitrate | 100 g |
| Solution 5 | |
| Water | 400 ml |
| Sodium chloride | 13.5 g |
| Potassium bromide | 45.0 g |

Thereafter, the resulting product was washed with water by a flocculation method according to a usual method. To state in detail, the temperature was dropped to 35° C., 3 g of an anionic sedimentation agent-1 shown below was added, and the pH was dropped using sulfuric acid to the level at which silver halide was precipitated. (The pH was in a range of 3.2±0.2.) Next, the supernatant was removed in an amount of about 3 l (first water-washing). After 3 l of distilled water was added, sulfuric acid was added until silver halide was precipitated. 3 l of the supernatant was removed again (second water-washing). The same operation as in the second water-washing was further repeated once (third water-washing) to finish a water-washing and desalting step. 45 g of a gelatin was added to the emulsion which was washed with water and desalted and the emulsion was adjusted to pH 5.7 and pAg 7.5 and then, phenoxy ethanol was added as an antiseptic to obtain a dispersion (1) of a non-ripened silver chlorobromoiodide cubic particle containing 30 mol % of average silver chloride and 0.08 mol % of silver iodide and having an average particle diameter of 0.45 μm and a coefficient of variation of 10% finally. (Finally, the emulsion qualities were as follows: pH=5.7, pAg =7.5, conductivity=40 μS/m, density=$1.3\times10^3$ kg/m$^3$ and viscosity=50 mPa·s)

Anionic Settling Agent-1

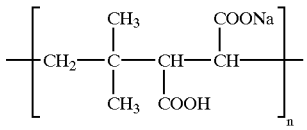

Average molecular weight 120000

Production of a Coated Sample

A structure consisting of a UL layer/emulsion layer/lower protective layer/upper protective layer was formed by application on a polyethylene terephthalate film support with both surfaces being formed of a moisture-proof undercoat containing vinylidene chloride to make a sample.

The preparation method, coating amount and coating method of each layer will be shown below.

<UL Layer>

| | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Antiseptic (PROXEL) | 1.5 mg/m$^2$ |

<Emulsion layer>

The ratio of each of an emulsion A and an emulsion B is shown in Table 1.

| | |
|---|---|
| Sensitizing dye (SD-1) | $5.7 \times 10^{-4}$ mol/mol Ag |
| KBr | $3.4 \times 10^{-4}$ mol/mol Ag |
| Compound (Cpd-1) | $2.0 \times 10^{-4}$ mol/mol Ag |
| Compound (Cpd-2) | $2.0 \times 10^{-4}$ mol/mol Ag |
| Compound (Cpd-3) | $8.0 \times 10^{-4}$ mol/mol Ag |
| 1,3,3a,7-tetrazaindene | $1.2 \times 10^{-4}$ mol/mol Ag |
| Hydroquinone | $1.2 \times 10^{-2}$ mol/mol Ag |
| Citric acid | $3.0 \times 10^{-4}$ mol/mol Ag |
| Hydrazine type nucleating agent (Cpd-4) | Amount shown in Table 1 |
| Compound (Cpd-5) | Amount shown in Table 1 |
| Compound represented by the formula (F) | Amount shown in Table 1 |
| 2,4-dichloro-6-hydroxy-1,3,5-triazine sodium salt | 90 mg/m$^2$ |
| Aqueous latex (aqL-6) | 100 mg/m$^2$ |
| Polyethyl acrylate latex | 150 mg/m$^2$ |
| Colloidal silica (particle diameter: 10 $\mu$m) | 15 wt % to the gelatin |
| Compound (Cpd-7) | 4 wt % to the gelatin |
| Latex copolymer of methylacrylate, sodium 2-acrylamido-2-methylpropane-sulfonate and 2-acetoxyethylmethacrylate (ratio by mass: 88:5:7) | 150 mg/m$^2$ |
| Core/shell-type latex (core: styrene/butadiene copolymer (ratio by mass: 37/63), shell: styrene/2-acetoxyethyl-acrylate (ratio by mass: 84/16), core/shell ratio = 50/50) | 150 mg/m$^2$ |

The pH of the coating solution was adjusted to 5.6 by using citric acid.

The coating solution for an emulsion layer prepared in the above manner was applied to the support shown below such that the amounts of Ag and gelatin were 3.4 g/m$^2$ and 1.5 g/m$^2$ respectively.

<Lower Protective Layer>

| | |
|---|---|
| Gelatin | 0.5 g/m$^2$ |
| Light-insensitive silver halide particle (1) | 0.1 g/m$^2$ as the amount of Ag |
| Compound (Cpd-12) | 15 mg/m$^2$ |
| 1,5-dihydroxy-2-benzaldoxime | 10 mg/m$^2$ |
| Polyethyl acrylate latex | 150 mg/m$^2$ |
| Compound (Cpd-13) | 3 mg/m$^2$ |
| Antiseptic (PROXEL) | 1.5 mg/m$^2$ |

<Upper protective layer>

| | |
|---|---|
| Gelatin | 0.3 g/m$^2$ |
| Undefined silica matt agent having an average size of 3.5 $\mu$m | 25 mg/m$^2$ |
| Compound (Cpd-8) (gelatin dispersion) | 20 mg/m$^2$ |
| Colloidal silica having a particle diameter of 10 to 20 $\mu$m (Snowtex C, manufactured by Nissan Chemical) | 30 mg/m$^2$ |
| Compound (Cpd-9) | 50 mg/m$^2$ |
| Sodium dodecylbenzene-sulfonate | 20 mg/m$^2$ |
| Compound (Cpd-10) | 20 mg/m$^2$ |
| Compound (Cpd-11) | 20 mg/m$^2$ |
| Compound represented by the formula (F) | Amount shown in Table 1 |
| Antiseptic (PROXEL (trade name, manufactured by ICI Co., Ltd.) | 1 mg/m$^2$ |

The viscosity of the coating solution of each layer was adjusted by adding a viscosity-enhancer represented by the following structural formula (Z).

The samples used in the present invention were provided with a backing layer and conductive layer having the following compositions.

<Backing Layer>

| | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-divinylsulfonyl-2-propanol | 60 mg/m$^2$ |
| Polymethylmethacrylate fine particle (average particle diameter: 6.5 $\mu$m) | 30 mg/m$^2$ |
| Liquid paraffin | 78 mg/m$^2$ |
| Compound (Cpd-7) | 120 mg/m$^2$ |
| Calcium nitrate | 20 mg/m$^2$ |
| Antiseptic (PROXEL) | 12 mg/m$^2$ |

<Conductive layer>

| | |
|---|---|
| Gelatin | 0.1 g/m$^2$ |
| Sodium dodecylbenzenesulfonate | 20 mg/m$^2$ |
| $SnO_2$/Sb (mass ratio: 9/1, average diameter: 0.25 $\mu$m) | 200 mg/m$^2$ |
| Antiseptic (PROXEL) | 0.3 mg/m$^2$ |

SD-1

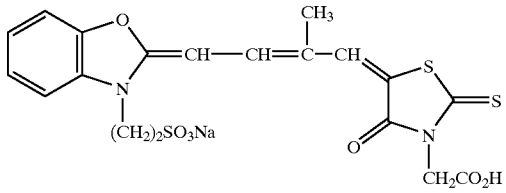

Cpd-1

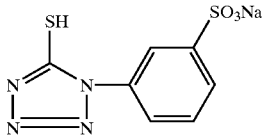

Cpd-2

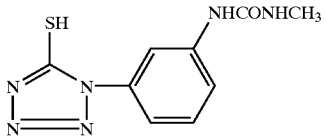

-continued
Cpd-3
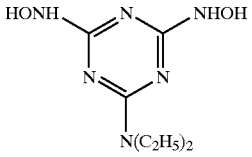
Cpd-132
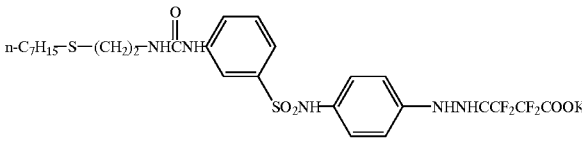
Cpd-5
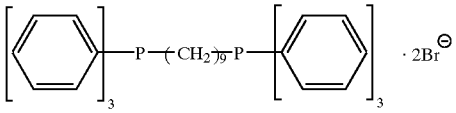
aqL-6
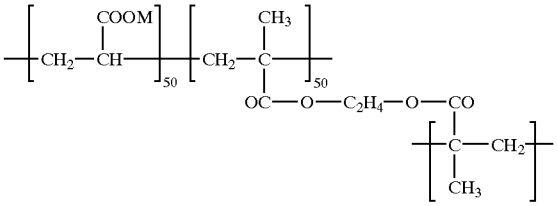
M = H or Na
Cpd-7
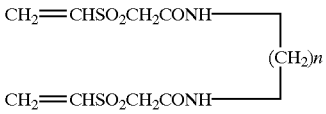
(n = 2):(n = 3) = 3:1
Cpd-8
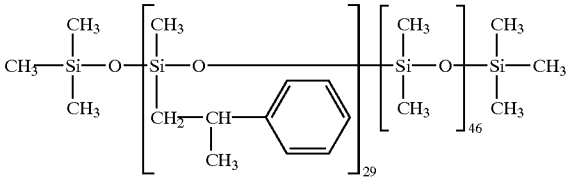
Cpd-9
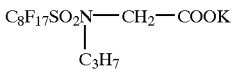
Cpd-10
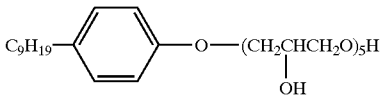
Cpd-11
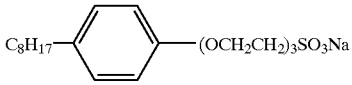
-continued
Cpd-12
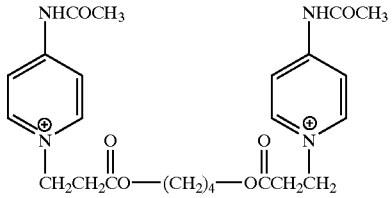
Cpd-13
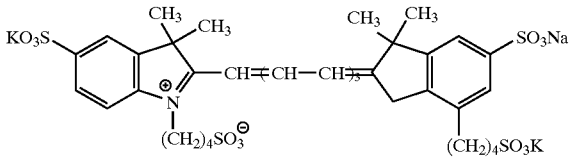
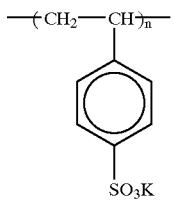
Viscosity-enhancer Z
Cpd-14
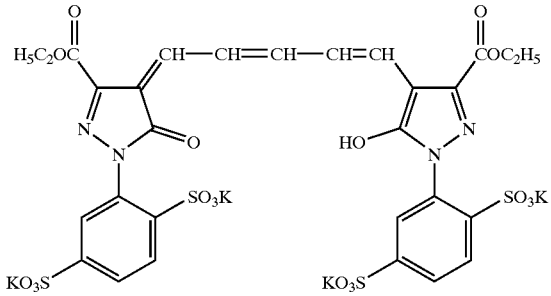
Cpd-15
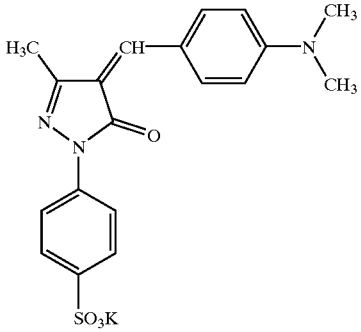

-continued

Cpd-16

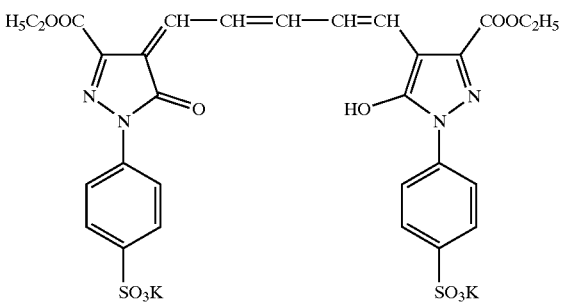

Cpd-17

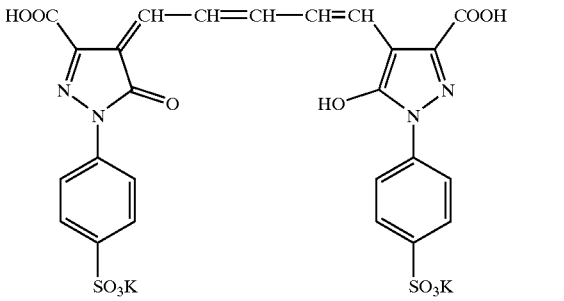

Cpd-18

$CH_3(CH_2)_{11}CH{=}CHSO_3Na$

Cpd-19

$CH_3(CH_2)_{11}CH_2{-}CHSO_3Na$

<Support>

A first undercoat layer and second undercoat layer having the following compositions were applied to both surfaces of a biaxially oriented polyethylene terephthalate support (thickness: 100 μm) respectively.

<First Undercoat Layer>

| | |
|---|---|
| Core/shell-type vinylidene chloride copolymer (1) | 15 g |
| 2,4-dichloro-6-hydroxy-s-triazine | 0.25 g |
| Polystyrene fine particle (average particle diameter: 3 μm) | 0.05 g |
| Compound (Cpd-20) | 0.20 g |
| Colloidal silica (Snowtex ZL: particle diameter: 70 to 100 μm, manufactured by Nissan Chemical) | 0.12 g |
| Water to make | 100 g |

10 mass % of KOH was further added to the above components and the pH was adjusted to 6 to prepare a coating solution, which was then applied and dried at 18° C. for 2 minutes such that the dry film thickness was 0.9 μm.

<Second Undercoat Layer>

| | |
|---|---|
| Gelatin | 1 g |
| Methyl cellulose | 0.05 g |
| Compound (Cpd-21) | 0.02 g |
| $C_{12}H_{25}O(CH_2CH_2O)_{10}H$ | 0.03 g |
| PROXEL | $3.5 \times 10^{-3}$ g |
| Acetic acid | 0.2 g |
| Water to make | 100 g |

This coating solution was applied and dried at 170° C. for 2 minutes such that the dry film thickness was 0.1 μm.

Core/shell-type vinylidene chloride copolymer (1)

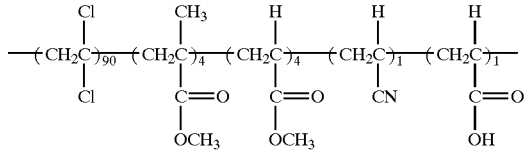

VDC MMA MA AN AA

Core :VDC/MMA/MA (80 mass %)

Shell :VDC/AN/AA (20 mass %)

Average particle size: 70 nm

Compound (Cpd-20)

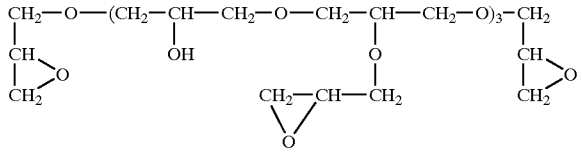

Compound (Cpd-21)

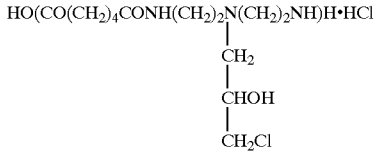

<Coating Method>

On the emulsion-coated surface side of the support that had been provided the above-mentioned undercoat layers, four layers, which were the UL layer, the emultion layer, the lower protective layer, and the upper protective layer were simultaneously multilayer-coated, in this order from the support, in a slide bead coater manner while a hardener solution was added thereto under keeping the temperature at 35° C. The resultant coated film was passed through a cold wind setting zone (5° C.). Thereafter, on the side opposite to the emulsion-coated surface side, the conductive layer and the backing layer were simultaneously multilayer-coated, in this order from this support, in a curtain coater manner while a hardener solution was added thereto. The resultant coated film was passed through a cold wind setting zone (5° C.). When the resultant coated film was passed through each of the cold wind setting zones, the coated solution exhibited sufficient capability of being set. Subsequently, in a drying zone both of the two surfaces of the resultant coated film were simultaneously dried under the following drying conditions. From the end of the coating on the backing surface side to winding of the resultant coated film, the product was carried without contact with a roller or any other member. At this time, the speed of the coating was 120 m/minute.

<Drying Conditions>

After the setting, the above-dried, coated film was dried with dry wind having a temperature of 30° C. until the mass ratio of water/gelatin was 800%. The resultant coated film was dried with dry wind having a temperature of 35° C. and 30% RH (relative humidity) from the mass ratio of 800% to a mass ratio of 200%. The dry wind continued to be applied to the coated film. After 30 seconds from the time when the surface temperature was 34° C. (the time was regarded as the drying was completed), the resultant coated film was dried with air having a temperature of 48° C. and 2% RH for 1 minute. At this time, the time for the drying was as follows: 50 seconds from the start of the drying to the water/gelatin mass ratio of 800%; 35 seconds from the mass ratio of 800% to the mass ratio of 200%; and 5 seconds from the mass ratio of 200% to the end of the drying.

The thus-prepared light-sensitive material was wound at 25° C. and 55% RH. Then, the light-sensitive material was cut in the same environment. After the humidity of this material was adjusted at 25° C. and 50% RH for 8 hours, the light-sensitive material and a cardboard whose humidity was adjusted at 25° C. and 50% RH for 2 hours were airtightly put into a barrier bag whose humidity was adjusted for 6 hours. Thus, each sample shown in Table 1 was prepared.

The humidity in the barrier bag was measured to find that it was 45% RH. Also, the film surface pH on the emulsion layer side of the resultant sample was 5.5 to 5.8, and the film surface pH on the backside was 6.0 to 6.5. The absorption spectrums of the emulsion layer side and on the backing layer side were shown in FIG. 1.

The evaluation was carried out by the following methods.

<Sensitometry>

The resulting sample was exposed to xenon flush light having an emission time of $10^{-6}$ seconds through an interference filter having a peak of 667 nm and a step wedge.

The sample was processed in a FG-680AG automatic developing machine (manufactured by Fuji Photo Film Co., Ltd.) using a developing solution (A) and fixing solution (B) having the following formulations in the developing condition of 35° C. and 30". Developing solution (A) Compositions per 1 L of the concentrated solution are shown.

| | |
|---|---|
| Potassium hydroxide | 60.0 g |
| Diethylenetriamine · pentaacetic acid | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 3-(5-mercaptotetrazole-1-yl)benzenesulfonate | 0.15 g |
| Sodium 2-mercaptobenzoimidazole-5-sulfonate | 0.45 g |
| Sodium erysorbate | 9.0 g |
| Diethylene glycol | 7.5 g |
| pH | 10.79 |

Upon use, the aforementioned concentrated solution was diluted with water at a dilution of 2:1 to prepare a mother liquor having a pH 10.65. Also, the aforementioned concentrated solution was diluted with water at a dilution of 4:3 to prepare a replenishing solution having a pH of 10.62.

| Fixing solution (B) formulation of the concentrated solution are shown. | Formulations per 1 L |
|---|---|
| Ammonium thiosulfate | 360 g |
| Ethylenediamine · tetraacetic acid · 2Na · dihydrate salt | 0.09 g |
| Sodium thiosulfate · pentahydrate | 33.0 g |
| Sodium methasulfite | 57.0 g |
| Sodium hydroxide | 37.2 g |

-continued

| | |
|---|---|
| Acetic acid (100%) | 90.0 g |
| Tartaric acid | 8.7 g |
| Sodium gluconate | 5.1 g |
| Aluminum sulfate | 25.2 g |
| pH | 4.85 |

Upon use, the aforementioned concentrated solution was diluted with water at a dilution of 1:2. The pH of the solution to be used was 4.8.

The gamma (γ) at an optical density of 0.3 to 3.0 is expressed by the value given by the following formula: ((3.0−0.3)/log (exposure amount giving a density of 3.0)−log (exposure amount giving a density of 0.3)).

<Evaluation of Storage Stability>

In order to estimate a variation in the photographic qualities of a green sensitive material (sensitive material provided with no thermal treatment) caused by long-term storage, a variation in sensitivity (ΔS1.5), when the green sensitive material was subjected to forced thermal treatment performed in the conditions of 50° C. and 65% RH for 5 days, was measured. As the sensitive value (S1.5), a logarithmic value of an exposure amount giving a density of 1.5 was used.

ΔS1.5 (storage stability)=−(S1.5 (sensitive material provided with thermal treatment)−S1.5 (sensitive material provided with no thermal treatment))

When the sensitivity rises, ΔS1.5 shows a positive value. It is necessary that the variation in the sensitivity of a sensitive material which is not thermally treated is practically 0.10 or less and preferably 0.05 or less.

<Evaluation of Practical Density>

A test step with 175 lines/inch was output using an image setter FT-R5055 manufactured by Dainippon Screen Mfg. while the quantity of light was changed, and a processing was carried out in the aforementioned processing conditions to measure the density of the Dmax part when the sample was exposed at such an LV value that the density of the intermediate dot was 50%. The density of the Dmax part was defined as the practical density. In this case, the dot % and the practical density were measured using a Macbeth TD904.

The results obtained are shown in Table 1.

It is found from the table that the samples according to the present invention having a gamma of 5.0 or more at a density of 0.3 to 3.0 and containing the compound represented by the formula (F) have a satisfactory high practical density and excellent storage stability.

On the other hand, the samples having a gamma less than 5.0 are inferior to the samples according to the present invention in practical density.

| Sample No. | Emulsion A:B (mol ratio of silver) | Amount of a hydrazine nucleating agent to be added (mol/Ag mol) | Amount of the compound (Cpd-5) to be added (mol/Ag mol) | Amount of the compound of formula (F) to be added ($mg/m^2$) Type | Emulsion layer | Upper protective layer | Photographic characteristics γ | Dmax | Storage characteristics ΔS1.5 | Remarks |
|---|---|---|---|---|---|---|---|---|---|---|
| 1 | 0:1 | — | — | — | — | — | 9.5 | 4.5 | 0.13 | Comparative example |
| 2 | 1:1 | — | — | — | — | — | 8.2 | 4.3 | 0.12 | Comparative example |
| 3 | 1:2 | — | — | — | — | — | 6.8 | 4.2 | 0.12 | Comparative example |
| 4 | 1:4 | — | — | — | — | — | 4.5 | 3.5 | 0.08 | Comparative example |
| 5 | 0:1 | — | — | FS-6 | 30 | 30 | 9.5 | 4.5 | 0.06 | This invention |
| 6 | 1:1 | — | — | FS-17 | 30 | 30 | 8.2 | 4.3 | 0.06 | This invention |
| 7 | 1:2 | — | — | FS-6 | 30 | 30 | 6.8 | 4.2 | 0.07 | This invention |
| 8 | 1:4 | — | — | FS-6 | 30 | 30 | 4.5 | 3.5 | 0.08 | Comparative example |
| 9 | 0:1 | $1.5 \times 10^{-4}$ | $6.0 \times 10^{-4}$ | — | — | — | 24.2 | 5.2 | 0.16 | Comparative example |
| 10 | 1:1 | $1.5 \times 10^{-4}$ | $6.0 \times 10^{-4}$ | — | — | — | 23.9 | 5.1 | 0.21 | Comparative example |
| 11 | 1:2 | $1.5 \times 10^{-4}$ | $6.0 \times 10^{-4}$ | — | — | — | 25.1 | 5.5 | 0.19 | Comparative example |
| 12 | 1:4 | $1.5 \times 10^{-4}$ | $6.0 \times 10^{-4}$ | — | — | — | 22.6 | 5.1 | 0.22 | Comparative example |
| 13 | 0:1 | $1.5 \times 10^{-4}$ | $6.0 \times 10^{-4}$ | FS-6 | 30 | 30 | 24.3 | 5.2 | 0.05 | This invention |
| 14 | 1:1 | $1.5 \times 10^{-4}$ | $6.0 \times 10^{-4}$ | FS-6 | 30 | 30 | 23.8 | 5.2 | 0.04 | This invention |
| 15 | 1:2 | $1.5 \times 10^{-4}$ | $6.0 \times 10^{-4}$ | FS-17 | 30 | 30 | 25.6 | 5.6 | 0.04 | This invention |
| 16 | 1:4 | $1.5 \times 10^{-4}$ | $6.0 \times 10^{-4}$ | FS-6 | 30 | 30 | 23.1 | 5.2 | 0.05 | This invention |

Example 2

The same procedures as in Example 1 were carried out except that the following solid developing solution (C) and solid fixing agent (D) were used. As a consequence, like the samples of Example 1, samples having the structure of the present invention exhibited superior characteristics.

| | |
|---|---|
| Sodium hydroxide (beads) 99.5% | 11.5 g |
| Potassium sulfite (raw powder) | 63.0 g |
| Sodium sulfite (raw powder) | 46.0 g |
| Potassium carbonate | 62.0 g |
| Hydroquinone (briquette) | 40.0 g |
| The following components are briquetted collectively. | |
| Diethylenetriamine · pentaacetic acid | 2.0 g |
| 5-methylbenzotriazole | 0.35 g |
| 4-hydroxymethyl-4-methyl-1-phenyl-3-pyrazolidone | 1.5 g |
| 4-(N-carboxymethyl-N-methylamino)-2,6-dimercaptopyrimidine | 0.2 g |
| Sodium 3-(5-mercaptotetrazole-1-yl)benzenesulfonate | 0.1 g |
| Sodium erysorbate | 6.0 g |
| Potassium bromide | 6.6 g |
| The above components are dissolved in water to make a total volume of 1 l. | |
| pH | 10.65 |

Here, as to the form of the raw materials, a usual industrial product was used as the raw powder as it was, and a commercially available product was used as the beads of the alkali metal salt.

As to the component which the raw material form was a briquette, the raw material which was compressed under pressure by using a briquetting machine into a plate was crushed upon using. As to components contained in small amounts, each component was blended and made into a briquette.

The above treating agent amounting to 10 l was filled in a foldable container made of a high density polyethylene and the output port was sealed using an aluminum seal. A dissolving and replenishing unit provided with an automatic unsealing mechanism as disclosed in JP-A-9-80718 and JP-A-9-138495 was used for dissolving and replenishing the treating agent. Formulation of a solid fixing agent (D)

| | |
|---|---|
| Ammonium thiosultate (compact) | 125.0 g |
| Sodium thiosultate anhydride (raw powder) | 19.0 g |
| Sodium methabisulfite (raw powder) | 18.0 g |
| Sodium acetate anhydride (raw powder) | 42.0 g |
| Agent B (liquid) | |
| Ethylenediamine · tetraacetic acid · 2Na · dihydrate salt | 0.03 g |
| Tartaric acid | 2.9 g |
| Sodium gluconate | 1.7 g |
| Aluminum sulfate | 8.4 g |
| Sulfuric acid | 2.1 g |

The above components are dissolved in water to make a total volume of 50 ml. The agents A and B were dissolved in water to prepare a solution amounting to 1 1 thereby preparing a fixing solution (D). The pH of the solution was 4.8.

As the above ammonium thiosulfate (compact), one obtained by compressing a flake product, manufactured by a spray drying method, under pressure by using a roller compactor and crushing the compressed product into a undefined chip having a size of about 4 to 6 mm was used and blended with the above sodium thiosulfate anhydride. As the aforementioned other raw powders, usual industrial products were used.

The agents A and B respectively amounting to 10 l were filled in a foldable container made of a high density polyethylene. The output port of the container for the agent A was sealed using an aluminum seal whereas the output port of the container for the agent B was closed using a screw cap. A dissolving and replenishing unit provided with an automatic unsealing mechanism as disclosed in JP-A-9-80718 and JP-A-9-138495 was used for dissolving and replenishing the treating agents.

Example 3

The same procedures as in Example 1 were carried out except that the following developing solution (E) was used in place of the developing solution (A). As a consequence, like the samples of Example 1, samples having the structure of the present invention exhibited superior characteristics.

The composition per 1 l of the concentrated solution of the developing solution (E) is shown below.

| | |
|---|---|
| Potassium hydroxide | 105.0 g |
| Diethylenetriamine.pentaacetic acid | 6.0 g |
| Potassium carbonate | 120.0 g |
| Sodium methabisulfite | 120.0 g |
| Potassium bromide | 9.0 g |
| Hydroquinone | 75.0 g |
| 5-methylbenzotriazole | 0.25 g |
| 4-Hydroxymethyl-4-methyl-1-phenyl-3-pyrazolidone | 1.35 g |
| 4-(N-carboxymethyl-N-methylamino)-2,6-dimercaptopyrimidine | 0.3 g |
| Sodium 2-mercaptobenzoimidazole-5-sulfonate | 0.45 g |
| Sodium erysorbate | 9.0 g |
| Diethylene glycol | 60.0 g |
| pH | 10.7 |

Upon use, the aforementioned concentrated solution was diluted with water at a dilution of 1:2. The pH of the solution to be used was 10.5.

Example 4

The developing solution (A) of Example 1 was used to process 20 pieces of 20%-blackened scanner films HL with a complete size (50.8 cm×61 cm), which films were manufactured by Fuji Photo Film Co., Ltd. per a day while the solution was replenished in an amount of 50 ml per one complete size film. This operation, was run six days at a week, was carried out continuously for 15 weeks to process films, thereby obtaining a developing solution in which the concentration of sulfurous acid was reduced to ⅓.

The developing solution (A) of Example 1 was used to process 300 pieces of 80%-blackened scanner films HL with a complete size (50.8 cm×61 cm) which films were manufactured by Fuji Photo Film Co., Ltd. per a day while the solution was replenished in an amount of 50 ml per one complete size film. This operation was run continuously for four days to process a large number of films, thereby obtaining a developing solution whose the pH was decreased to 10.2 and the concentration of bromine ions was increased.

Using the exhausted developing solution and the developing solution of a exhausting stage in the way the same test as in Example 1 was made and as consequence, the light-sensitive material having the structure of the present invention exhibited high qualities in the same manner as Example 1.

Example 5

In Examples 1 to 4, the developing temperature was set to 38° C., the fixing temperature were set to 37° C., and the developing time was set to 20 seconds, to carry out the processing. As a result, the same results as in Examples 1 to 5 were obtained and the effects of the present invention were maintained.

Example 6

In Examples 1 to 4, a FG-680AS model manufactured by Fuji Photo Film Co., Ltd. was used as the automatic developing machine. The carriage speed of the light-sensitive material thereof was set to 1500 mm/min as the line speed to carry out the same processing. Even in this condition, the same results were obtained.

Example 7

Instead of using the image setter FT-R5055 manufactured by Dainippon Screen Mfg. Co., Ltd., any one of Select Set 5000, Abantra 25 or Accuset 1000, manufactured by Agfa Gevaert, Dolev 450 or Dolev 800 manufactured by Scitex Co., Ltd., Lino 630, Quasar, Herkules ELITE or Signa Setter manufactured by Heidel Co., Ltd., Lux Setter RC-5600V or Laxel F-9000 manufactured by Fuji Photo Film Co., Ltd. and Panther Pro 62 manufactured by Prepress was used to make the same evaluation. The sample according to the present invention produced the same effect.

Example 8

In Example 1, the amount of ammonium hexachlororhodate (0.001%, aqueous 20% NaCl solution) to be added to the emulsion B was regulated such that the emulsion had a photographic characteristics y as shown in Table 2 to prepare emulsions C, D and E. Samples were prepared in the same manner as in Example 1 except that these emulsions B to E were used by singly without mixing with the emulsion A as shown in Table 2, the hydrazine nucleating agent was not contained, and the compound (Cpd-22) was used in place of the compound (Cpd-5).

Compound (Cpd-22)

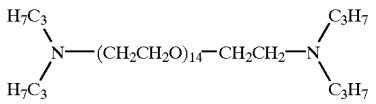

The results obtained are shown in Table 2.

It is understood that the samples according to the present invention have a satisfactory high practical density and are excellent in storage stability.

On the other hand, the samples whose gamma was less than 5.0 have excellent in storage stability, but are poor in practical density, compared to the samples according to the present invention.

TABLE 2

| Sample No. | Emulsion | Amount of the compound (Cpd-22) to be added (mol/Ag mol) | Amount of the compound of formula (F) to be added ($mg/m^2$) Type | Emulsion layer | Upper protective layer | Photographic characteristics γ | Dmax | Storage characteristics ΔS1.5 | Remarks |
|---|---|---|---|---|---|---|---|---|---|
| 17 | B | — | — | — | — | 9.5 | 4.5 | 0.13 | Comparative example |
| 18 | C | — | — | — | — | 7.5 | 4.4 | 0.14 | Comparative example |
| 19 | D | — | — | — | — | 5.8 | 4.2 | 0.11 | Comparative example |
| 20 | E | — | — | — | — | 4.6 | 3.4 | 0.07 | Comparative example |
| 21 | B | — | FS-6 | 40 | 40 | 9.5 | 4.5 | 0.06 | This invention |
| 22 | C | — | FS-6 | 40 | 40 | 7.4 | 4.3 | 0.06 | This invention |
| 23 | D | — | FS-17 | 40 | 40 | 5.9 | 4.2 | 0.07 | This invention |
| 24 | E | — | FS-6 | 40 | 40 | 4.5 | 3.5 | 0.07 | Comparative example |
| 25 | B | $4.0 \times 10^{-3}$ | — | — | — | 11.3 | 4.8 | 0.25 | Comparative example |
| 26 | C | $4.0 \times 10^{-3}$ | — | — | — | 9.8 | 4.6 | 0.23 | Comparative example |
| 27 | D | $4.0 \times 10^{-3}$ | — | — | — | 8.1 | 4.5 | 0.26 | Comparative example |
| 28 | E | $4.0 \times 10^{-3}$ | — | — | — | 7.1 | 4.2 | 0.22 | Comparative example |
| 29 | B | $4.0 \times 10^{-3}$ | FS-6 | 40 | 40 | 11.4 | 4.8 | 0.03 | This invention |
| 30 | C | $4.0 \times 10^{-3}$ | FS-6 | 40 | 40 | 9.8 | 4.6 | 0.04 | This invention |
| 31 | D | $4.0 \times 10^{-3}$ | FS-2 | 40 | 40 | 8.1 | 4.4 | 0.04 | This invention |
| 32 | E | $4.0 \times 10^{-3}$ | FS-6 | 40 | 40 | 7.2 | 4.2 | 0.04 | This invention |

Example 9

<Preparation of Emulsion F>

500 ml of an aqueous silver nitrate solution in which 150 g of silver nitrate was dissolved and 500 ml of an aqueous halide solution in which 44 g of potassium bromide, containing $(NH_4)_2RhCl_5(H_2O)$ equivalent to $2\times10^{-7}$ mol per 1 mol of silver obtained after particles were formed and $K_3IrCl_6$ equivalent to $1\times10^{-7}$ mol per 1 mol of silver, and 34 g of sodium chloride were dissolved, were added to an aqueous 2% gelatin solution obtained by dissolving 3 g of sodium chloride, 0.02 g of 1,3-dimethyl-2-imidazolithion, 0.5 g of citric acid, 4 mg of sodium benzenethiosulfonate and 1 mg of sodium benzenethiosulfinate in water whose the total volume was 1 l, with stirring at 38° C. for 20 minutes by using a double jet method, to obtain silver chlorobromide particles having an average particle size of 0.21 μm and containing 58 mol % of silver chloride, thereby accomplishing the formation of a nucleus. In succession, 200 ml of an aqueous silver nitrate solution in which 50 g of silver nitrate was dissolved and 200 ml of an aqueous halide solution in which 12 g of potassium bromide containing potassium hexacyanoferrate (II) equivalent to $1\times10^{-5}$ mol per 1 mol of total silver contained in the emulsion and 13 g of sodium chloride were dissolved were added to the resulting mixture by using. a double jet method over 10 minutes.

Thereafter, a KI solution was added in an amount of $1\times10^{-3}$ mol per 1 mol of silver to carry out conversion and the resulting product was washed with water by a flocculation method according to a usual method. To state in detail, the temperature was dropped to 35° C., 3 g of an anionic sedimentation agent-1 shown below was added and the pH was dropped using sulfuric acid to the level at which silver halide was precipitated. (The pH was in a range of 3.2±10.2.) Next, the supernatant was removed in an amount of about 3 l (first water-washing). After 3 l of distilled water was added, sulfuric acid was added until silver halide was precipitated. 3 l of the supernatant was removed again (second water-washing). The same operation as in the second water-washing was further repeated once (third water-washing) to finish a water-washing and desalting step. 40 g of a gelatin per 1 mol of silver was added to the emulsion which was washed with water and desalted, and the emulsion was adjusted to pH 5.9 and pAg 7.5. Then, 8 mg of sodium benzenethiosulfonate, 2 mg of sodium benzenesulfinate, 3 mg of sodium thiosulfate, 2 mg of triphenylphosphine selenide and 8 mg of chloroaurate per 1 mol of silver were added to the emulsion, followed by heating at 55° C. for 60 minutes to carry out chemical sensitization. Then, 150 mg of 4-hydroxy-6-methyl-1,3,3a,7-tetrazaindene as a stabilizer and 100 mg of PROXEL (trade name, manufactured by ICI Co., Ltd.) as an antiseptic were added to the emulsion. The resulting particle was a silver chlorobromoiodide cubic particle having an average particle size of 0.23 μm and a coefficient of variation of 10% and containing 60 mol % of silver chloride. (Finally, the emulsion qualities were as follows: pH=5.9, pAg=7.2, conductivity=37 μS/m, density=$1.20\times10^3$ $kg/m^3$ and viscosity=20 mPa·s)

<Preparation of Emulsion G>

250 ml of an aqueous silver nitrate solution in which 75 g of silver nitrate was dissolved and 250 ml of an aqueous halide solution in which 16 g of potassium bromide, containing $(NH_4)_2RhCl_5(H_2O)$ equivalent to $4\times10^{-7}$ mol per 1 mol of total silver contained in the emulsion and $K_3IrCl_6$ equivalent to $1\times10^{-7}$ mol per 1 mol of silver, and 20 g of sodium chloride were dissolved, were added to an aqueous 2% gelatin solution obtained by dissolving 4 g of sodium chloride, 0.02 g of 1,3-dimethyl-2-imidazolithion, 0.5 g of citric acid, 4 mg of sodium benzenethiosulfonate and 1 mg of sodium benzenethiosulfinate in water whose the total volume was 1 l, with stirring at 45° C. for 12 minutes by using a double jet method, to obtain silver chlorobromide particles having an average particle size of 0.20 μm and containing 70 mol % of silver chloride, thereby accomplishing the formation of a nucleus. In succession, 400 ml of an aqueous silver nitrate solution in which 125 g of silver nitrate was dissolved and 400 ml of an aqueous halide solution in which 26 g of potassium bromide and 34 g of sodium chloride were dissolved were added to the resulting mixture by using a double jet method over 20 minutes.

Thereafter, a KI solution was added in an amount of $1\times10^{-3}$ mol per 1 mol of silver to carry out conversion and the resulting product was washed with water by a flocculation method according to a usual method. To state in detail, the same procedures as in the preparation of the emulsion A were carried out. Then, 40 g of a gelatin per 1 mol of silver was added to the emulsion which was washed with water and desalted, and the emulsion was adjusted to pH 6.0 and pAg 7.5. Then, 7 mg of sodium benzenethiosulfonate, 2 mg of sodium benzenesulfinate, 8 mg of chloroaurate and 5 mg of sodium thiosulfate per 1 mol of silver were added to the emulsion, followed by heating at 60° C. for 60 minutes to carry out chemical sensitization. Then, 250 mg of 4-hydroxy-6-methyl-1,3,3a,7-tetrazaindene as a stabilizer and 100 mg of PROXEL (trade name, manufactured by ICI Co., Ltd.) as an antiseptic were added to the emulsion. The resulting particle was a silver chlorobromoiodide cubic particle having an average particle diameter of 0.28 μm and a coefficient of variation of 10% and containing 70 mol % of silver chloride. (Finally, the emulsion qualities were as follows: pH=6.1, pAg=7.5, conductivity=46 μS/m, density= $1.20\times10^3$ kg/m$^3$ and viscosity=62 mPa·s)

<Preparation of Coated Sample>

A structure consisting of a UL layer/hydrazine-containing EM layer/intermediate layer/redox compound-containing EM layer/protective layer was formed by application on a polyethylene terephthalate film support with both surfaces being formed of a moisture-proof undercoat containing vinylidene chloride as shown below to make a sample.

The preparation method, coating amount and coating method of each layer will be shown below.

(UL Layer)

| | |
|---|---|
| Gelatin | 0.3 g/m$^2$ |

(including PROXEL (trade name, manufactured by ICI Co., Ltd.) as an antiseptic)

Nucleation accelerator

| | |
|---|---|
| Polyethylacrylate dispersion | 0.25 g/m$^2$ |
| Film hardener 1,2-bis(vinylsulfonylacetamido)ethane | 50 mg/m$^2$ |

The pH of the coating solution was adjusted to 5.8.

(Hydrazine-Containing EM Layer)

<Preparation of Coating Solution for Hydrazine-Containing Layer Emulsion>

Emulsion A

| | |
|---|---|
| Sensitizing dye represented by the structural formula (S-1) | $5\times10^{-4}$ mol/mol Ag |
| Potassium bromide | $1\times10^{-3}$ mol/mol Ag |
| Mercapto compound represented by the structural formula (a) | $5\times10^{-4}$ mol/mol Ag |
| Mercapto compound represented by the structural formula (b) | $5\times10^{-4}$ mol/mol Ag |
| Triazine compound represented by the structural formula (c) | $1\times10^{-4}$ mol/mol Ag |
| Hydrazine nucleating agents-A and B | $1\times10^{-4}$ mol/mol Ag |
| Colloidal silica (Snowtex C manufactured by Nissan Chemical) | 500 mg/m$^2$ |
| Polyethylacrylate dispersion | 500 mg/m$^2$ |

Compound represented by the formula (F) according to the present invention. Amount shown in Table 3 The pH of the solution was adjusted to 5.8

(S-1)

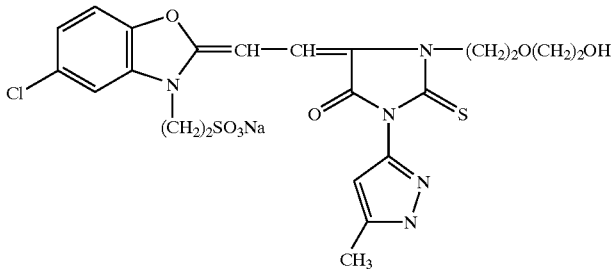

(a)

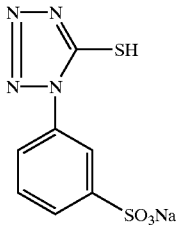

-continued (b)

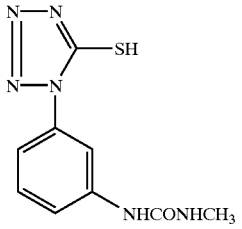

(c)

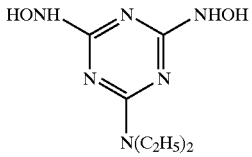

Hydrazine nucleating agent-A

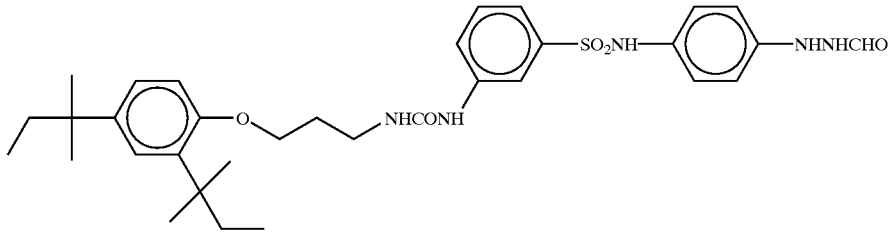

Hydrazine nucleating agent-B

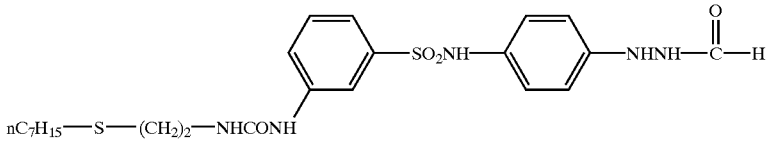

The resulting coating solution for a silver halide emulsion was applied such that the amounts of Ag and gelatin were 3.4 g/m$^2$ and 1.6 g/m$^2$ respectively.

(Intermediate Layer)

<Preparation of Coating Solution for Intermediate Layer>

| | |
|---|---|
| Gelatin | 1.0 g/m$^2$ |

(including PROXEL (trade name, manufactured by ICI Co., Ltd.) as an antiseptic)

| | |
|---|---|
| Sodium ethanethiosulfonate | 5 mg/m$^2$ |
| Dye (e) | 50 mg/m$^2$ |
| Hydroquinone | 100 mg/m$^2$ |
| 5-Chloro-8-hydroxyquinoline | 10 mg/m$^2$ |
| Polyethylacrylate dispersion | 100 mg/m$^2$ |

The pH of the solution was adjusted to 7.0.

(Redox Compound-Containing EM Layer)

<Preparation of Coating Solution for Redox Compound-Containing Layer Emulsion>

Emulsion B

| | |
|---|---|
| Sensitizing dye represented by the structural formula (S-1) | 1 × 10$^{-4}$ mol/mol Ag |
| Mercapto compound represented by the structural formula (a) | 5 × 10$^{-4}$ mol/mol Ag |
| Triazine compound represented by the structural formula (c) | 1 × 10$^{-4}$ mol/mol Ag |
| Dye represented by the formula (f) | 5 mg/m$^2$ |
| Polyethylacrylate dispersion | 100 mg/m$^2$ |
| Film hardener 1,2-bis(vinylsulfonylacetamide)ethane | 50 mg/m$^2$ |
| Redox compound (R-1) | 2.1 × 10$^{-4}$ mol/m$^2$ |

The pH of the solution was adjusted to 5.4

At this time, as the redox compound, an emulsion prepared in the following manner was dissolved at 60° C. and added to the coating solution.

(Preparation of a Redox Emulsion)

| Solution A | |
|---|---|
| Ethyl acetate | 30 ml |
| Avobe-described redox compound | 8 g |
| Sodium p-dodecylbenzenesulfonate | 0.3 g |
| Oils represented by the structural formula (P-1) and (P-2) respectively | 4 g each |

These components were dissolved at 60° C. to prepare a solution A.

| Solution B | |
|---|---|
| Water | 170 g |
| Gelatin | 8.5 g |
| PROXEL (trade name, manufactured by ICI Co., Ltd.) | 0.05 g |

These components were dissolved at 60° C. to prepare a solution B.

These solutions A and B were mixed and emulsion-dispersed at 60° C. by using a high-speed homogenizer. After the emulsion-dispersion was finished, the solvent was removed at 60° C. under reduced pressure to obtain an emulsion-dispersion containing 4 wt % of a redox compound.

The resulting coating solution for a redox compound-containing layer emulsion was applied such that the amounts of silver and gelatin were 0.4 g/m$^2$ and 0.5 g/m$^2$ respectively.

| <Protective layer> | |
|---|---|
| Gelatin | 0.2 g/m$^2$ |
| $SiO_2$ matt agent (undefined, average particle size: about 3.5 $\mu$m) | 50 mg/m$^2$ |
| Colloidal silica (Snowtex C, manufactured by Nissan Chemical) | 60 mg/m$^2$ |
| Liquid paraffin | 50 mg/m$^2$ |
| Fluorine type surfactant represented by the structural formula (g) concerning coating adjuvants | 1 mg/m$^2$ |
| Sodium p-dodecylbenzenesulfonate | 10 mg/m$^2$ |
| Compound represented by the formula (F) | |

The viscosity of the coating solution of each layer was adjusted by adding a thickener represented by the following structural formula (Z).

(e)

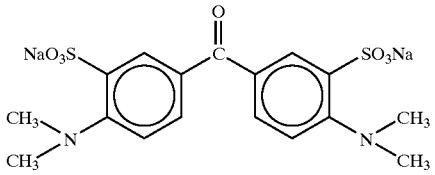

(f)

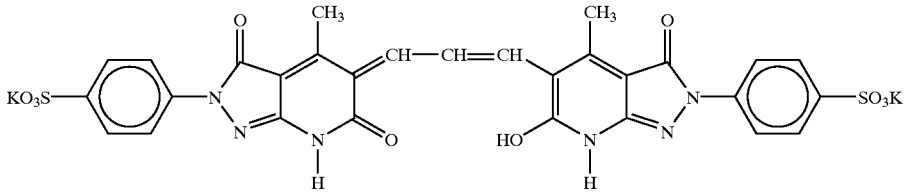

(R-1)

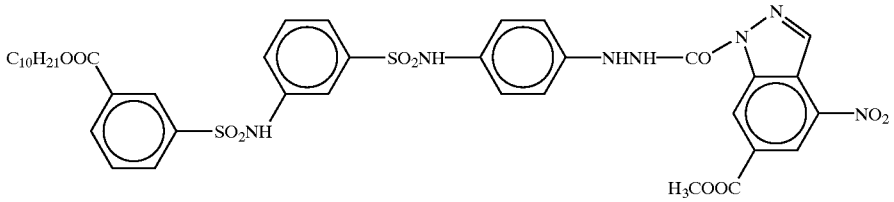

(P-1)

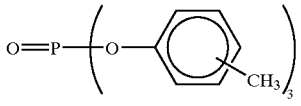

(P-2)

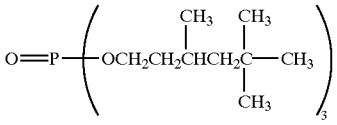

-continued (g)

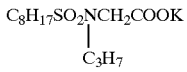

Also, the backing layer was coated using the following composition.

| <Backing layer> | |
|---|---|
| Gelatin | 2.8 g/m$^2$ |
| Surfactants: | |
| Sodium p-dodecylbenzenesulfonate | 40 mg/m$^2$ |
| Sodium dihexyl-α-sulfosuccinate | 40 mg/m$^2$ |
| Gelatin hardening agent: | |
| 1,2-bis(vinylsulfonylacetamide)ethane | 200 mg/m$^2$ |
| $SnO_2$/Sb (weight ratio: 90/10, average particle diameter: 0.20 μm) | 200 mg/m$^2$ |
| Dye (a mixure of the following dyes (h-1), (h-2), (h-3), and (h-4)) | |
| Dye (h-1) | 20 mg/m$^2$ |
| Dye (h-2) | 50 mg/m$^2$ |
| Dye (h-3) | 20 mg/m$^2$ |
| Dye (h-4) | 30 mg/m$^2$ |
| Antiseptic agent (PROXEL, trade name) | 10 mg/m$^2$ |
| <Back protective layer> | |
| Gelatin | 1.1 g/m$^2$ |
| Fine particles of a polymethylmethacrylate (average particle size: 2.5 μm) | 20 mg/m$^2$ |
| Sodium p-dodecylbenzenesulfonate | 15 mg/m$^2$ |
| Sodium dihexyl-α-sulfosuccinate | 15 mg/m$^2$ |
| Sodium acetate | 60 mg/m$^2$ |
| Antiseptic agent (PROXEL, trade name) | 1 mg/m$^2$ |

(h-1)

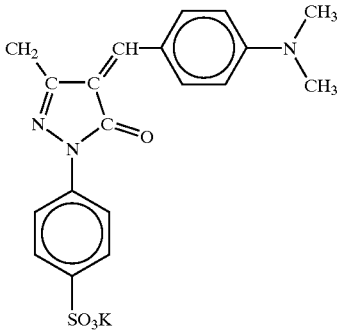

(Z)

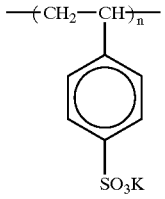

-continued (h-2)

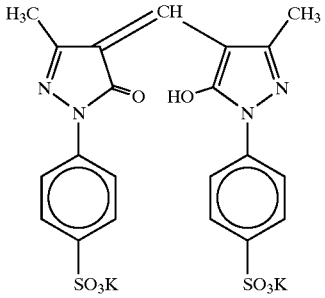

(h-3)

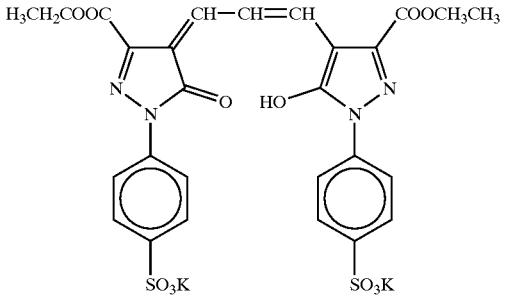

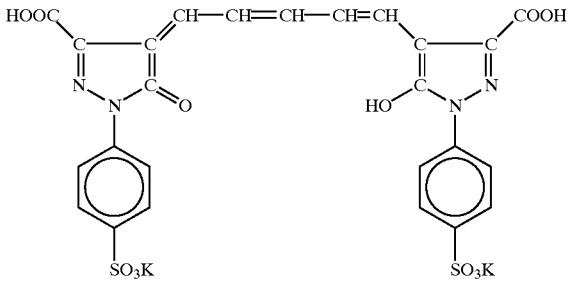

A support, first under-coated layer, and second under-coated layer is same as that of Example 1.

<Coating Method>

On the emulsion-coated surface side of the support that had been provided the above-mentioned undercoat layers, five layers, which were the UL layer, the hydrazine-containing EM layer, the intermediate layer, the redox compound-containing EM layer, and the protective layer were simultaneously multilayer-coated, in this order from the support, in a slide bead coater manner while a hardener solution was added thereto under keeping the temperature at 35° C. The resultant coated film was passed through a cold wind setting zone (5° C.). Thereafter, on the side opposite to the emulsion-coated surface side, the backing layer and the back protective layer were simultaneously multilayer-coated, in this order from this support, in a curtain coater manner while a hardener solution was added thereto. The resultant coated film was passed through a cold wind setting zone (5° C.). When the resultant coated film was passed through each of the cold wind setting zones, the coated solution exhibited sufficient capability of being set. Subsequently, in a drying zone both of the two surfaces of the resultant coated film were simultaneously dried under the following drying conditions. From the end of the coating on the backing surface side to winding of the resultant coated film, the product was carried without contact with a roller or any other member. At this time, the speed of the coating was 120 m/minute.

<Drying Conditions>

After the setting, the above-dried, coated film was dried with dry wind having a temperature of 30° C. until the mass ratio of water/gelatin was 800%. The resultant coated film was dried with dry wind having a temperature of 35° C. and 30% RH (relative humidity) from the mass ratio of 800% to a mass ratio of 200%. The dry wind continued to be applied to the coated film. After 30 seconds from the time when the surface temperature was 34° C. (the time was regarded as the drying was completed), the resultant coated film was dried with air having a temperature of 48° C. and 2% RH for 1 minute. At this time, the time for the drying was as follows: 50 seconds from the start of the drying to the water/gelatin mass ratio of 800%; 35 seconds from the mass ratio of 800% to the mass ratio of 200%; and 5 seconds from the mass ratio of 200% to the end of the drying.

<Evaluation of Practical Density>

A manuscript with lines 40 μm wide was prepared using photocomposition paper PR-100WP manufactured by Fuji Photo Film Co., Ltd. This manuscript was photographically printed on the coated sample by using a photomechanical camera Fine Zoom C-880 manufactured by Dainippon Screen Mfg. Co., Ltd. (processed by an automatic developing machine LD-281Q integrated with a camera). Processing was performed using the aforementioned developing solution (A) and fixing solution (B) in the condition of 35° C. and 30". The density of the black solid part when the resulting line on the sample had a width of 40 μm was defined as a practical Dmax.

<Evaluation of Storage Characteristics>

The evaluation was made in the same manner as in Example 1.

The obtained results are shown in Table 3.

It is found from Table 3 that the samples according to the present invention have high practical density and are also excellent in storage stability.

It is found from Table 3 that, on the contrary, the samples excluding the compound represented by the formula (F) are significantly inferior in storage stability.

TABLE 3

| Sample | Amount of the compound of formula (F) to be added ($mg/m^2$) | | | Photographic characteristics | | Storage characteristics | |
|---|---|---|---|---|---|---|---|
| No. | Type | Hydrazine-containing EM layer | Protective layer | γ | Dmax | ΔS1.5 | Remarks |
| 33 | — | — | — | 9.5 | 5.1 | 0.21 | Comparative example |
| 34 | FS-6 | 20 | 20 | 9.4 | 5.2 | 0.09 | This invention |
| 35 | FS-6 | 40 | 40 | 9.6 | 5.1 | 0.07 | This invention |
| 36 | FS-6 | 80 | 80 | 9.5 | 5.0 | 0.04 | This invention |

The thus-prepared light-sensitive material was wound at 25° C. and 55% RH. Then, the light-sensitive material was cut in the same environment. After the humidity of this material was adjusted at 25° C. and 50% RH for 8 hours, the light-sensitive material and a cardboard whose humidity was adjusted at 25° C. and 50% RH for 2 hours were airtightly put into a barrier bag whose humidity was adjusted for 6 hours. Thus, each sample shown in Table 3 was prepared.

The humidity in the barrier bag was measured. As a result, the humidity was 53% RH. The pH of the film surface of the emulsion layer side of the resultant samples was 5.5 to 5.8.

The evaluation was made using the following methods.

As the developing solution and the fixing solution, the developing solution (A) and the fixing solution (B) shown in Example 1 were used and each sample was processed at 35° C. for 30 seconds.

<Sensitometry>

The resulting sample was exposed to the light of a tungsten light source through a step wedge. The sample was processed in a FG-680AG. automatic developing machine (manufactured by Fuji Photo Film Co., Ltd.) using the developing solution (A) and the fixing solution (B) in the developing condition of 35° C. and 30".

The density of the processed sample was measured using visible light to prepare a characteristic curve, thereby finding y at a density ranging from 0.3 to 3.0.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide photographic light-sensitive material that has at least one silver halide emulsion layer on a support, the light-sensitive material containing a surfactant represented by the following formula (F), and having the characteristic curve that a gamma in the range of an optical density from 0.3 to 3.0 is 5.0 or more, on the characteristic curve shown in a rectangular coordinate where a logarithmic exposure amount (the x axis) and an optical density (the y axis) are indicated according to the same unit length;

$$[Rf—(Rc)_n]_m—Z \qquad \text{formula (F)}$$

wherein Rf represents a perfluoroalkyl group, Rc represents an alkylene group, Z represents a group having an anionic group, cationic group, amphoteric ionic group, or nonionic polar group, n is 1, and m is an integer of 1 to 3.

2. The silver halide photographic light-sensitive material as claimed in claim 1, wherein the pH of a film surface on the silver halide emulsion layer side is 6.0 or less.

3. The silver halide photographic light-sensitive material as claimed in claim 1, further containing a metal that belongs to the group VIII in the periodic table.

4. The silver halide photographic light-sensitive material as claimed in claim 1, further containing a rhodium compound, an iridium compound or a ruthenium compound.

5. The silver halide photographic light-sensitive material as claimed in claim 1, wherein Rc is an ethylene group in the above-described formula (F).

6. The silver halide photographic light-sensitive material as claimed in claim 1, wherein the compound represented by formula (F) is contained in a surface protective layer or a back protective layer.

7. The silver halide photographic light-sensitive material as claimed in claim 1, wherein the amount of the compound represented by formula (F) to be used is within the range from 0.1 to 200 $mg/m^2$ on the surface side or back surface side of the light-sensitive material, respectively.

8. The silver halide photographic light-sensitive material as claimed in claim 1, further containing a hydrazine compound.

9. The silver halide photographic light-sensitive material as claimed in claim 8, wherein the hydrazine compound is represented by the following formula (D);

Formula (D)

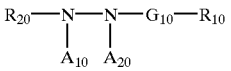

wherein $R_{20}$ represents an aliphatic group, an aromatic group, or a heterocyclic group, $R_{10}$ represents a hydrogen atom or a blocking group, $G_{10}$ represents a —CO—, —COCO—, —C(=S)—, —$SO_2$—, —SO—, —PO($R_{30}$)— (in which $R_{30}$ has the same meaning as defined in $R_{10}$, and $R_{30}$ and $R_{10}$ may be the same or different), or an iminomethylene group, $A_{10}$ and $A_{20}$ each represent a hydrogen atom, or one of $A_{10}$ and $A_{20}$ is a hydrogen atom and the other of $A_{10}$ and $A_{20}$ is a substituted or unsubstituted alkylsulfonyl group, a substituted or unsubstituted arylsulfonyl group, or a substituted or unsubstituted acyl group.

10. The silver halide photographic light-sensitive material as claimed in claim 8, wherein the hydrazine compound is added to any of the at least one silver halide emulsion layer or to a hydrophilic colloid layer adjacent thereto on the silver halide emulsion layer side of the support.

11. The silver halide photographic light-sensitive material as claimed in claim 8, wherein the amount of the hydrazine compound to be used is from $1\times10^{-5}$ to $1\times10^{-2}$ mol per mol of silver halide.

12. The silver halide photographic light-sensitive material as claimed in claim 1, containing further at least one compound selected from the group consisting of an amine derivative, an onium salt, a disulfide derivative, and a hydroxymethyl derivative as a nucleation accelerator.

* * * * *

UNITED STATES PATENT AND TRADEMARK OFFICE

CERTIFICATE OF CORRECTION

PATENT NO. : 6,468,710 B1
DATED : October 22, 2002
INVENTOR(S) : Shoji Yasuda

It is certified that error appears in the above-identified patent and that said Letters Patent is hereby corrected as shown below:

Title page,
Please add the following information:

-- [30] Foreign Application Priority Data

Sep. 28, 2000 (JP)……..2000-297386
Jul. 16, 2001 (JP)……..2001-215661 --

Signed and Sealed this

Twenty-fourth Day of June, 2003

JAMES E. ROGAN
*Director of the United States Patent and Trademark Office*